US007475698B2

(12) United States Patent
Bigott

(10) Patent No.: US 7,475,698 B2
(45) Date of Patent: Jan. 13, 2009

(54) KITCHENWARE WASHERS AND METHODS OF MANUFACTURING THE SAME

(75) Inventor: James W Bigott, Fenton, MO (US)

(73) Assignee: Steelkor, L.L.C., Fenton, MO (US)

( * ) Notice: Subject to any disclaimer, the term of this patent is extended or adjusted under 35 U.S.C. 154(b) by 136 days.

(21) Appl. No.: 11/113,405

(22) Filed: Apr. 22, 2005

(65) Prior Publication Data

US 2006/0237046 A1 Oct. 26, 2006

(51) Int. Cl.
*B08B 3/04* (2006.01)

(52) U.S. Cl. ..... 134/190; 134/191

(58) Field of Classification Search ..... 134/56 R, 134/56 D, 110, 111, 184, 189, 190, 191, 200
See application file for complete search history.

(56) References Cited

U.S. PATENT DOCUMENTS

| | | | | |
|---|---|---|---|---|
| 392,517 | A | 11/1888 | King | |
| 560,673 | A * | 5/1896 | Atkinson | 134/98.1 |
| 982,578 | A * | 1/1911 | Dilg | 134/148 |
| 1,104,139 | A * | 7/1914 | Rodda | 134/148 |
| 1,200,289 | A | 10/1916 | Wittemann | |
| 1,414,634 | A * | 5/1922 | Fassio | 134/96.1 |
| 1,420,759 | A | 6/1922 | Sawicki | |
| 1,508,828 | A | 9/1924 | Wholey | |
| 1,533,159 | A | 4/1925 | Blakeslee | |
| 1,545,081 | A | 7/1925 | Cowles | |
| 1,566,312 | A | 12/1925 | Coates | |
| 1,570,296 | A | 1/1926 | Cave | |
| 1,605,961 | A * | 11/1926 | Loew | 134/111 |
| 1,658,413 | A | 2/1928 | Patelski | |
| 1,790,902 | A | 2/1931 | Cowles | |
| 1,793,431 | A | 2/1931 | Charles | |
| 1,853,529 | A | 4/1932 | Zademach | |
| 1,878,685 | A | 9/1932 | Elkington | |

(Continued)

FOREIGN PATENT DOCUMENTS

DE 2 304 035 8/1974

(Continued)

OTHER PUBLICATIONS

European Patent Office 0 343 153 May 1989.*

(Continued)

*Primary Examiner*—Frankie L Stinson
(74) *Attorney, Agent, or Firm*—Harness, Dickey & Pierce, P.L.C.

(57) ABSTRACT

A kitchenware washing assembly includes a tank for holding fluid for washing kitchenware, and at least one pump. The kitchenware washing assembly can also include at least one outlet chamber for dispensing fluid into the tank, and at least one intake chamber for receiving fluid from the tank. The kitchenware washing assembly may also include at least one intake cover for separating the intake chamber from the tank. The intake cover can include a plurality of inlets and at least one projection that extends into the tank. In addition, either or both of the outlet chamber and/or intake chamber can be configured to have positive drainage from the chamber into the tank. Further, the kitchenware washing assembly may include one or more detachable outlet covers configured to cover the outlet chamber. The detachable outlet cover can include a plurality of outlets for directing fluid into the tank.

17 Claims, 49 Drawing Sheets

U.S. PATENT DOCUMENTS

| | | | | | |
|---|---|---|---|---|---|
| 1,917,829 | A | | 7/1933 | Cole | |
| 1,934,539 | A | | 11/1933 | Henderson | |
| 1,961,548 | A | | 6/1934 | Caise | |
| 1,966,572 | A | * | 7/1934 | Webb | 239/553 |
| 2,091,838 | A | | 8/1937 | Staak | |
| 2,115,577 | A | * | 4/1938 | Goldman | 210/494.1 |
| 2,205,113 | A | * | 6/1940 | Adams | 134/89 |
| 2,208,397 | A | | 7/1940 | Shawber | |
| 2,217,531 | A | * | 10/1940 | Werneth | 134/199 |
| 2,254,824 | A | | 9/1941 | Large | |
| 2,278,994 | A | | 4/1942 | Kempton | |
| 2,287,591 | A | * | 6/1942 | Adams | 366/134 |
| 2,289,890 | A | | 7/1942 | Walter | |
| 2,299,053 | A | | 10/1942 | Ferris | |
| 2,307,363 | A | | 1/1943 | Dunham | |
| 2,360,145 | A | | 10/1944 | Lansing | |
| 2,444,355 | A | | 6/1948 | Kniznick | |
| 2,473,007 | A | * | 6/1949 | Carson | 210/196 |
| 2,501,887 | A | | 3/1950 | Cress | |
| 2,530,028 | A | * | 11/1950 | Petersen | 68/190 |
| 2,563,109 | A | * | 8/1951 | Franklin | 134/148 |
| 2,564,186 | A | | 8/1951 | Benck | |
| 2,589,247 | A | * | 3/1952 | Guzzetti et al. | 68/184 |
| 2,596,653 | A | | 5/1952 | Clague et al. | |
| 2,619,100 | A | * | 11/1952 | Palotsee | 134/104.4 |
| 2,630,813 | A | | 3/1953 | Murdoch | |
| 2,632,452 | A | | 3/1953 | Spitzer | |
| 2,645,235 | A | | 7/1953 | Wheeler | |
| 2,649,756 | A | | 8/1953 | Anderson | |
| 2,651,311 | A | | 9/1953 | Rule | |
| 2,659,804 | A | | 11/1953 | Dunn | |
| 2,667,975 | A | * | 2/1954 | Seaholm | 210/388 |
| 2,669,240 | A | * | 2/1954 | Thorson | 134/95.3 |
| 2,701,574 | A | | 2/1955 | Hollerith | |
| 2,721,928 | A | | 10/1955 | Boydstun | |
| 2,786,123 | A | | 3/1957 | Arthur | |
| 2,796,993 | A | * | 6/1957 | Imershein | 210/231 |
| 2,797,567 | A | | 7/1957 | Heien | |
| 2,842,144 | A | | 7/1958 | Lyman | |
| 2,896,642 | A | | 7/1959 | Lilly | |
| 2,900,992 | A | * | 8/1959 | Johnson | 134/122 R |
| 2,912,988 | A | | 11/1959 | Kochendorffer | |
| 2,918,925 | A | | 12/1959 | Dopler | |
| 2,970,819 | A | * | 2/1961 | Kleebauer | 366/270 |
| 2,975,626 | A | | 3/1961 | Frey | |
| 2,987,260 | A | * | 6/1961 | Sasnett | 239/231 |
| 3,036,996 | A | | 5/1962 | Kogon | |
| 3,055,378 | A | | 9/1962 | Alford | |
| 3,072,527 | A | | 1/1963 | Cohen | |
| 3,072,935 | A | * | 1/1963 | Ruby | 15/4 |
| 3,076,886 | A | | 2/1963 | Altman et al. | |
| 3,086,538 | A | * | 4/1963 | Voltz | 134/111 |
| 3,087,504 | A | | 4/1963 | Geschka | |
| 3,108,607 | A | | 10/1963 | Blakeslee | |
| 3,117,583 | A | | 1/1964 | Hearn et al. | |
| 3,129,711 | A | | 4/1964 | Schmitt-Matzen | |
| 3,136,903 | A | | 6/1964 | Marvin | |
| 3,217,721 | A | | 11/1965 | Hertel | |
| 3,230,961 | A | | 1/1966 | Benkert et al. | |
| 3,277,906 | A | | 10/1966 | Goldman | |
| 3,378,858 | A | * | 4/1968 | Jacuzzi | 210/163 |
| 3,420,226 | A | | 1/1969 | Berry, Sr. | |
| 3,444,355 | A | | 5/1969 | Arthur | |
| 3,453,417 | A | | 7/1969 | Hummel | |
| 3,533,841 | A | * | 10/1970 | Kurt | 134/111 |
| 3,568,935 | A | * | 3/1971 | Hoffman | 239/568 |
| 3,586,011 | A | | 6/1971 | Mazza | |
| 3,592,205 | A | * | 7/1971 | Sheppard | 134/104.4 |
| 3,621,856 | A | | 11/1971 | Guth | |
| 3,673,042 | A | | 6/1972 | Mayers | |
| 3,680,567 | A | | 8/1972 | Hansen | |
| 3,729,481 | A | | 4/1973 | Sones et al. | |
| 3,747,772 | A | * | 7/1973 | Brown | 210/493.1 |
| 3,846,615 | A | | 11/1974 | Athey et al. | |
| 3,863,657 | A | * | 2/1975 | Irving | 134/57 D |
| 4,004,600 | A | | 1/1977 | Corn et al. | |
| 4,197,016 | A | | 4/1980 | Winterhalter et al. | |
| 4,227,546 | A | | 10/1980 | Bergeson | |
| 4,357,176 | A | | 11/1982 | Anthony | |
| 4,439,242 | A | | 3/1984 | Hadden | |
| 4,460,005 | A | | 7/1984 | Rodger | |
| 4,509,543 | A | | 4/1985 | Livingston et al. | |
| 4,615,744 | A | | 10/1986 | Murtha | |
| 4,641,671 | A | | 2/1987 | Nogi et al. | |
| 4,655,197 | A | | 4/1987 | Atkinson | |
| 4,673,441 | A | | 6/1987 | Mayers | |
| 4,753,258 | A | | 6/1988 | Seiichiro | |
| 4,773,436 | A | * | 9/1988 | Cantrell et al. | 134/108 |
| 4,776,359 | A | | 10/1988 | Federighi et al. | |
| 4,784,167 | A | | 11/1988 | Thomas et al. | |
| 4,794,228 | A | | 12/1988 | Braun, Jr. | |
| 5,000,206 | A | | 3/1991 | Kramer et al. | |
| 5,017,852 | A | | 5/1991 | Nagata et al. | |
| 5,056,542 | A | | 10/1991 | Reinhard | |
| 5,131,419 | A | | 7/1992 | Roberts | |
| 5,136,143 | A | | 8/1992 | Kutner et al. | |
| 5,143,101 | A | | 9/1992 | Mor | |
| 5,197,499 | A | | 3/1993 | Bodenmiller et al. | |
| 5,241,975 | A | | 9/1993 | Yanagihara | |
| 5,322,078 | A | | 6/1994 | Tuttle | |
| 5,333,631 | A | | 8/1994 | Kirkland et al. | |
| 5,470,142 | A | | 11/1995 | Sargeant et al. | |
| 5,482,064 | A | | 1/1996 | Goddard | |
| 5,525,161 | A | | 6/1996 | Milocco et al. | |
| 5,556,478 | A | | 9/1996 | Brady et al. | |
| 5,601,100 | A | | 2/1997 | Kawakami et al. | |
| 5,603,233 | A | | 2/1997 | Erickson et al. | |
| 5,608,927 | A | * | 3/1997 | Lowry et al. | 4/615 |
| 5,622,196 | A | | 4/1997 | Luongo | |
| 5,725,002 | A | | 3/1998 | Payzant | |
| 5,775,347 | A | * | 7/1998 | Hoover et al. | 134/56 D |
| 5,819,770 | A | | 10/1998 | Randall et al. | |
| 5,839,097 | A | | 11/1998 | Klausner | |
| 5,839,454 | A | | 11/1998 | Matz | |
| 5,860,361 | A | | 1/1999 | Nanjyo et al. | |
| 5,890,503 | A | | 4/1999 | Bowen | |
| 5,905,648 | A | | 5/1999 | Badami | |
| 5,924,433 | A | | 7/1999 | Thies et al. | |
| 5,927,309 | A | | 7/1999 | Hoover et al. | |
| 5,934,298 | A | | 8/1999 | Singh | |
| 5,941,259 | A | | 8/1999 | Cleveland | |
| 5,946,448 | A | | 8/1999 | Taylor | |
| 5,961,937 | A | | 10/1999 | Gobbato | |
| 5,983,608 | A | | 11/1999 | Wu et al. | |
| 6,019,110 | A | | 2/2000 | McClure et al. | |
| 6,044,854 | A | | 4/2000 | Marks | |
| 6,058,247 | A | | 5/2000 | Lahey et al. | |
| 6,092,541 | A | | 7/2000 | Crane et al. | |
| 6,095,163 | A | | 8/2000 | McClure et al. | |
| 6,102,056 | A | | 8/2000 | Kotsopey | |
| 6,132,532 | A | | 10/2000 | Okuda et al. | |
| 6,189,551 | B1 | | 2/2001 | Sargeant et al. | |
| 6,228,180 | B1 | | 5/2001 | Caroli | |
| 6,260,565 | B1 | | 7/2001 | Welch et al. | |
| 6,289,530 | B1 | * | 9/2001 | Miller et al. | 4/619 |
| 6,289,908 | B1 | | 9/2001 | Kelsey | |
| 6,327,730 | B1 | | 12/2001 | Corbett | |
| 6,363,950 | B2 | | 4/2002 | Nishibe et al. | |
| 6,390,104 | B1 | | 5/2002 | Gagnon | |
| 6,484,738 | B1 | | 11/2002 | Andrews et al. | |
| 6,521,180 | B2 | | 2/2003 | Sergio et al. | |
| 6,550,488 | B2 | | 4/2003 | McKee | |
| 6,659,114 | B2 | | 12/2003 | Bigott | |
| 6,666,218 | B2 | | 12/2003 | Lavole et al. | |

| | | | | |
|---|---|---|---|---|
| 6,791,288 | B2 | 9/2004 | Peterson et al. | |
| 6,799,943 | B2 | 10/2004 | Racer et al. | |
| 7,049,714 | B2 | 5/2006 | Tran | |
| 7,051,765 | B1 * | 5/2006 | Kelley et al. | 138/44 |
| 2001/0045226 | A1 | 11/2001 | Todd | |
| 2002/0100773 | A1 | 8/2002 | Rodd et al. | |
| 2002/0108969 | A1 | 8/2002 | Rodd et al. | |
| 2004/0007256 | A1 | 1/2004 | Durazzani et al. | |
| 2004/0118433 | A1 | 6/2004 | Bigott | |

FOREIGN PATENT DOCUMENTS

| | | |
|---|---|---|
| DE | 2337027 | 2/1975 |
| DE | 39 11 305 | 10/1989 |
| DE | 38 32 144 | 3/1990 |
| DE | 39 14 760 | 11/1990 |
| DE | 41 12 230 | 10/1992 |
| DE | 296 13 432 | 10/1996 |
| EP | 677800 | 10/1995 |
| FR | 2 596 429 | 10/1987 |
| FR | 2 804 005 | 7/2001 |
| GB | 361049 | 11/1931 |
| GB | 2 284 540 | 6/1995 |
| GB | 2 348 117 | 9/2000 |
| JP | 1-126940 | 5/1989 |
| JP | 1-293821 | 11/1989 |
| JP | 2-45094 | 2/1990 |
| JP | 3-237962 | 10/1991 |
| JP | 6-296574 | 10/1994 |
| JP | 8-317892 | 12/1996 |
| JP | 9-28651 | 2/1997 |
| JP | 9-108158 | 4/1997 |
| JP | 10-258014 | 9/1998 |
| JP | 11-30440 | 2/1999 |
| JP | 11-128150 | 5/1999 |
| JP | 2002-58626 | 2/2002 |
| JP | 2004-222976 | 8/2004 |
| KR | 2002049323 | 6/2002 |
| SE | 9200856 | 9/1993 |
| WO | WO 93/01640 | 1/1993 |

OTHER PUBLICATIONS

Euorpean Patent Offcice 0 310 385 Apr. 1989.*

Entitled "Kitchenware Washers and Methods of Manufacturing the Same" Bigott Apr. 22, 2005.

Brown-Campbell Company, 2003, Types & Constructions of Bar Grating, may be seen at http://brown-campbell.com/bartype.htm (1 page).

* cited by examiner

KITCHENWARE WASHERS AND METHODS OF MANUFACTURING THE SAME

FIELD OF THE INVENTION

The present invention relates to commercial kitchenware washers for washing large quantities of commercial kitchenware, and to methods of manufacturing kitchenware washers.

BACKGROUND OF THE INVENTION

Commercial washers have been in the marketplace for decades. Many of the commercial washers that are currently on the market include multiple tanks for various cleaning stages (e.g., a scraping tank, washing tank, rinsing tank, and sanitizing tank). The washing tank, at a basic level, typically includes features such as a rectangular tank with a drain, a valve for closing the drain, nozzles attached to walls of the tank for directing water down into the tank, and a pump to circulate water from within the tank into a manifold that feeds the water through the nozzles.

SUMMARY OF THE INVENTION

According to one aspect of the present invention, a kitchenware washing assembly includes a tank for holding fluid for washing kitchenware, at least one pump, at least one outlet for dispensing fluid into the tank, and at least one intake chamber for receiving fluid from the tank. The kitchenware washing assembly further includes at least one intake cover for separating the intake chamber from the tank. The intake cover includes a plurality of inlets and at least one projection that extends into the tank.

According to another aspect of the present invention, a kitchenware washing assembly includes a tank for holding fluid for washing and at least one pump. The kitchenware washing assembly further includes at least one of an intake chamber for receiving fluid from the tank, and an outlet chamber on a wall of the tank for dispensing fluid into the tank. Either or both of the outlet chamber and/or intake chamber can be configured to have positive drainage from the chamber into the tank.

In another aspect of the invention, a kitchenware washing assembly includes a tank for holding fluid for washing kitchenware, at least one pump, and at least one inlet for receiving fluid from the tank. The kitchenware washing assembly also includes at least one outlet chamber on a wall of the tank for dispensing fluid into the tank. The kitchenware washing assembly further includes at least one detachable outlet cover configured to cover the outlet chamber. The detachable outlet cover includes a plurality of outlets for directing fluid into the tank. In further aspects, the invention provides such detachable outlet covers and methods of using the same.

Further aspects and features of the present invention will become apparent from the detailed description provided hereinafter. It should be understood that the detailed description and specific examples, while indicating exemplary embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF EXEMPLARY EMBODIMENTS

The following description of various embodiments is merely exemplary in nature and is in no way intended to limit the invention, its applications, or uses.

Figure 15A:
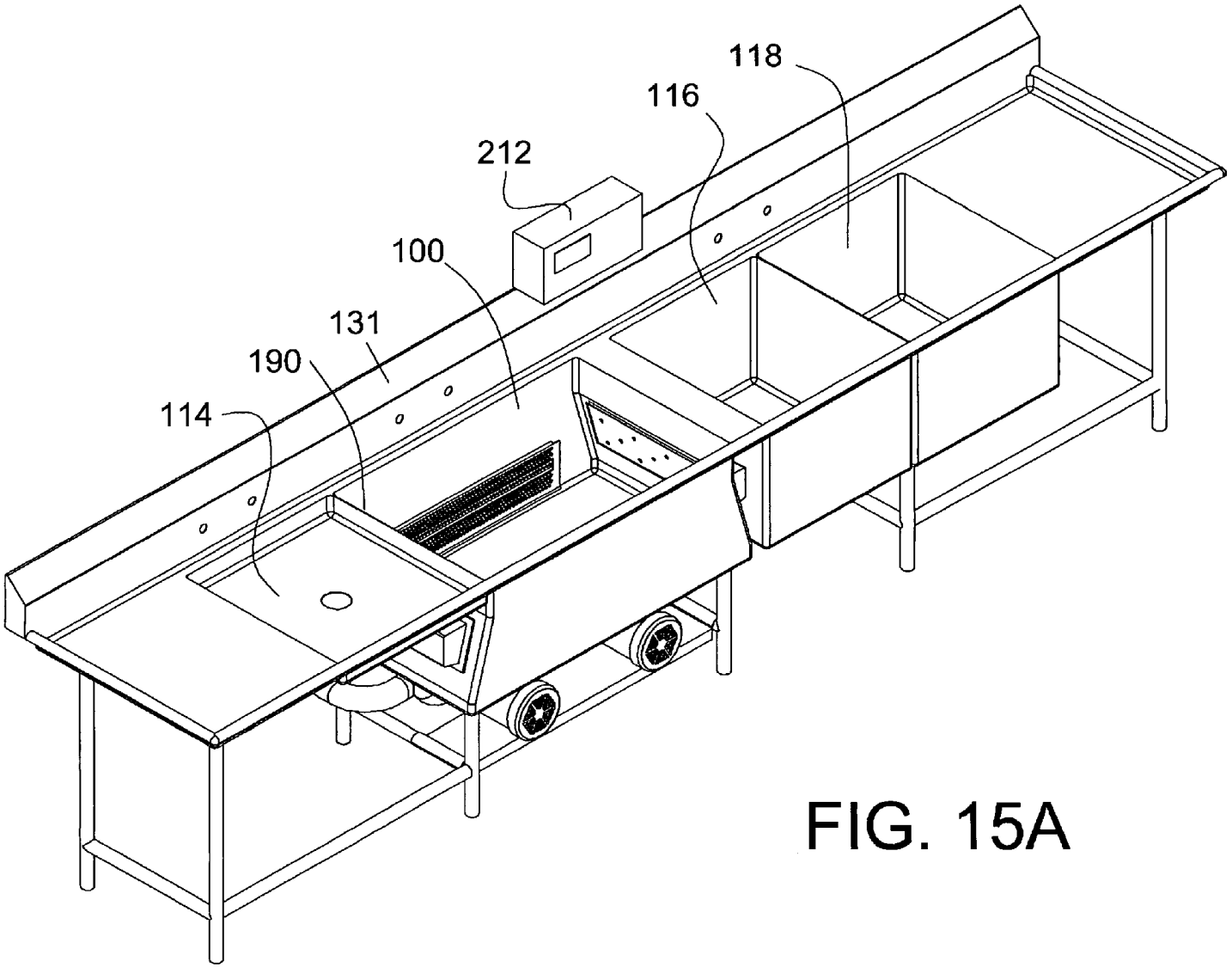
FIGS. 15A and 15B are perspective views of the kitchenware washing assembly shown in FIG. 1 and a control system that can be used for controlling one or more operations of the kitchenware washing assembly, and also illustrating the kitchenware washing assembly incorporated into a compete commercial kitchenware washing system according to one embodiment of the invention.
Figure 15B:
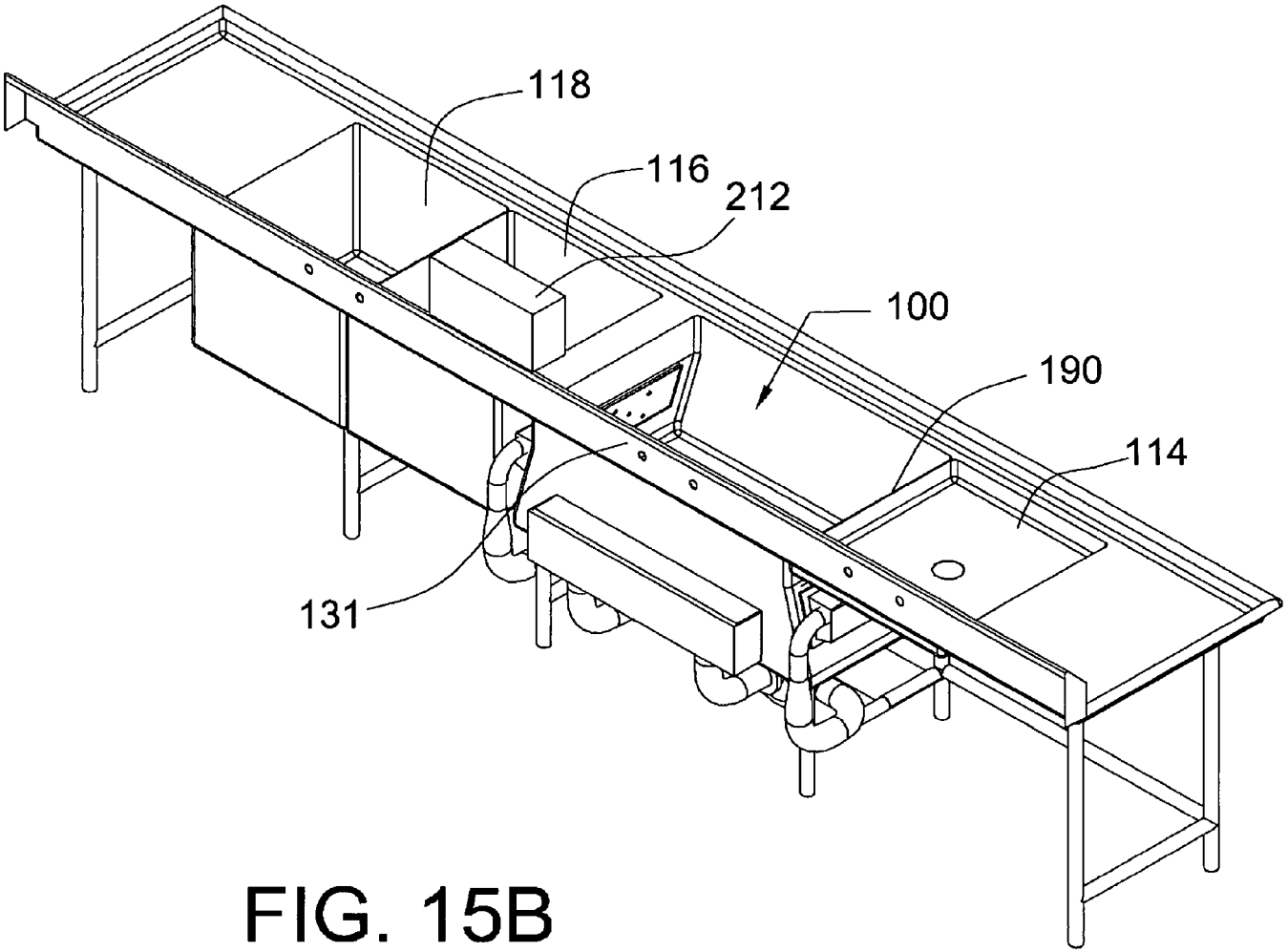

Aspects of the present invention can be adapted to be included in a commercial washer system for commercial or large-scale kitchens, as shown in FIGS. 15A and 15B. Commercial washer systems typically include several contiguous stations such as an initial scraping station to remove bulk food items that have stuck to the dishware, a washing station to wash the remaining food items or food residues from the dishware, a rinsing tank to rinse the soap or cleaning fluids from the dishware, and a sanitizing station to sanitize the cleaned dishware. Various embodiments of the present invention provide washers that are capable of washing a variety of kitchenware, including dishware, food service ware and equipment, pots, pans, food trays, grease filters, gratings, or any other items found in commercial or large-scale kitchens that require cleaning.

A kitchenware washing assembly according to one aspect of the invention includes at least one wall defining at least a portion of a tank for holding fluid for washing kitchenware. The washing assembly also includes at least one pump and at least one chamber in fluid communication with the tank. At least part of the chamber is formed unitary with a wall of the tank, which tends to reduce the overall amount of welding, labor, and costs associated with manufacturing the kitchenware washing assembly.

In another aspect of the invention, a kitchenware washing assembly includes a tank for holding fluid for washing kitchenware. The tank includes two wall portions, and an outlet positioned on each of the two wall portions. The washing assembly further includes an inlet, and two pumps for pumping the fluid from the inlet to the outlets. Accordingly, various embodiments of the invention provide washing assemblies that include two variable speed pumps, wherein each pump is separately operable at a different speed as compared to the other pump. In such embodiments, one of the pumps may remain active while the other pump is idle or inoperable (e.g., due to a failure or malfunction). In addition, this multi-pump design also increases the effectiveness of the washer by providing more turbulence, while also allowing the washer to clean dishware having varied fragility, for example, by only operating one of the pumps at a relatively low rate while the other pump is idle.

In another aspect of the invention, a kitchenware washing assembly includes a tank for holding fluid for washing and at least one pump. The washing assembly further includes at least one of an intake chamber for receiving fluid from the tank, and an outlet chamber on a wall of the tank for dispensing fluid into the tank. Either or both of the outlet chamber and/or intake chamber can have positive draining. For example, various embodiments include an outlet chamber configured to provide drainage into the tank and/or an intake chamber configured to provide drainage into the tank. In these embodiments, fluid will drain out of the intake chamber and/or outlet chamber into the tank such that little to no fluid will remain within the intake chamber and/or outlet chamber when the washing assembly is drained.

In another aspect of the present invention, a kitchenware washing assembly includes a tank for holding fluid for washing kitchenware, at least one pump, at least one outlet for dispensing fluid into the tank, and at least one intake chamber for receiving fluid from the tank. The washing assembly further includes at least one intake cover for separating the intake chamber from the tank. The intake cover includes a plurality of inlets (e.g., holes, perforations, openings, etc.) and at least one projection that extends into the tank. The projection inhibits kitchenware (e.g., plates, pans, etc.) from being drawn up against the inlets and blocking fluid passage through the inlets, which might otherwise decrease operational efficiency of the kitchenware washing assembly. In various embodiments, the intake cover is readily detachable from the tank, which, in turn, allows the intake cover, its inlet holes, and the intake chamber (and components therein) to be more easily serviced. For example, the intake cover can be removed in order to replace the intake cover, to clean out the inlet holes, to clean the intake cover, to clean the intake chamber, and/or to replace a heating element within the intake chamber.

In another aspect of the invention, a kitchenware washing assembly includes a tank for holding fluid for washing kitchenware, at least one pump, and at least one inlet for receiving fluid from the tank. The washing assembly also includes at least one outlet chamber on a wall of the tank for dispensing fluid into the tank. The washing assembly further includes at least one detachable outlet cover configured to cover the outlet chamber. The detachable outlet cover includes a plurality of outlets (e.g., discharge openings, holes, perforations, pipes, etc.) for directing fluid into the tank. In various embodiments, the outlet cover is readily detachable from the tank, which, in turn, allows the outlet cover and outlet chamber to be serviced (e.g., cleaned, replaced, etc.) much easier.

In addition, various embodiments include a plurality of detachable interchangeable outlet covers each of which is configured to cover the outlet chamber. Each outlet cover has a plurality of outlets forming a different pattern (e.g., arranged differently, differently sized, differently shaped, etc.) from the other outlet covers. By selecting from amongst the interchangeable outlet covers, the fluid flow pattern into the tank can be customized or varied for a particular application (e.g., particular type of kitchenware, different customer performance levels, etc.). Accordingly, the interchangeable outlet covers can further increase the utility and efficiency of the kitchenware washing assembly.

In another aspect of the invention, a kitchenware washing assembly includes a tank for holding fluid for washing kitchenware, at least one pump, at least one outlet for dispensing fluid into the tank, and at least one inlet for receiving fluid from the tank. The washing assembly further includes a control system with a consolidated removable control module. The consolidated removable control module includes electronic components (e.g., a circuit breaker, a fuse, a motor starter, a relay, a printed circuit board electronic circuitry, etc.) for substantially controlling one or more operations of the washing assembly. In various embodiments, the removable control module is a pluggable module such that, in the event of a failure, the entire module can be removed and replaced in its entirety by a layperson. Advantageously, this can allow for the elimination of costly service calls by a technician, for example, to perform diagnostics in the field to determine which individual component failed, and downtime of the machine while waiting for that service to be performed.

Any of the above described aspects of the present invention can be used in combination with any one or more of the other aspects of the present invention.

An exemplary kitchenware washing assembly embodying several aspects of the invention is illustrated in FIGS. 1 through 13 and is indicated generally by reference character 100. As shown in FIGS. 1 through 13, the washing assembly 100 includes a tank 102, two pumps 104 and 106, and outlets or discharge openings 108.

The tank can and typically should include a drain 110 and valve system (not shown) to allow the tank 102 to be filled and emptied. The tank 102 will also typically include a faucet (not shown) to fill the tank 102.

In general operation, the tank 102 is filled to operating level. One or both of the pumps 104 and/or 106 can be operating to pump cleaning fluid (e.g., water and a detergent or soap) from tank 102 through intake cover 150 to outlets or discharge openings 108. The drain 110 and valve system should be in a closed position to maintain the cleaning fluid in the tank 102. By way of example only, FIGS. 15A and 15B show the washing assembly 100 incorporated into an overall commercial washing system, including a scraping station 114, the washing assembly 100, a rinsing station 116, and a sanitizing station 118. Also shown in FIGS. 15A and 15B is an exemplary control system 212 (described in more detail below and shown in FIGS. 34 through 36) that can be used for controlling one or more operations of the kitchenware washing assembly 100.

Figure 1:
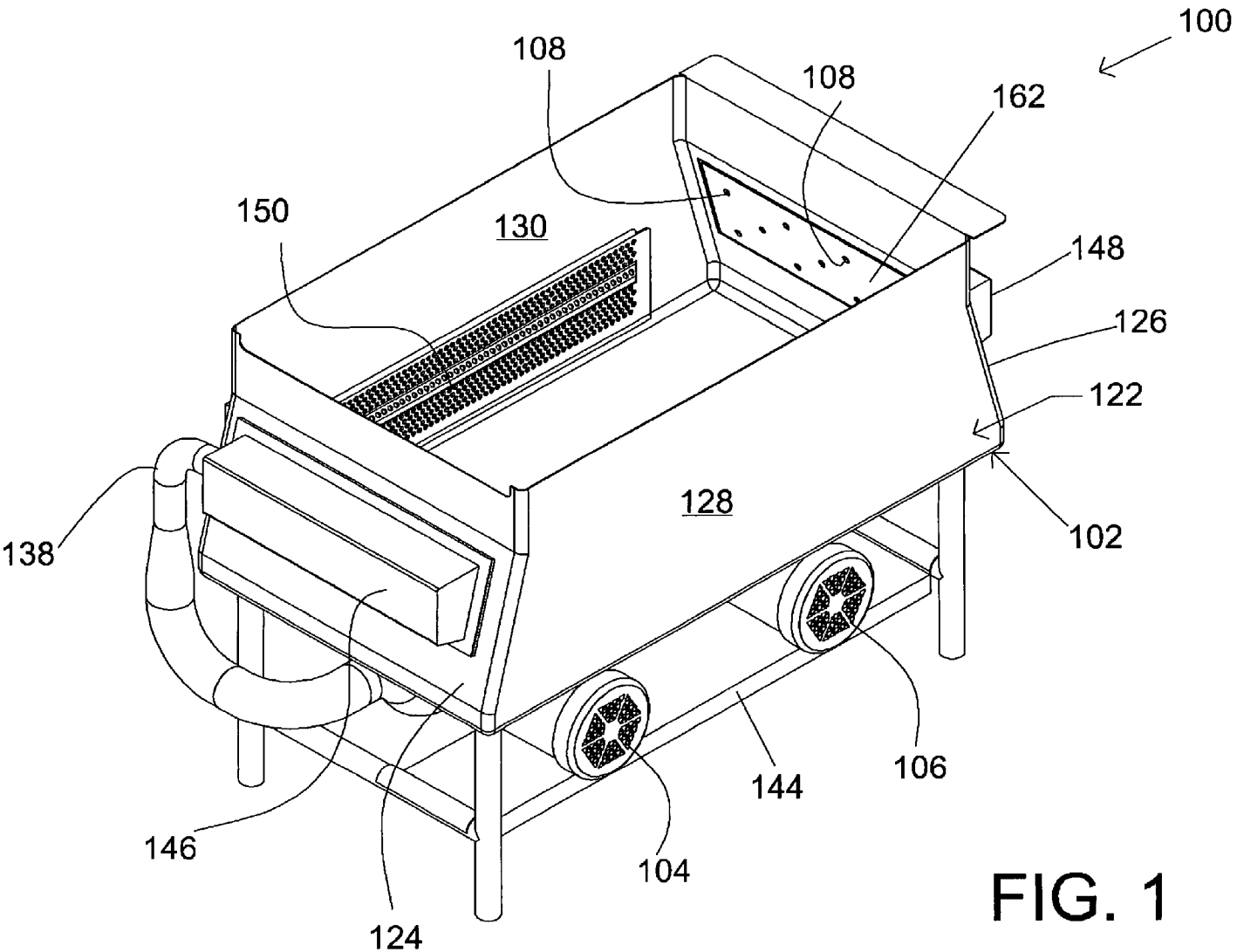
FIG. 1 is an upper perspective view of a kitchenware washing assembly according to one embodiment of the invention.
Figure 2:
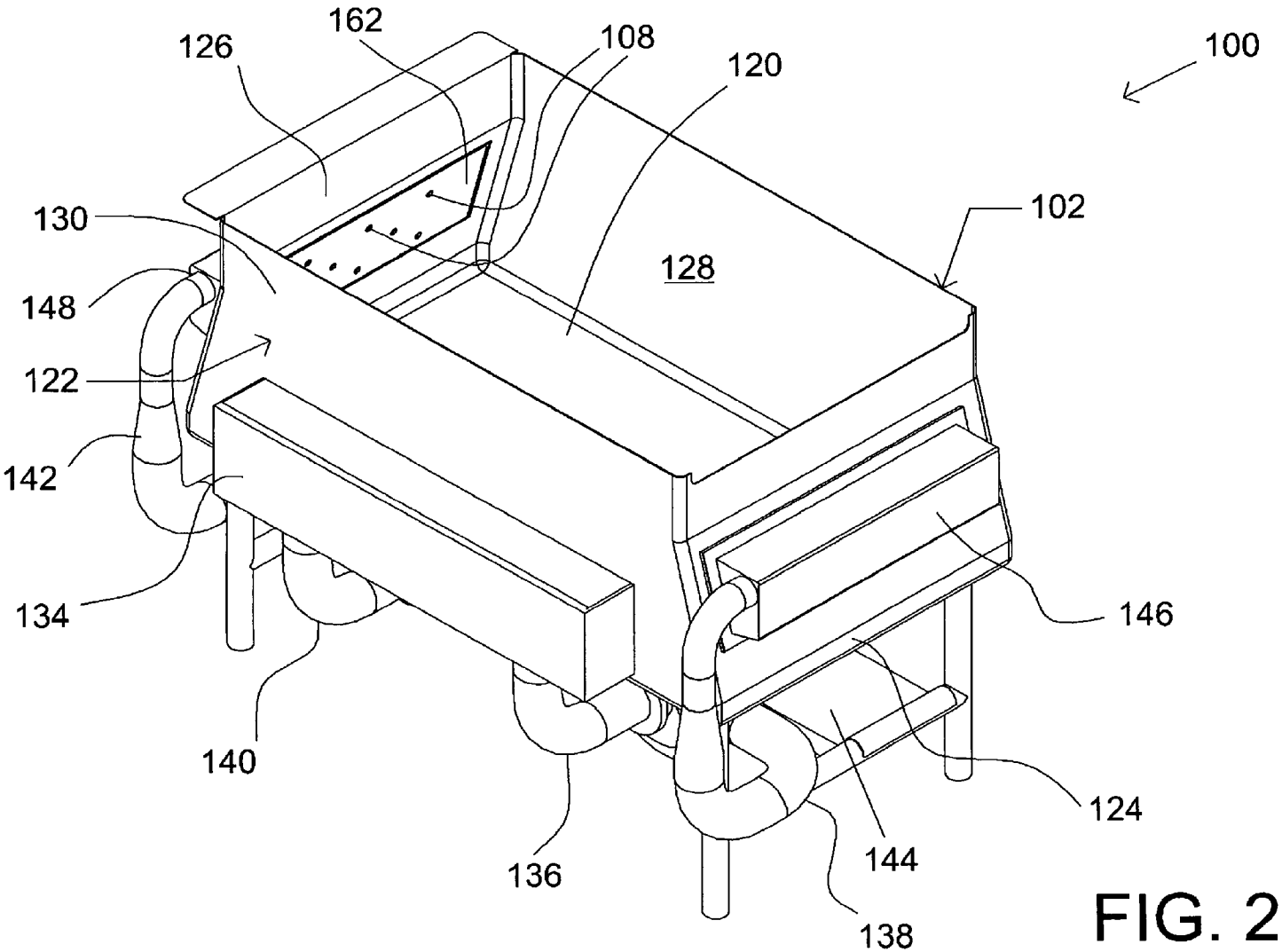
FIG. 2 is another upper perspective view of the kitchenware washing assembly shown in FIG. 1.
Figure 3:
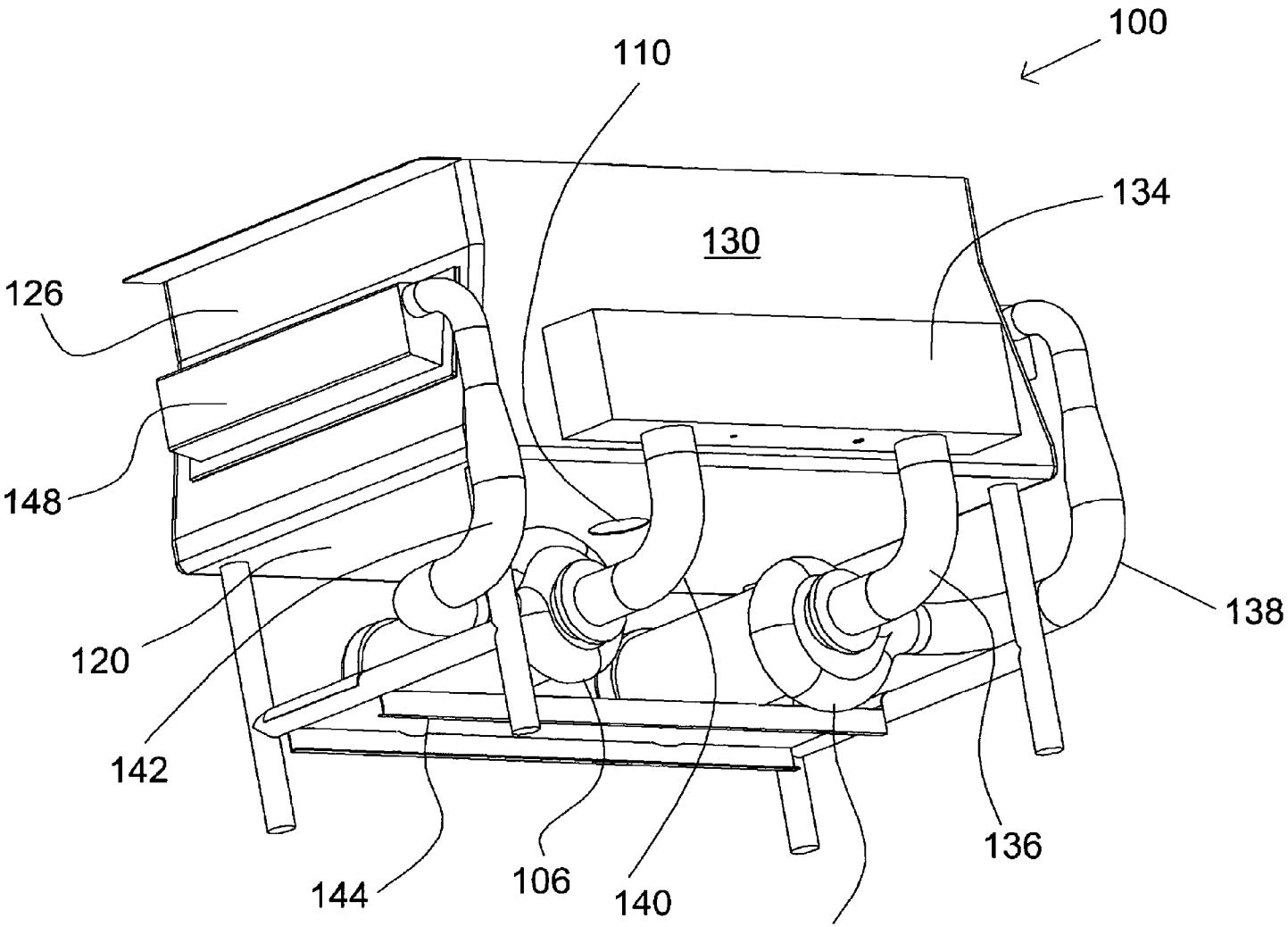
FIG. 3 is a lower perspective view of the kitchenware washing assembly shown in FIG. 1.

With continued reference to FIGS. 1 through 3, the tank 102 includes a bottom 120 and an enclosure wall 122 extending generally upwardly from the bottom 120. In the illustrated embodiment, the enclosure wall 122 is formed by four walls 124, 126, 128, and 130. Alternative embodiments, however, can include tanks formed with more or less than four walls and/or formed in any other suitable configuration including cup-shaped, cylindrical, cubical, triangular, trapezoidal, circular, ovular, prismatic, a configuration having four walls generally perpendicular to the bottom, etc.

When the tank 102 is oriented as shown in FIG. 1, the walls 124 and 126 are sidewalls, wall 128 is a front wall, and wall 130 is a back wall. In the illustrated embodiment, the sidewalls 124 and 126 are shorter in height from top to bottom than the length from left to right of the front and back walls 128 and 130. Accordingly, the tank 102 is wider from left to right that the tank 102 is deep from front to back.

In one particular embodiment, the sidewalls 124 and 126 are preferably about twenty-eight inches in length from front to back and eighteen inches in height from top to bottom. Walls 128 and 130 are preferably about forty-two inches in length from left to right at the bottom edge, and preferably about thirty-six inches in length from left to right at the top edge. This difference in length between the top and bottom edges accounts for the angled portions 170 and 172 of walls 124 and 126. Front wall 128 is preferably the same height from top to bottom as sidewalls 124 and 126. In addition, a backsplash 131 can be provided that is preferably slightly higher than the tank walls by a few inches, as shown in FIGS. 15A and 15B. The dimensions are set forth as mere examples and can be varied as understood by those skilled in the art. For example, alternative tank configurations can include a configuration in which all tank walls are the same size and shape, a configuration in which the tank is circular or cup-shaped, or some other geometric configuration.

A wide range of materials can be used for the tank walls and bottom. In one embodiment, the tank walls and bottom are formed from stainless steel, thus providing a sturdy, long-lasting structure. Alternatively, other materials can be used for the tank walls and bottom. For example, the tank could be injection molded or thermoformed from a plastic or other suitable material.

The thickness of the tank walls can also vary depending, for example, on the particular application. In one embodiment, the tank walls and the bottom are formed from fourteen-gauge stainless steel, type 304.

The tank's bottom 120 can be downwardly sloped to cause water to flow to the drain 110 (FIG. 8) when the drain 110 is open. The drain 110 can be conventionally connected to the facility plumbing and drainage system (not shown). Drain 110 can also include a shutoff valve (not shown) that allows the user to open and close the drain 110 to allow the tank 102 to be filled and emptied as desired. The drain 110 can further include a screen or perforated cover (not shown) to prevent debris from entering the drain 110 and clogging or partially clogging it. In various embodiments, the drain 110 and its connection to facility plumbing is standard and in use in most commercial washers.

A commercial washer of the variety disclosed herein should be able to circulate fluid within the tank to create turbulence in the tank. The turbulence helps to clean kitchenware and loosen tough food residues or remnants that become caked-on kitchenware during the cooking or food preparation process. In various embodiments of the present invention, the following components generally provide this function: intake opening 132, pumps 104 and 106, and outlets or discharge openings 108.

Figure 12:
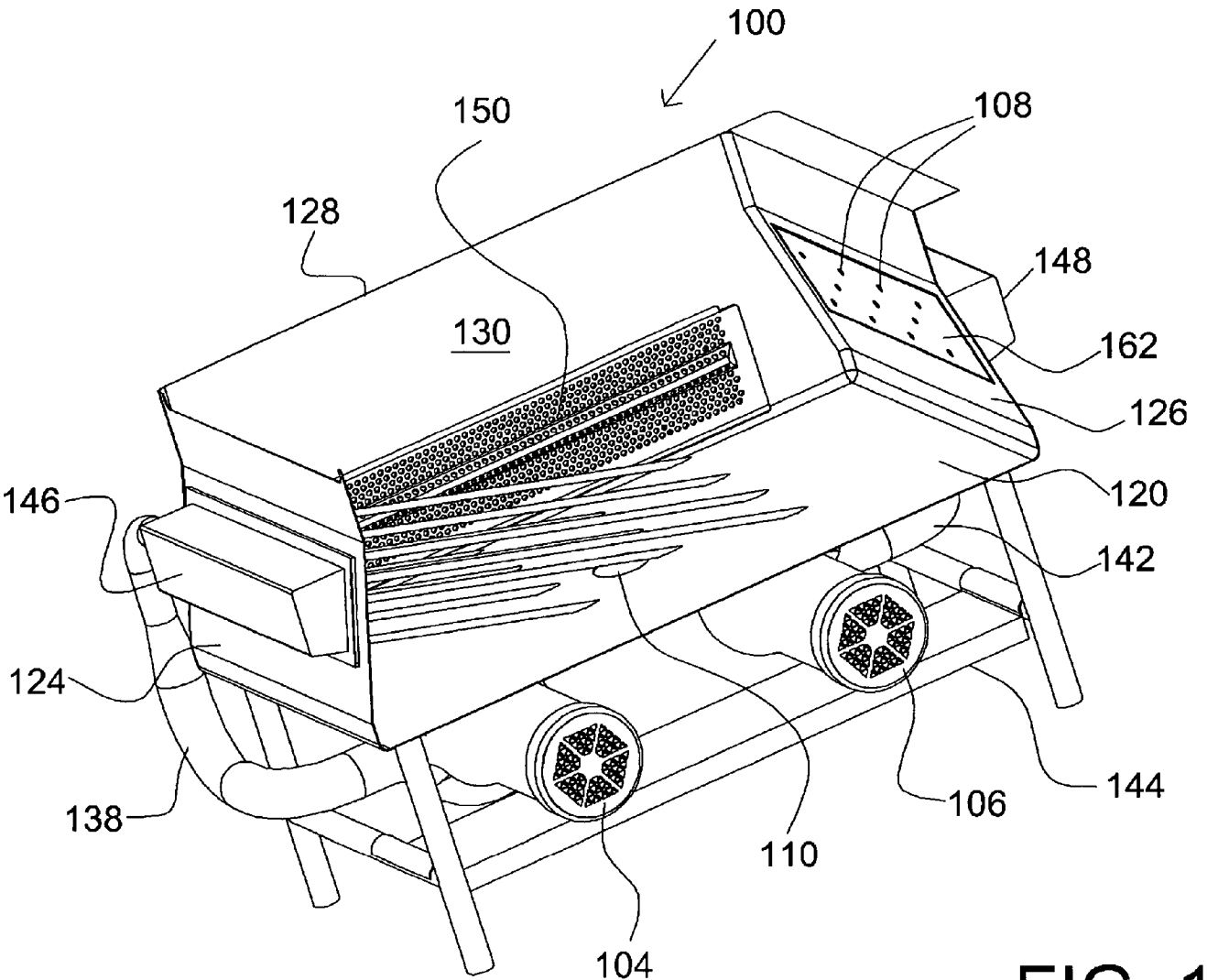
FIG. 12 is a perspective view of the kitchenware washing assembly shown in FIG. 1 with a portion broken away to reveal the fluid flow when only one pump is operating.
Figure 13:
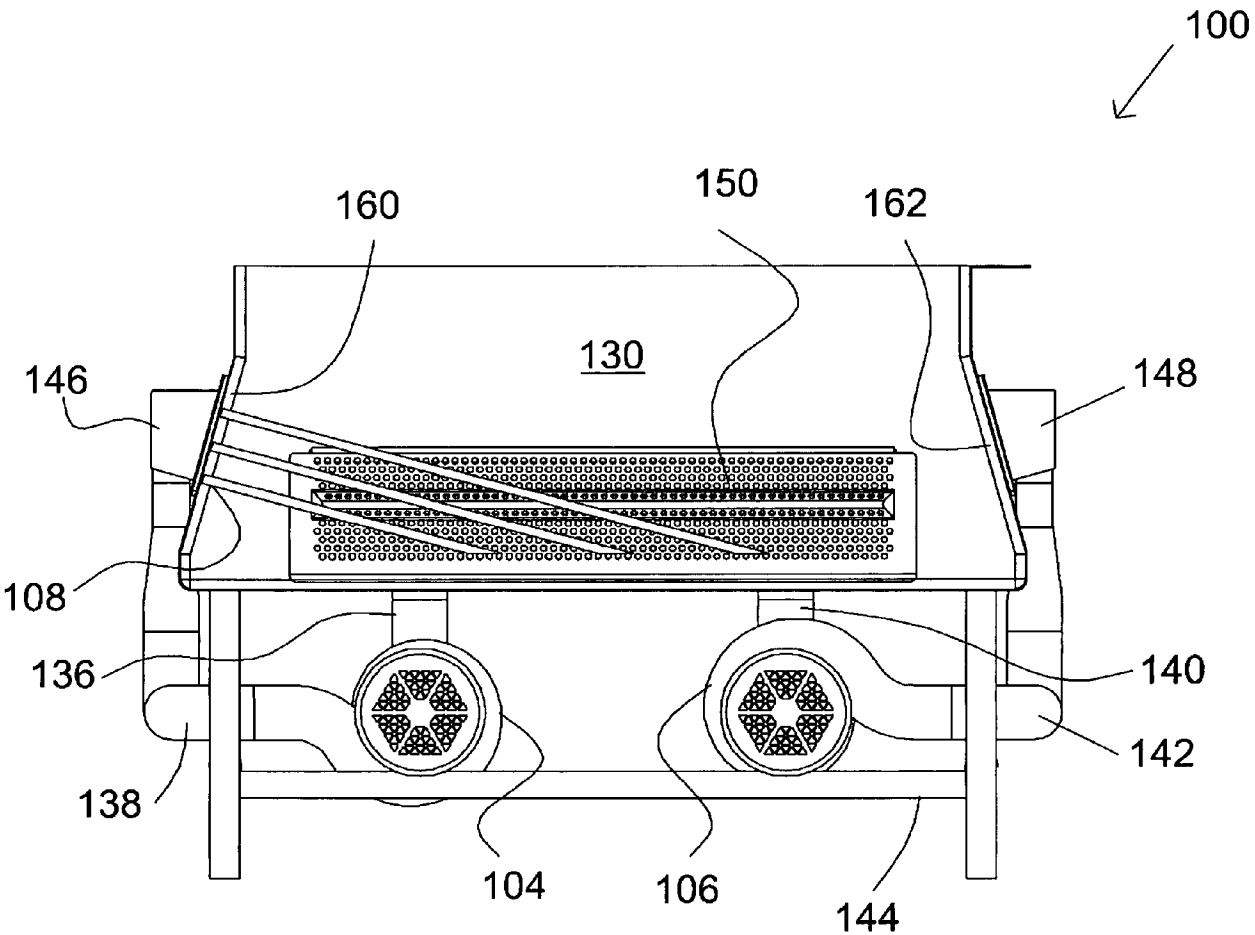
FIG. 13 is a cross-sectional view of the kitchenware washing assembly of FIG. 12 showing the fluid flow from the discharge openings when only one pump is operating.

Each pump 104 and 106 is coupled in fluid communication with the tank 102 through the intake opening 132 on the back wall 130 and through outlets or discharge openings 108 on a respective one of the tank sidewalls 124 and 126. By using two pumps 104 and 106, one of the pumps may remain active while the other pump is idle or inoperable due to failure or malfunction, as shown in FIGS. 12 and 13. Accordingly, a multi-pump allows for at least some use of the tank 102 even when one pump is inoperable and/or being serviced.

As compared to commercial washers having a single pump that is single speed and that creates a constant level of turbulence, a multi-pump design can increase the effectiveness of the washer by providing adjustable levels of turbulence as well as providing higher turbulence, which can be especially useful for removing inordinately "caked-on" food. With a multi-pump design of the present invention, one pump may be shut down while the other pump runs at a low rate in order to reduce the turbulence to a level more suitable for cleaning more fragile and delicate dishware, such as china and expensive ceramic plates. A multi-pump design also allows for reducing the length (and costs) of the fluid conduits as compared to the fluid conduit length for connecting a single pump to the inlet and both outlets. Either or both pumps 104 and/or 106 can be cycled off and on at various speeds and durations to alter flow patterns in the tank 102. Accordingly, embodiments of the present invention are suitable for use with a variety of cleaning needs including large pots and pans that are not subject to breaking under turbulent tank conditions as well as more delicate and fragile dishware.

Alternative embodiments, however, can include more or less than two pumps depending, for example, on the particular application. For example, another embodiment includes a third pump which may be connected to an outlet chamber on the front wall. Yet another embodiment includes a washing assembly that includes only one pump. Further embodiments can include a separate intake chamber for each pump rather than having each pump 104 and 106 connected to a single intake chamber 134. In such embodiments, one pump can be coupled in fluid communication between a respective intake chamber and outlet, and the other pump can be coupled in fluid communication between the other intake chamber and outlet.

Referring to FIGS. 1 through 3, fluid conduits are used for coupling each pump 104 and 106 in fluid communication between the intake chamber 134 and the outlet chambers 146, 148 on the respective sidewalls 124 and 126. More specifically, fluid conduits 136 and 138 respectively connect the pump 104 to the intake chamber 134 and to the outlet chamber 146. Fluid conduits 140 and 142 respectively connect the pump 106 to the intake chamber 134 and to the outlet chamber 148. Alternatively, however, either or both pumps 104 and 106 can be connected directly to the intake chamber 134 and/or outlet chamber 146, 148 without any connecting fluid conduits.

In various embodiments, the pumps 104 and 106 are positioned relative to the intake chamber 134 and outlet chambers 146, 148 in order to optimize (or at least reduce) the length of the conduits 136, 138, 140, 142. For example, and as shown in FIG. 3, each pump 104 and 106 is positioned under the bottom 120 of the tank 102 such that each pump's inlet is aligned with the respective location at which the fluid conduit 136 and 140 connects to the intake chamber 134. This, in turn, reduces the conduit length needed to connect each pump to the intake chamber 134. The shorter conduit lengths can allow the washing assembly 100 to operate more quietly because of less resistance (less wasted power) due to the shorter intake and discharge lengths. In addition, various embodiments allow for smoother less turbulent (and thus quieter) flow in the conduits due to smoother transitions (e.g., fewer sharp corners, fewer turns). Further, the shorter suction conduits reduce the chance of pump cavitation, which, in turn, also allows for quieter operation.

Although the illustrated embodiment includes outlets on two opposing walls, aspects of this invention are not so limited. For example, alternative embodiments of this invention include a tank having outlets on only one wall, a tank having outlets on two walls that are not opposing, and a tank having outlets on more than two walls. In addition, other embodiments include a tank having an outlet and an intake opening on the same wall.

A wide range of materials can be used for the fluid conduits 136, 138, 140, and 142, and the same material need not be used for each fluid conduit. Exemplary materials that can be used for the fluid conduits include rubber, plastic, stainless steel, and combinations thereof, among other suitable materials. In one particular embodiment, the fluid conduits 136, 138, 140, 142 are formed from two-inch or three-inch diameter rubber tubing such that the fluid conduits are relatively flexible. While the fluid conduits 136, 138, 140, 142 are illustrated with generally circular cross-sections, other suitable cross-sectional shapes can be used for the fluid conduits.

Figure 16:
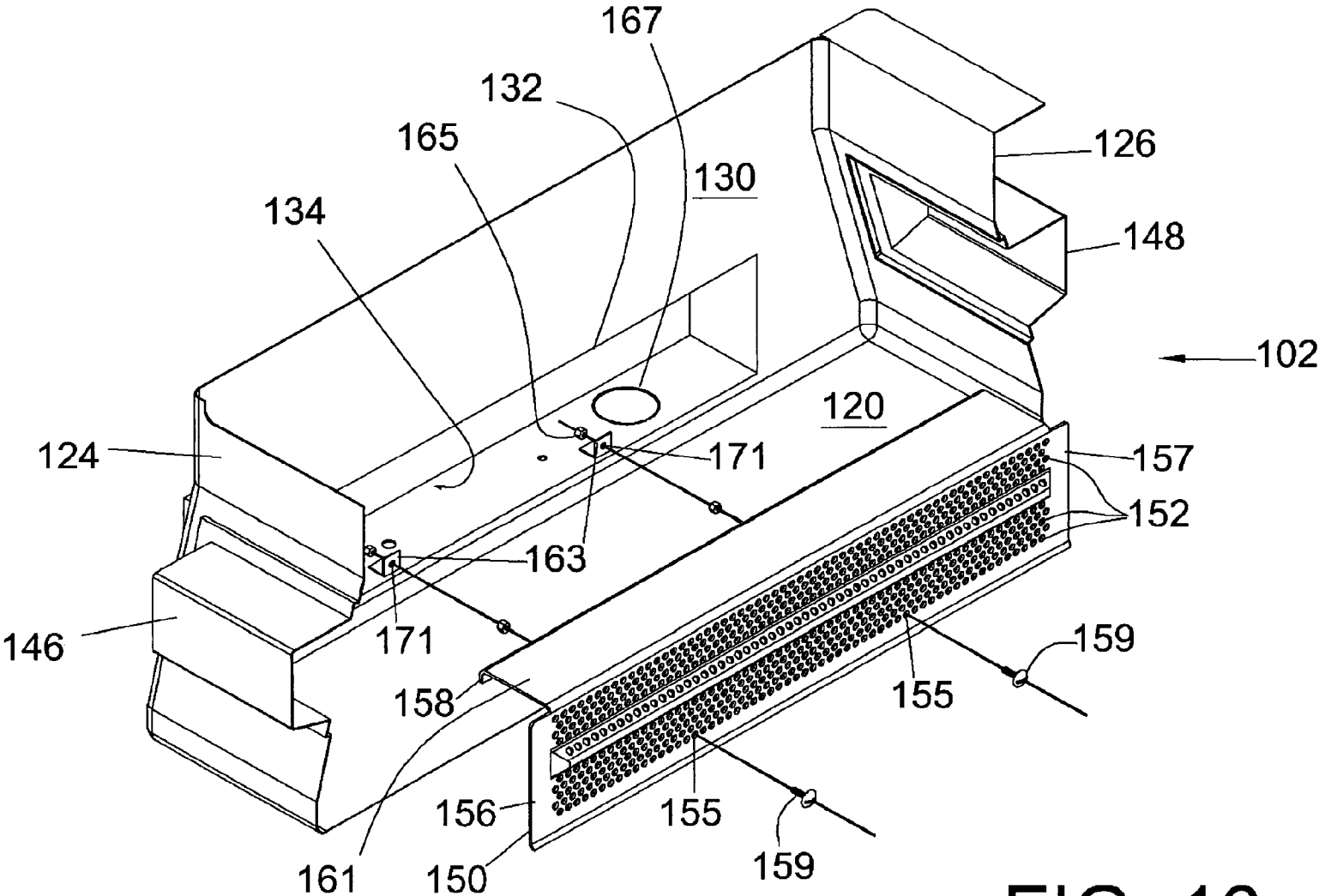
FIG. 16 is a partial exploded perspective view of a kitchenware washing assembly with a front portion of the tank broken away and illustrating an intake cover that can be used for separating an intake chamber from the tank according to one embodiment of the invention.
Figure 17:
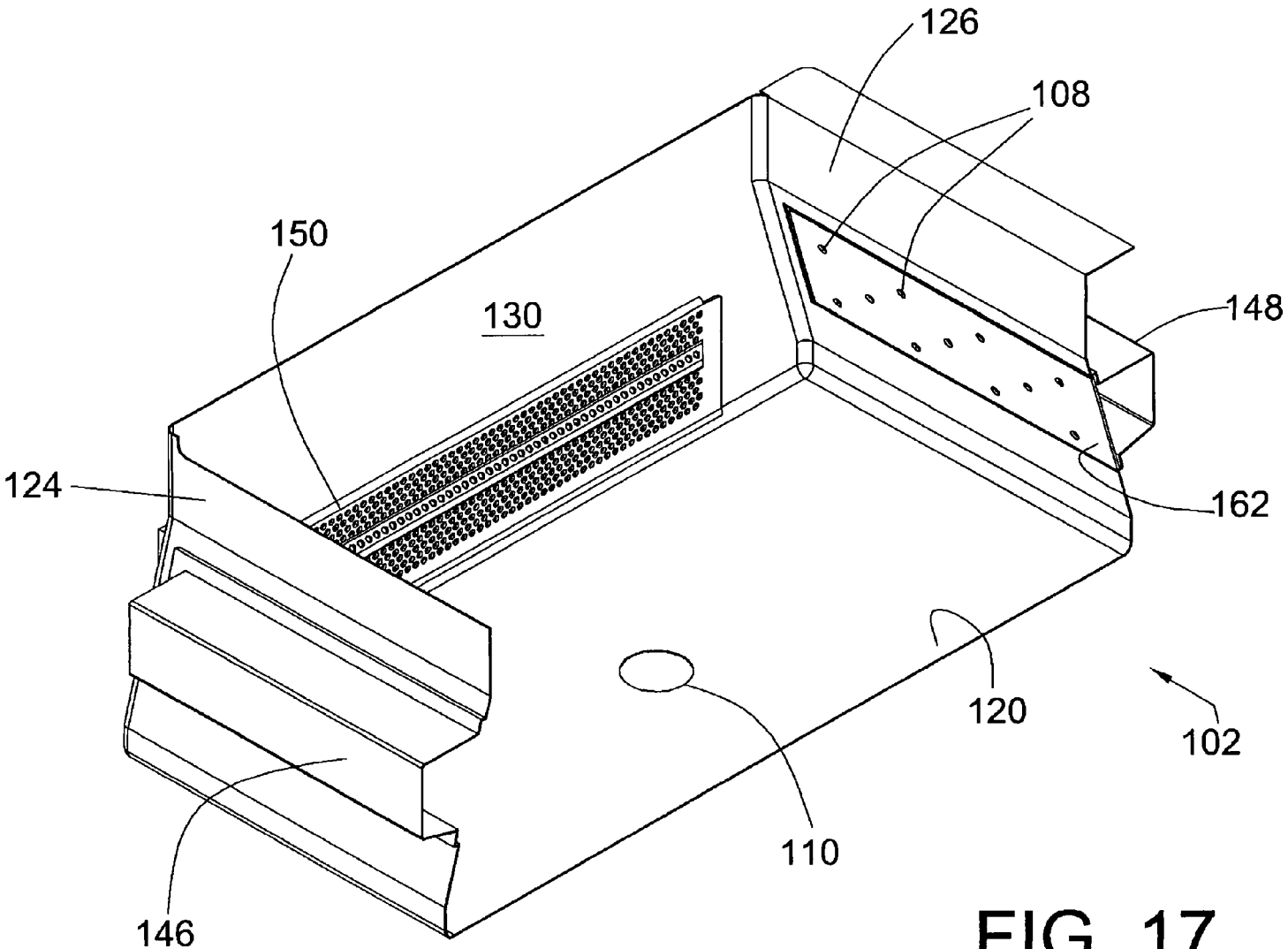
FIG. 17 is a partial perspective view of the tank and intake cover shown in FIG. 16 after the intake cover has been positioned over the intake chamber.

As shown in FIG. 16, the intake opening 132 comprises a front open portion of the intake chamber 134, which, in turn, is disposed on the back wall 130. Alternatively, the intake opening 132 and intake chamber 134 can be located at any other tank location, such as the front wall, bottom, sidewalls, etc.

The fluid conduits 136 and 140 connect to the intake chamber 134 along the bottom of the intake chamber 134 such that the fluid conduits 136 and 140 are spaced apart from one another. Alternatively, the fluid conduits 136 and 140 can be connected to the intake chamber 134 at other suitable locations.

The fluid conduits 136 and 140 can be coupled to the intake chamber 134 in various ways. In embodiments in which the fluid conduits 136 and 140 are formed from relatively rigid pipes, such as stainless steel, the fluid conduits 136 and 140 can be welded, bolted (e.g., by flange connection), threaded, bonded, etc. to the intake chamber 134. In one example embodiment, the fluid conduits 136, 140 and the intake chamber 134 are formed from a weldable material like stainless steel. In this particular example, the fluid conduits 136 and 140 are welded to a wall of the intake chamber 134.

Figure 14A:
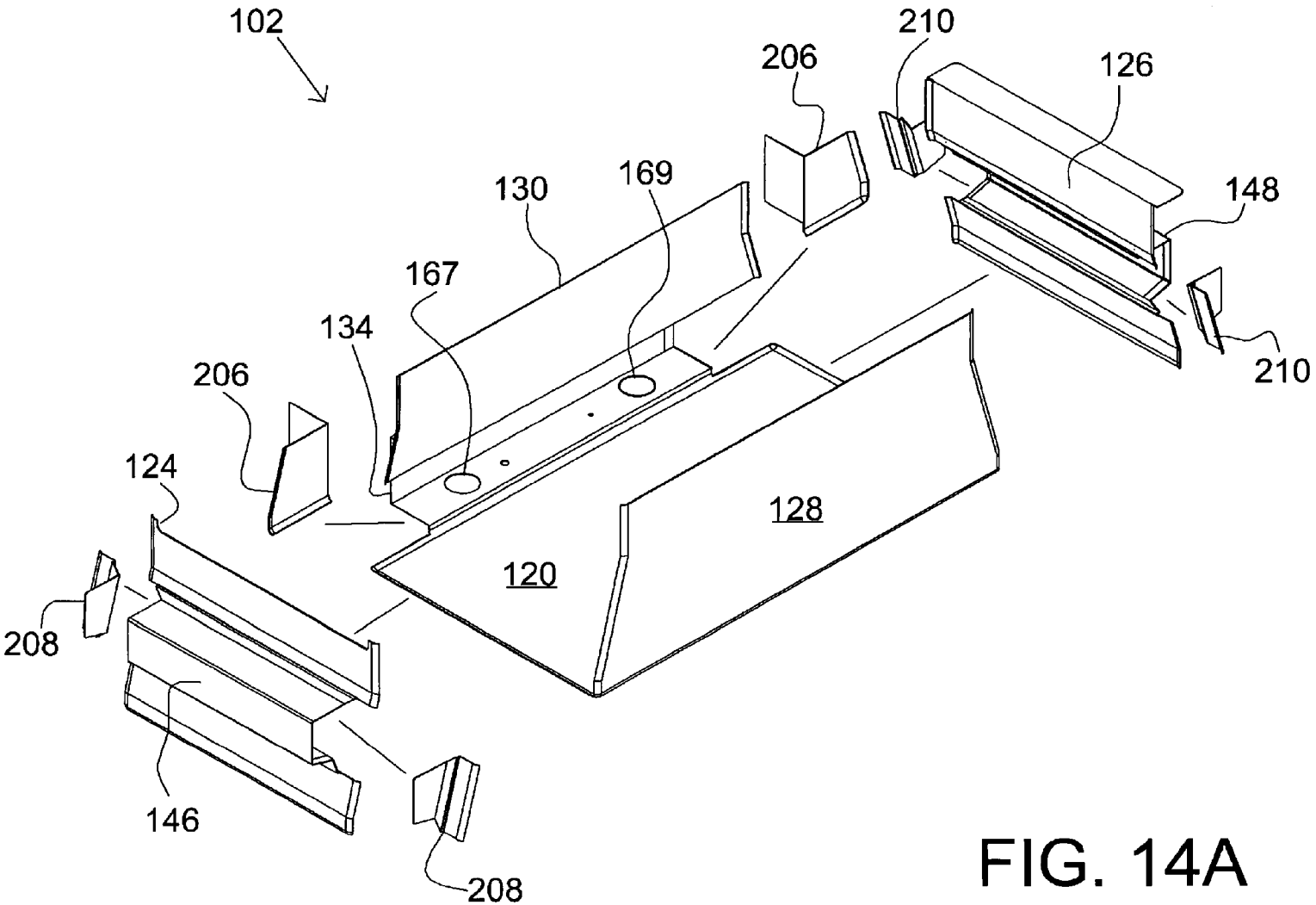
FIGS. 14A through 14E are exploded perspective views of a kitchenware washing assembly according to one embodiment in which portions of the tank are unitarily formed.

In embodiments in which the fluid conduits 136 and 140 are formed from generally flexible tubing or hoses, the fluid conduits 136 and 140 can be connected to the intake chamber 134 by way of connector members or fittings, such as hose barbs or bibs. For example, hose barbs 135 (FIG. 14B) can be attached (e.g., bolted, welded, adhesively bonded, threaded, etc.) to the intake chamber 134 at locations 167 and 169 (FIG. 14A). Alternatively, in those embodiments in which the tank is formed by injection molding or thermoforming, hose barbs can be unitarily or monolithically formed with the tank such that the hose barbs would not be separately attached to the intake chamber.

A wide range of materials can be used for the hose barbs 135, depending, for example, on the particular material(s)

used for intake chamber 134 and/or the particular means by which the hose barbs 135 will be attached to the intake chamber 134. In one particular embodiment, the hose barbs 135 are formed from stainless steel and are welded to the intake chamber 134.

The fluid conduits 136 and 140 can be coupled to the hose barbs 135 in various ways depending, for example, on the particular material(s) forming the hose barbs 135 and conduits 136, 140. In one particular embodiment, end portions of the conduits 136 and 140 are slid over the hose barbs 135, and then clamps (not shown) are used to retain the conduits 136 and 140 to the hose barbs 135. Alternatively, other suitable means can be employed for coupling the fluid conduits 136 and 140 to the intake chamber 134.

The fluid conduits 138 and 142 connect to the respective outlet chambers 146 and 148 along the chamber end walls 208, 210. Alternatively, the fluid conduits 138 and 142 can be connected to the respective outlet chambers 146 and 148 at other suitable locations.

The fluid conduits 138 and 142 can be coupled to the respective outlet chambers 146 and 148 in various ways. In embodiments in which the fluid conduits 138 and 142 are formed from relatively rigid pipes, such as stainless steel, the fluid conduits 138 and 142 can be welded, bolted (e.g., by flange connection), threaded, bonded, etc. to the respective outlet chambers 146 and 148. In one exemplary embodiment, the fluid conduits 138, 142 and the outlet chambers 146, 148 are formed from a weldable material, such as stainless steel. In this particular example, each fluid conduit 138 and 142 is welded (e.g. extrusion welded, etc.) to a wall of the corresponding outlet chamber 146 and 148.

In embodiments in which the fluid conduits 138 and 142 are formed from generally flexible hoses, the fluid conduits 138 and 142 can be connected to the respective outlet chambers 146 and 148 by way of connector members or fittings, such as hose barbs or bibs. For example, hose barbs can be attached (e.g., bolted, welded, adhesively bonded, threaded, etc.) to the outlet chambers 146 and 148 in various ways. Alternatively, in those embodiments in which the tank is formed by injection molding or thermoforming, hose barbs can be unitarily or monolithically formed with the outlet chambers 146 and 148 such that the hose barbs would not be separately attached to the outlet chambers.

A wide range of materials can be used for the hose barbs, depending, for example, on the particular material(s) forming the outlet chambers 146, 148 and/or the particular means by which the hose barbs are attached to the outlet chambers 146 and 148. In one particular embodiment, the hose barbs are formed from stainless steel and are welded to the outlet chambers 146 and 148.

The fluid conduits 138 and 142 can be coupled to the hose barbs in various ways depending, for example, on the particular material(s) forming the hose barbs and conduits 138 and 142. In one particular embodiment, end portions of the conduits 138 and 142 are slid over the hose barbs, and then clamps (not shown) are used to retain the conduits 138 and 142 to the hose barbs. Alternatively, other suitable means can be employed for coupling the fluid conduits 138 and 142 to the respective outlet chambers 146 and 148.

Figure 9:
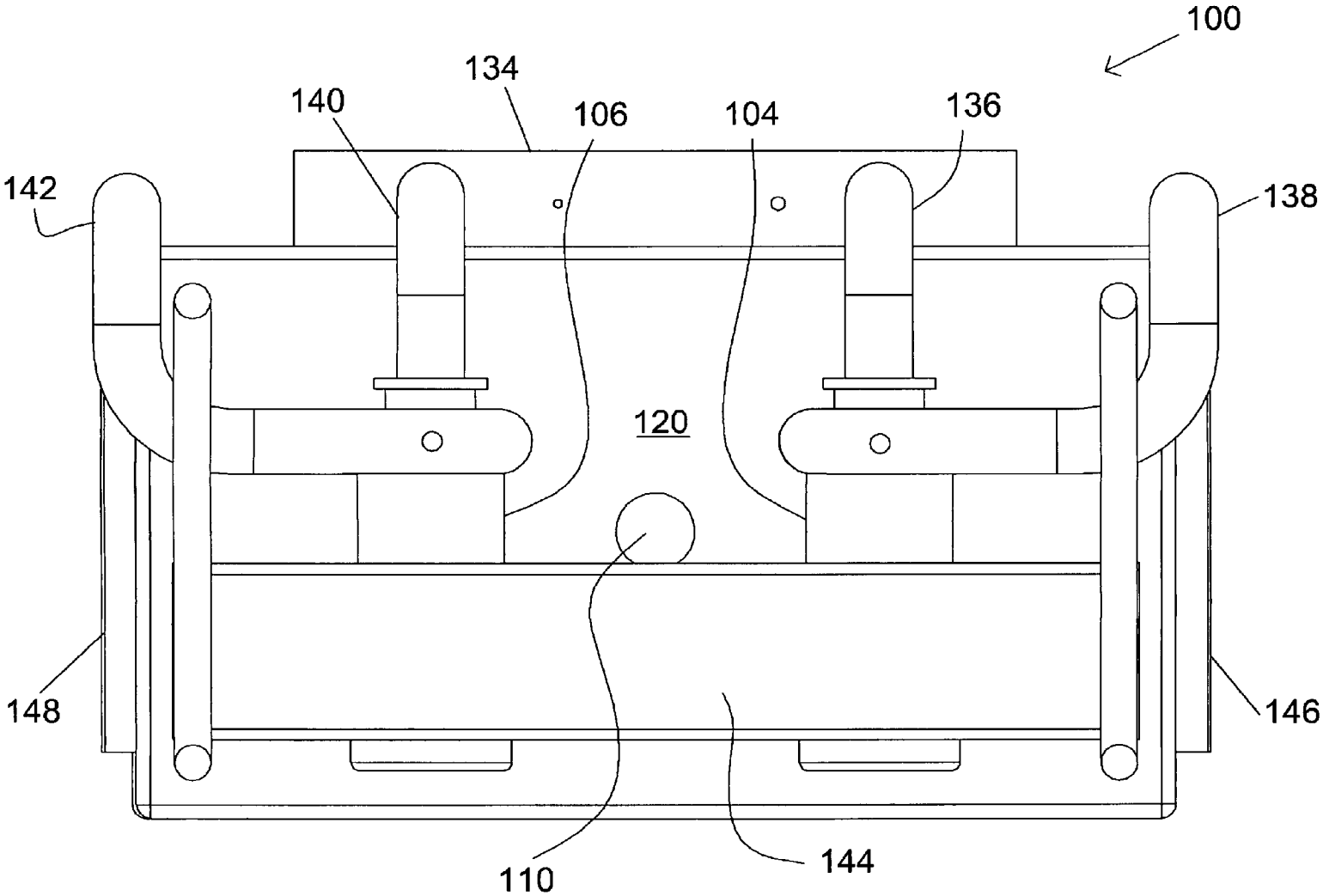
FIG. 9 is a bottom plan view of the kitchenware washing assembly shown in FIG. 1.

As shown in FIG. 9, the pumps 104 and 106 are positioned and supported by a slidable shelf 144. The shelf 144 can be positioned generally under the tank 102, thereby providing a convenient storage location for the pumps 104 and 106. When the pumps 104 and/or 106 need to be serviced, the shelf 144 can be slidably moved out from under the tank 102 to thereby provide access to the pumps 104 and 106. In some embodiments, each pump 104 and 106 is positioned on a separate shelf so that each pump can be separately slid out from under the tank 102. In such embodiments, one pump can thus be serviced without having to disconnect and/or slide the other pump out from under the tank. In various embodiments, the pumps 104 and 106 are configured such that they can be readily detached from their respective conduits 136, 138, 140, and 142.

Figure 41:
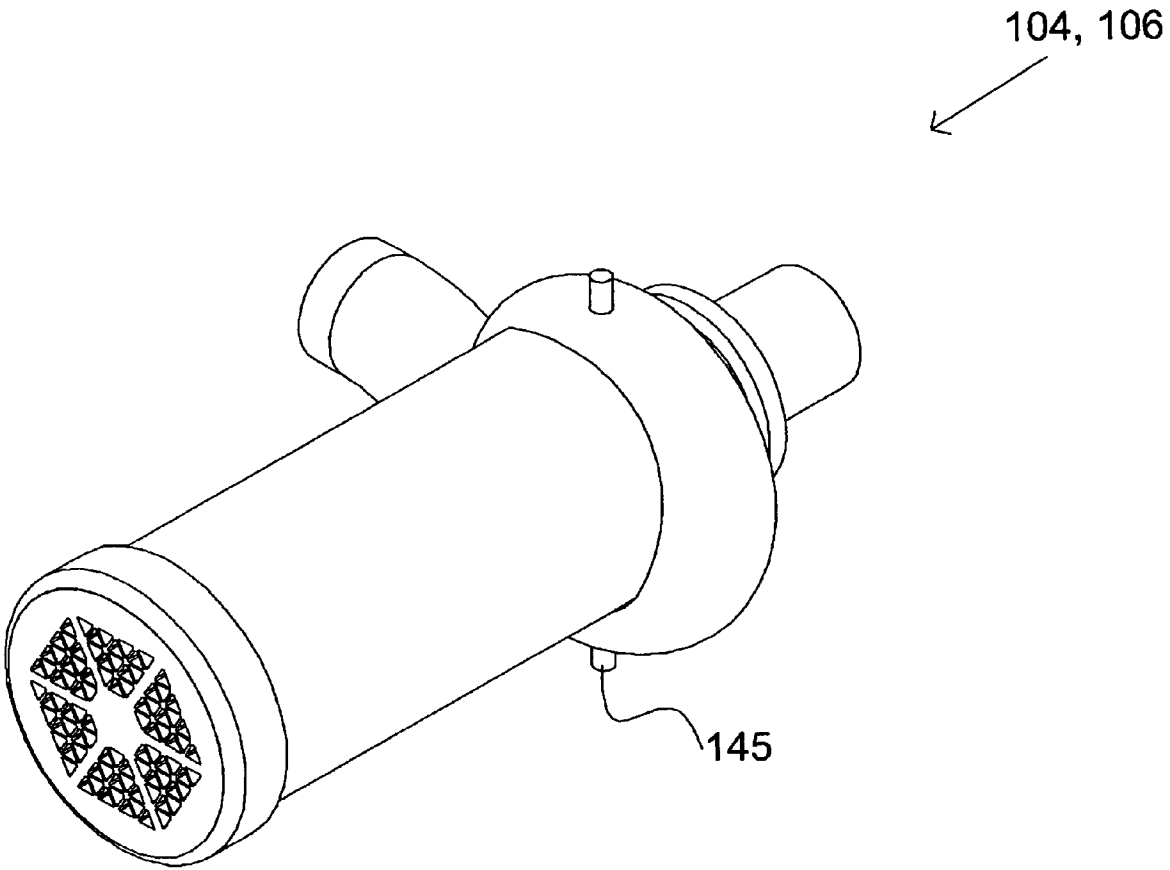
FIG. 41 is a perspective view of a pump having a drain according to one embodiment of the invention.

As shown in FIG. 41, each pump 104 and 106 includes a drain 145 positioned at or near a low point in each pump. These drains 145 provides an operator with the ability to drain a substantial portion of the fluid from the tank 102, interconnecting conduits 136, 138, 140, 142 and/or from each pump 104 and 106. Each drain 145 is preferably operable with little effort by the operator. By way of example only, these drains 145 can be controlled by a manual valve, an actuator activated valve, combinations thereof, and/or by other suitable means.

In various embodiments, each pump 104 and 106 is a variable speed pump that is separately operable at a different speed as compared to the other pump. A control system (e.g., control system 212 described herein and shown in FIGS. 34 through 36) can be used for controlling the operation of the pumps 104 and 106. The control system can include one or more modes configured to operate one pump at a different speed than the other pump. For example, the control system may include a mode in which one pump is idle while the other pump is operational.

When operating, the pumps 104 and 106 draw cleaning fluid from the tank 102 through inlet holes 152 of the intake cover 150 and into the respective fluid conduits 136 and 140. The pumps 104 and 106 direct the cleaning fluid through the respective fluid conduits 138 and 142 to the outlet chambers 146 and 148 for discharge by the openings 108 into the tank 102.

A wide range of pumps can be used for pumps 104 and 106. In one particular embodiment, each pump 104 and 106 is a closed-coupled, end suction centrifugal pump with a maximum capacity of three hundred gallons per minute at eighteen hundred revolutions per minute. Each pump 104 and 106 includes a two horsepower, frequency drive duty motor.

In one particular embodiment, the intake opening 132 is preferably about seven inches in height from top to bottom, and thirty inches in length from left to right. In addition, the intake chamber 134 is preferably about four inches deep from front to back as measured from the intake opening 132 to the back wall of the intake chamber 134. The dimensions are set forth as mere examples and can be varied as understood by those skilled in the art.

Referring now to FIGS. 16 through and 23, an intake cover 150 can be positioned to cover intake opening 132. The intake cover 150 includes inlets and a projection 154 that extends into the tank 102.

As used herein, term "inlet" broadly includes any opening for receiving fluid from the tank, such as perforations, pipes, and holes. In the illustrated embodiment, the intake cover's inlets are inlet holes 152 in the intake cover 150. The term "inlet holes", as used herein, refers to mere holes in the intake cover 150, or equivalent openings, which do not include separate parts such as pipes, nozzles, or the like for receiving fluid flow from the tank.

The inlets holes 152 allow fluid to be drawn into the intake chamber 134, while the intake cover 150 restricts food debris and other small items like silverware from entering the intake opening 132 and entering the pumps 104 and 106. In addition, the projection 154 helps keep kitchenware (e.g., plates, pans, dishware, etc.) from being drawn up flush against the inlet holes 152 and blocking fluid passage through the inlet holes 152, which might otherwise decrease operational efficiency of the kitchenware washing assembly.

Figure 19:
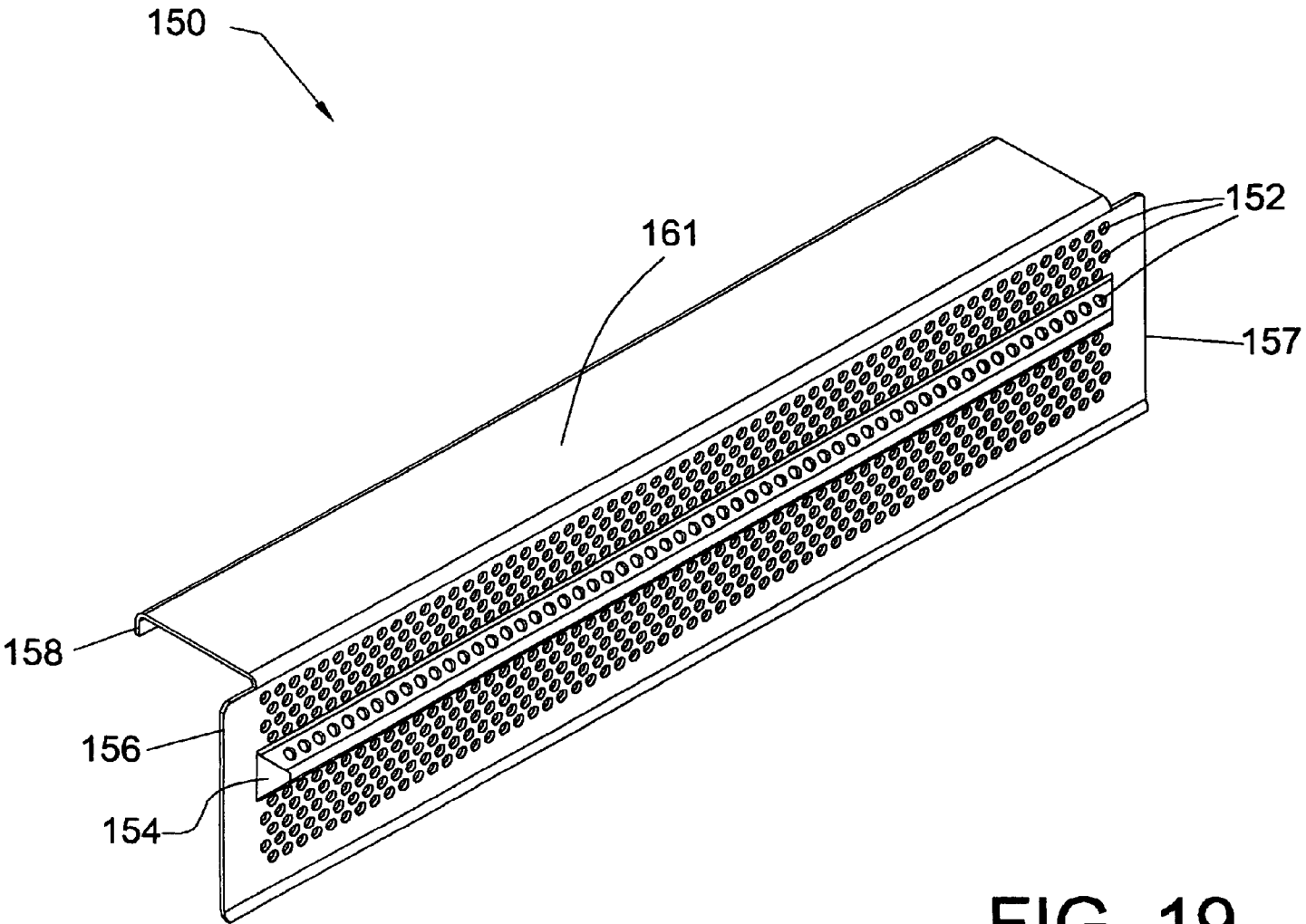
FIG. 19 is an outer perspective view of the intake cover shown in FIG. 16.
Figure 20:
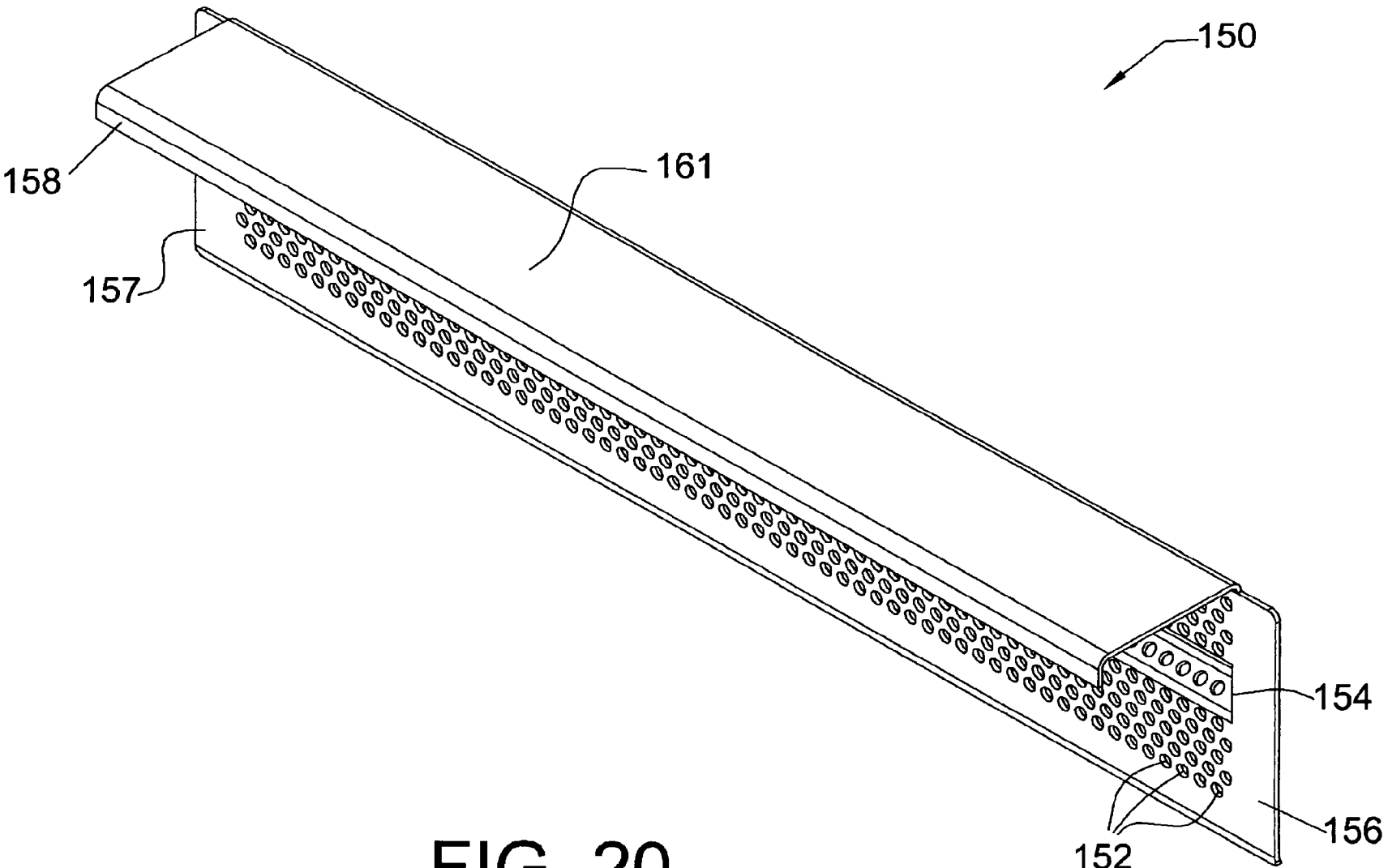
FIG. 20 is an inner perspective view of the intake cover shown in FIG. 16.
Figure 21:
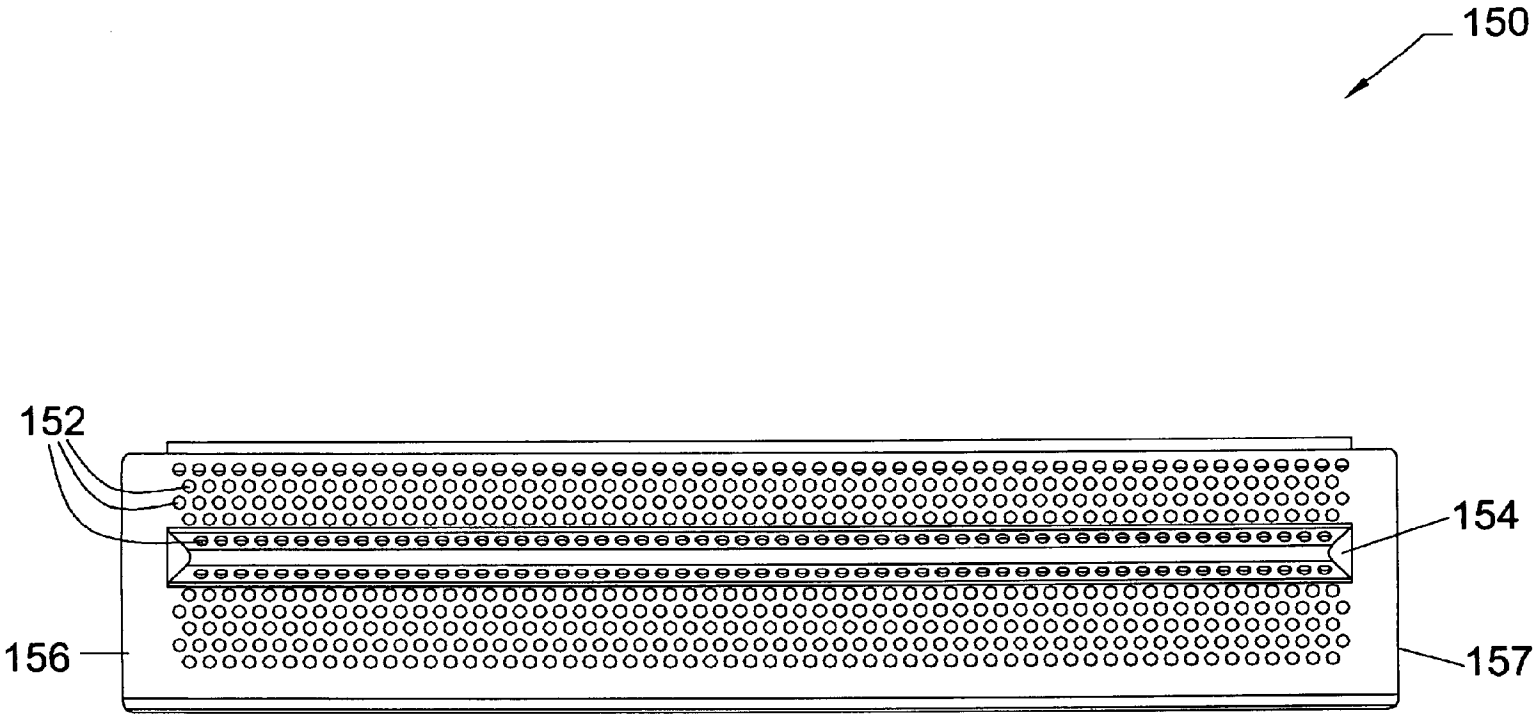
FIG. 21 is a front elevation view of the intake cover shown in FIG. 16.
Figure 43:
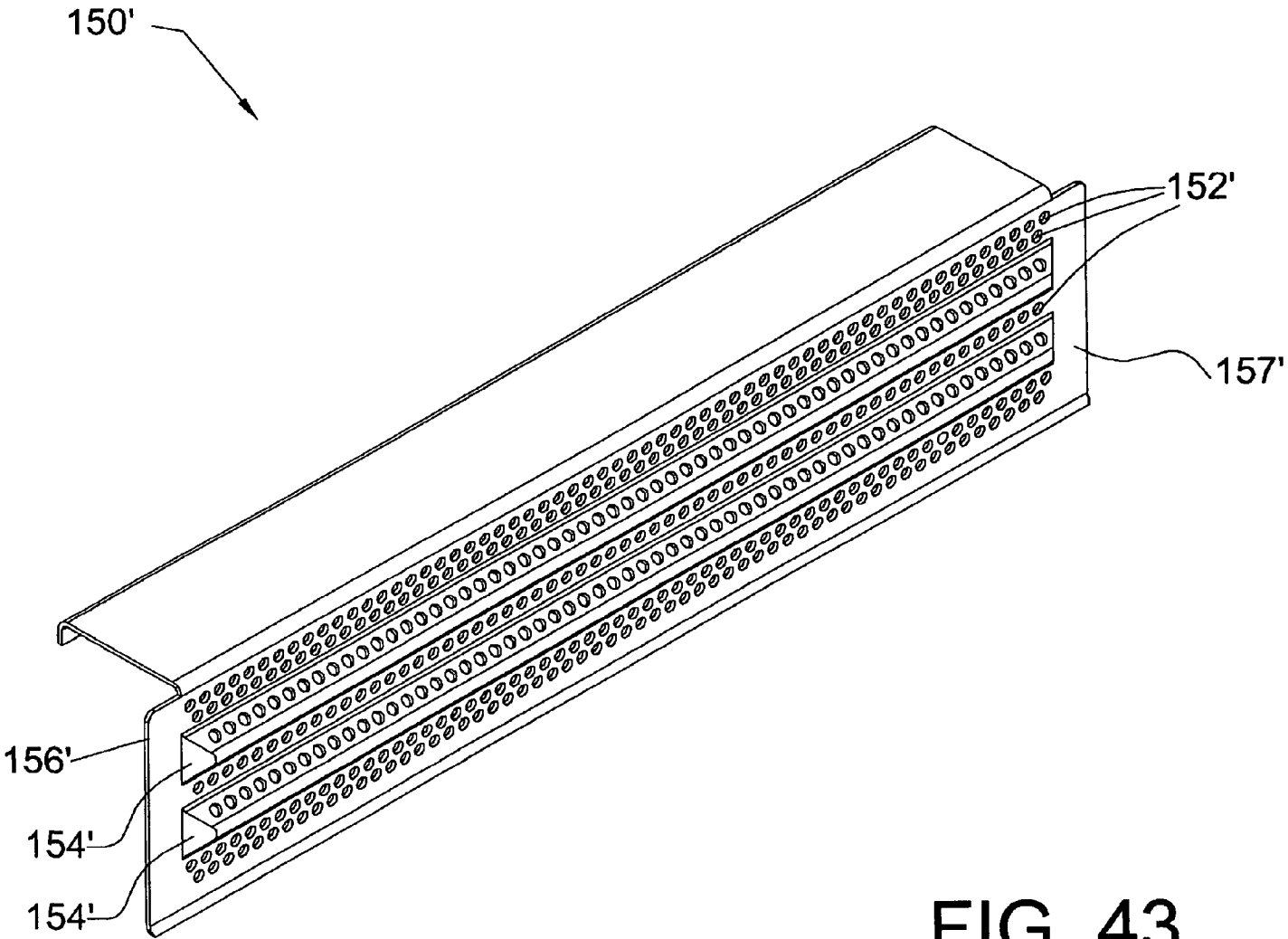
FIG. 43 is an outer perspective view of an intake cover that includes a plurality of projections extending into the tank according to one embodiment of the invention.

In the illustrated embodiment, the projection 154 comprises a rib that extends longitudinally between the first and second sides 156 and 157 of the intake cover 150. As shown in FIG. 19, the projection 154 does not extend completely across the intake cover 150. But in other embodiments, the projection extends completely across the intake cover from its first side to its second side. Yet other embodiments include one or more projections that extend diagonally across the intake cover (e.g., between upper and lower corners of the intake cover). Additional embodiments include one or more vertically extending projections. In further embodiments, the intake cover includes a plurality of projections that extend into the tank. These projections can extend longitudinally, vertically, diagonally, in a crossing pattern, parallel with one another, and combinations thereof, etc. The particular number and arrangement of projections on the intake cover can vary depending, for example, on the particular application. By way of example only, FIG. 43 shows an alternative embodiment of an intake cover 150' having inlet holes 152' and two projections 154' longitudinally extending between the intake cover's first and second sides 156' and 157'.

Figure 22:
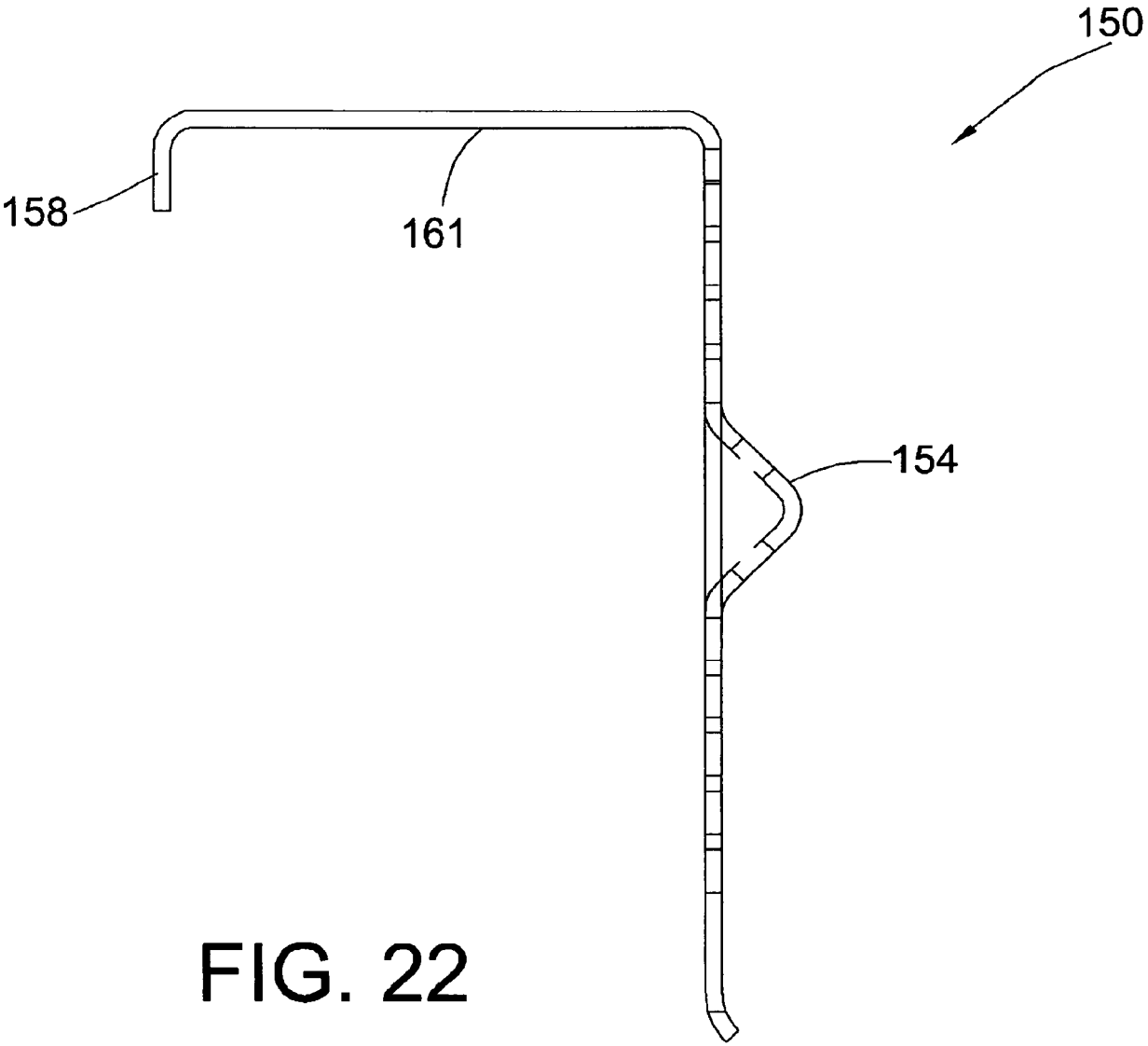
FIG. 22 is a side elevation view of the intake cover shown in FIG. 16.
Figure 23:
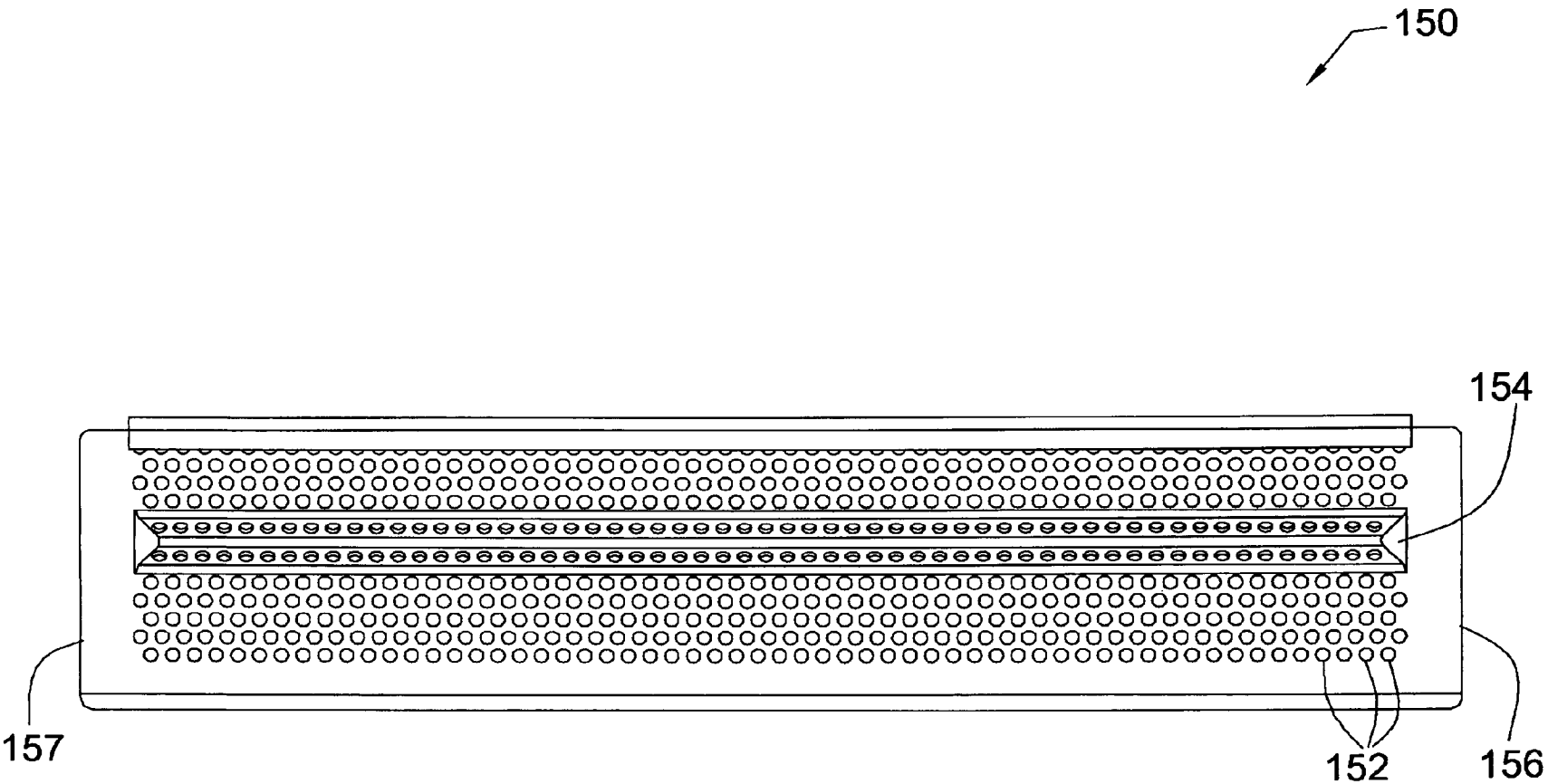
FIG. 23 is a rear elevation view of the intake cover shown in FIG. 16.

With further reference to FIG. 22, the projection 154 has a generally V-shaped longitudinal cross-section with a generally flat or rounded bottom portion. Stated differently, the projection 154 defines a generally V-shaped channel with inwardly sloping walls that connect to a generally flat or rounded bottom portion.

Alternative embodiments, however, include projections having other cross-sectional shapes and geometric configurations including hemispherical, and substantially solid cross-sections (e.g. trapezoidal, triangular, rectangular, etc.) that do not define a channel, among other suitable cross-sectional shapes and geometric configurations.

In various embodiments, the intake cover 150 is detachable from the tank 102. Advantageously, this allows the interior of the intake chamber 134 (and components therein) to be readily accessed, for example, for cleaning and sanitizing. In addition, having a detachable intake cover 150 also allows the intake cover 150 itself and its inlet holes 152 to be more easily serviced, for example, to replace the intake cover 150, clean out the inlet holes 152, and/or clean other portions of intake cover 150.

Figure 18:
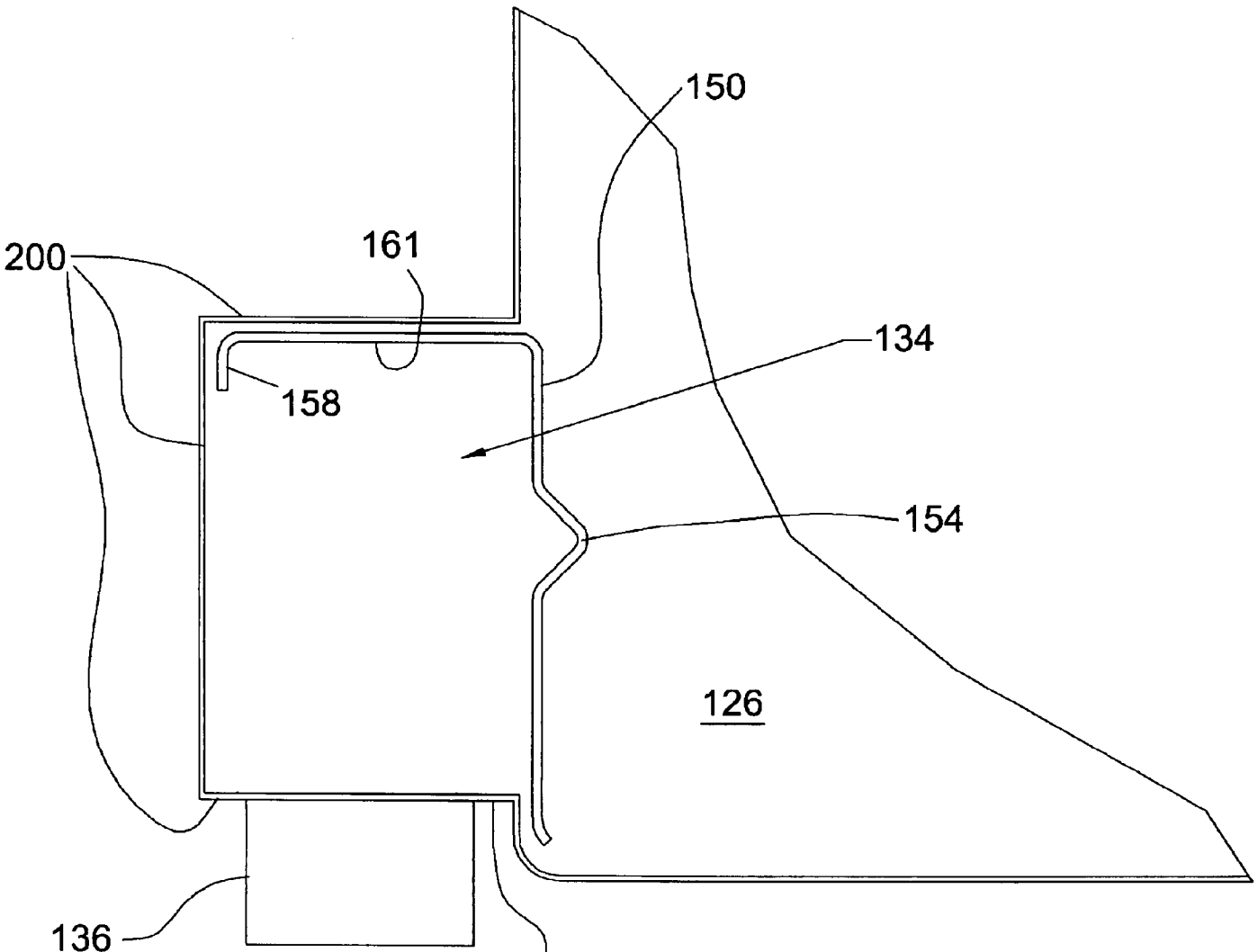
FIG. 18 is a partial side cross-sectional view of the intake cover shown in FIG. 16 after the intake cover has been positioned over the intake chamber.

As shown in FIG. 16, the intake cover 150 includes fastener holes 155, and an upper flange 161 having a downwardly depending lip 158. The intake cover 150 is installed by positioning the intake cover 150 over the intake opening 132 such that the lip 158 is positioned adjacent a back wall of the intake chamber 134, as shown in FIG. 18. Screws 159 (FIG. 16) are inserted into the fastener holes 155, through holes 171 of tabs 163, and retained to tabs 163 by nuts 165. Alternatively, the intake cover 150 can be attached to the tank 102 using other suitable means. For example, another embodiment includes an intake cover that is hingedly attached to the tank using hinge bars. In this embodiment, the intake cover can hingedly swing open into the tank to thereby provide access to the intake chamber and any components therein (e.g., heater, etc.).

The particular inlet hole pattern (e.g., the number, size, shape, and positions of the holes, etc.) can vary depending, for example, on the desired velocity or fluid flow rate through the inlet holes. In the illustrated embodiment, the projection 154 includes a portion of the inlet holes 152. Alternatively, the projection 154 can instead include all or none of the inlet holes 152.

In addition, the inlet holes 152 can be patterned (e.g. shaped, sized, positioned, etc.) to substantially distribute the flow of intake fluid across the intake cover 150. In one embodiment, the inlet holes 152 are patterned to substantially evenly distribute the intake fluid pressure across a lateral length of the intake cover 150. In this particular embodiment, the inlet holes 152 are patterned such that more of the intake cover's material mass is relatively distributed in front of the locations (e.g., 167 and 169 in FIG. 14A) at which the fluid conduits 136 and 140 connect to the intake chamber 134. The inlet holes 152, which are aligned with the locations at which the fluid conduits 136 and 140 connect to the intake chamber 134, can be smaller and/or be more spaced apart than the other inlet holes 152. Varying the inlet hole size and/or staggering inlet hole spacing can help equalize the fluid pressure and flow across the lateral length of the intake cover 150. This, in turn, can help equalize the static pressure and return velocity of the fluid within the intake chamber 134, thereby reducing turbulence of the fluid flow into the conduits 136 and 140.

In one particular embodiment, the intake cover 150 is formed from a sheet of stainless steel into which the inlet holes 152 are formed (e.g., laser cut, etc.). The sheet can be cut into a particular configuration (e.g., width, length, etc.), and then bent to form the projection 154, upper flange 161 and downwardly depending lip 158. Alternatively, a wide range of other suitable materials and manufacturing processes can be used to form the intake cover.

The washer assembly 100 includes outlets for directing fluid from the pumps 104 and 106 into the tank 102. As used herein, the terms "outlet" broadly includes any opening such as perforations, pipes, and discharge openings for directing fluid into the tank.

In the illustrated embodiment of FIGS. 24 through 30, the outlets are discharge openings 108 that are formed in the detachable outlet covers 160 and 162. The term "discharge openings", as used herein, refers to mere holes in the outlet covers 160 and 162, or equivalent openings, which do not include separate parts such as pipes, nozzles, or the like for directing the fluid flow.

Because it is desirable to have the fluid directed down into the tank 102 to avoid splashing fluid out of the tank, the walls 124 and 126 preferably include portions 170 and 172 (FIG. 4) that are angled downwardly. The outlet covers 160 and 162 (FIG. 11) are disposed on these downwardly angled wall portions 170 and 172 such that at least some of the discharge openings 108 are located on the angled wall portions, and, more preferably, all discharge openings 108 are located on the angled portions.

By providing the angled wall portions 170 and 172, the need to include separate pipes and nozzles to direct fluid down into the tank is eliminated and the size of the opening at the top of the tank 102 is increased. Eliminating the need for separate pipes and nozzles also allows for the elimination of problems associated with pipes and nozzles unnecessarily extending into the tank and getting in the way when then tank is full of dishware, personnel catching their hands on pipes and nozzles during the dishwashing process, and/or increased manufacturing costs associated with pipes and nozzles.

In other embodiments, however, a similar effect is accomplished by angling the entire tank walls, but this reduces the size of the opening at the top of the tank. Nevertheless, aspects of the present invention will work fine by angling the entire wall and/or locating the discharge openings on the wall itself. If the entire wall is angled it, of course, includes an angled portion.

Figure 10:
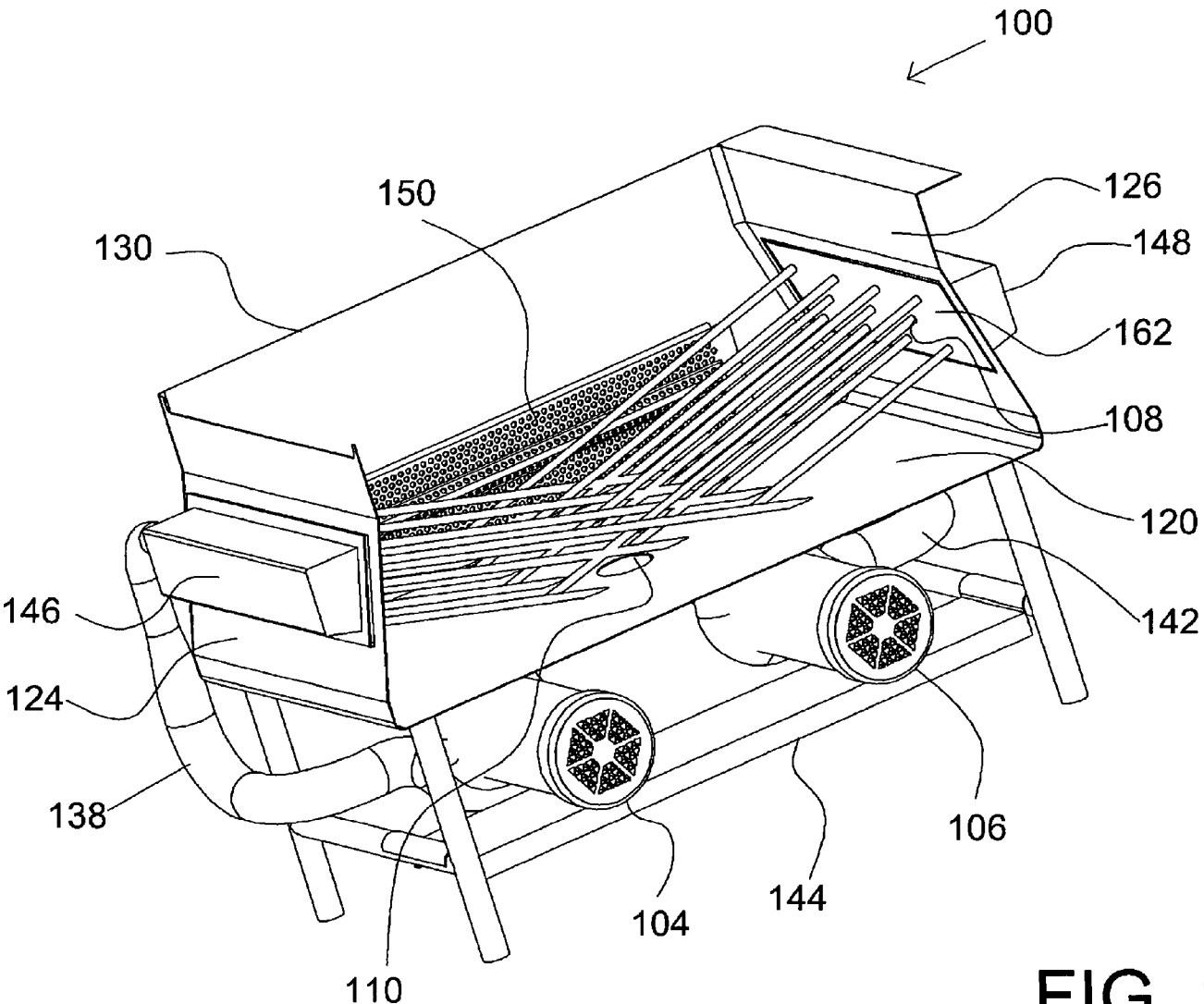
FIG. 10 is a perspective view of the kitchenware washing assembly shown in FIG. 1 with a portion broken away to reveal the crisscross fluid flow in the tank when fluid is circulated through the discharge openings.
Figure 11:
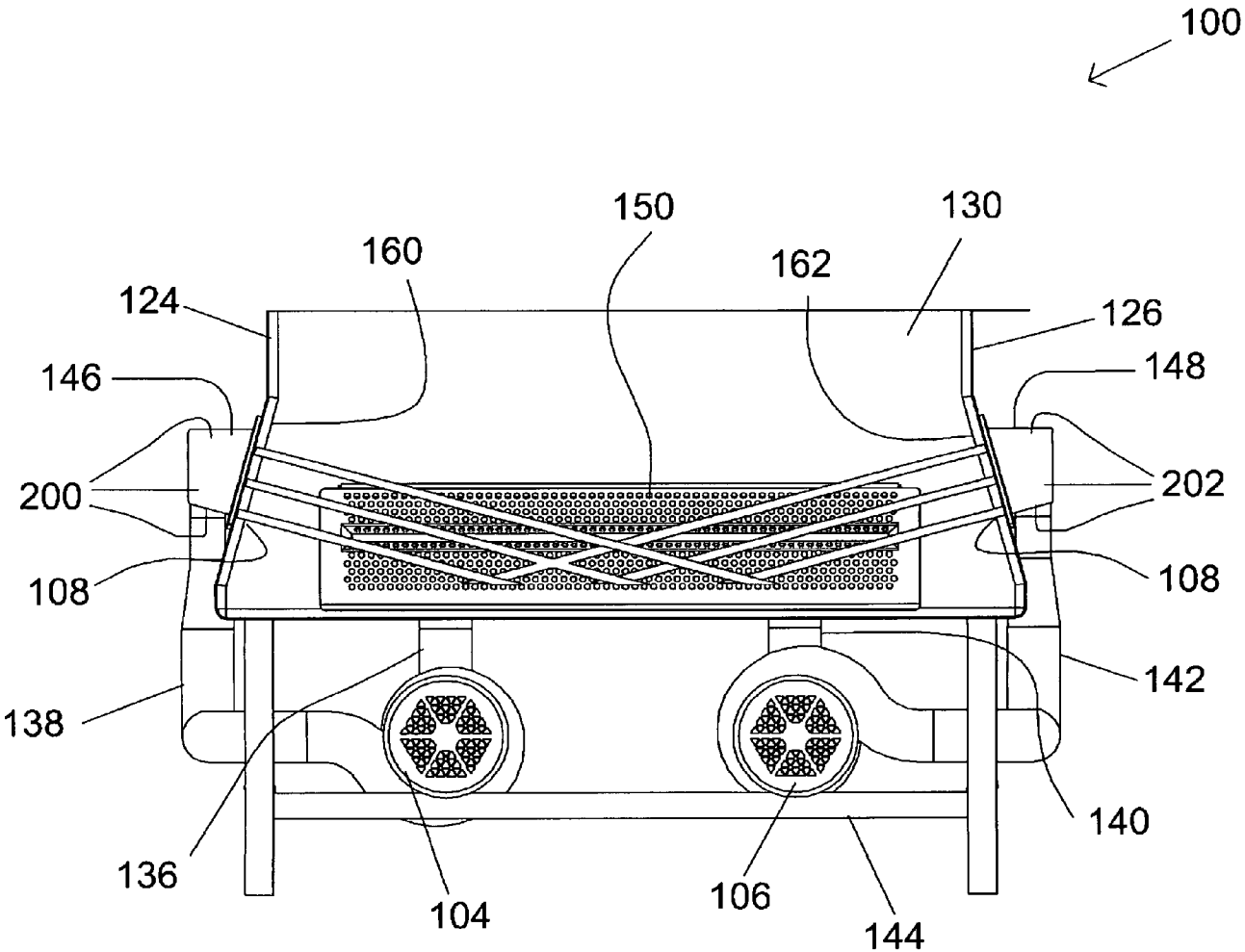
FIG. 11 is a cross-sectional view of the kitchenware washing assembly of FIG. 10 showing the crisscross pattern of fluid flow from the discharge openings.

In the illustrated embodiment, the outlet covers 160 and 162 are positioned on opposing walls 124 and 126. In embodiments having a circular or ovular shaped tank, the outlet covers 160 and 162 can be positioned on opposed portions of the curved wall. Alternative embodiments, however, include washer assemblies having outlets or discharge openings on only one wall or on more than two walls. But placing the outlets on opposed walls is generally preferred. With the opposed configuration, turbulence in the tank is increased to facilitate cleaning kitchenware. As shown in FIGS. 10 and 11, the opposed discharge openings 108 discharge the fluid such that the fluid forms a crossing pattern. The crossing pattern causes increased turbulence in the tank 102 to enhance the cleaning ability of the washer assembly 100 while minimizing (or at least reducing) splashing of washing fluid from the tank 102.

The particular pattern (e.g., number of, size, shape, positions of the discharge openings, etc.) can vary depending, for example, on the desired velocity or fluid flow rate through the openings. For example, the illustrated embodiment includes circular discharge openings 108 having a diameter of about 7/16 inches. Alternatively, other sizes and shapes of openings can be used, for example, in order to increase or decrease the velocity or fluid flow rate through the openings.

Figure 28:
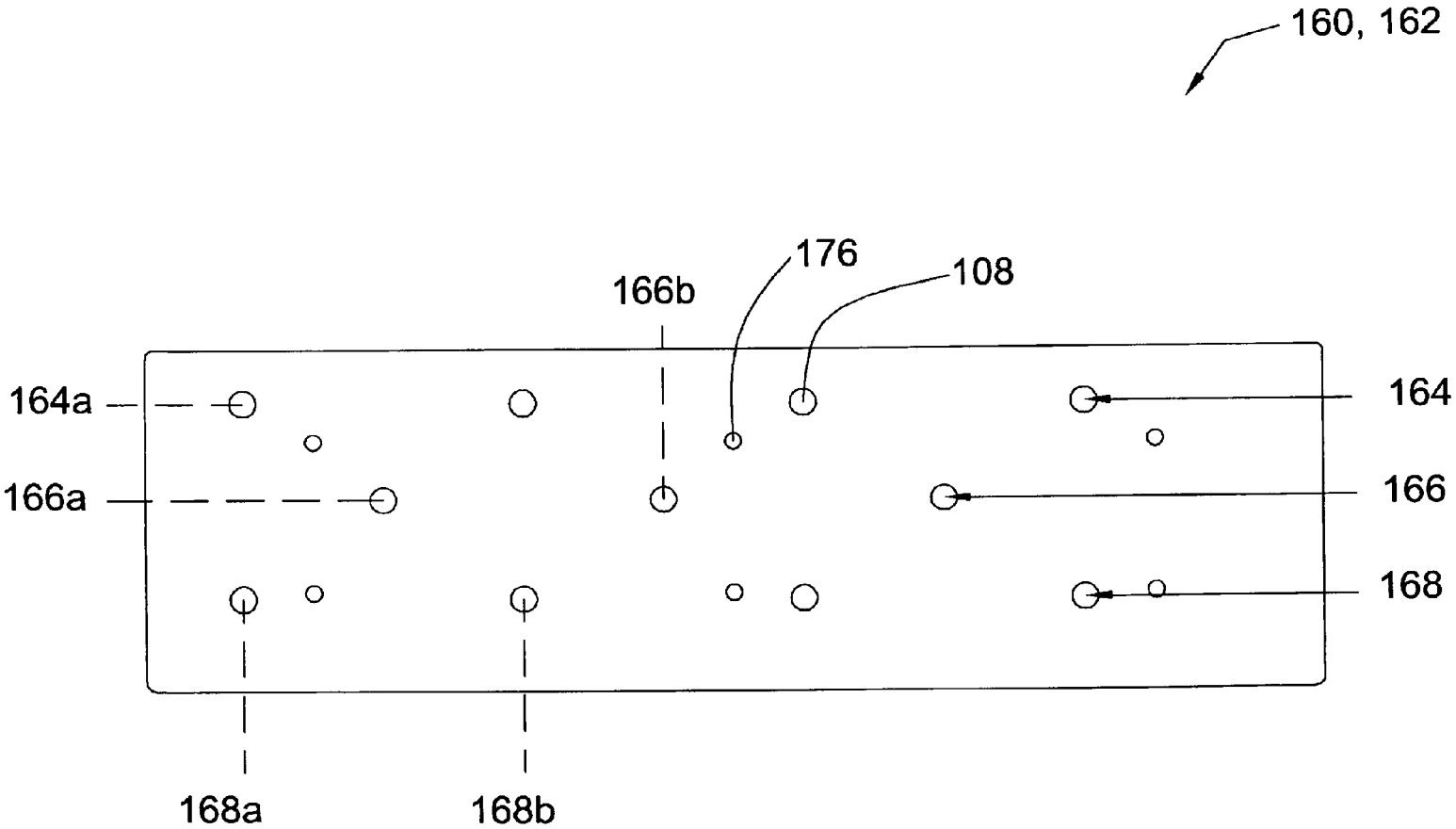
FIG. 28 is a front elevation view of the outlet cover shown in FIG. 24.
Figure 29:
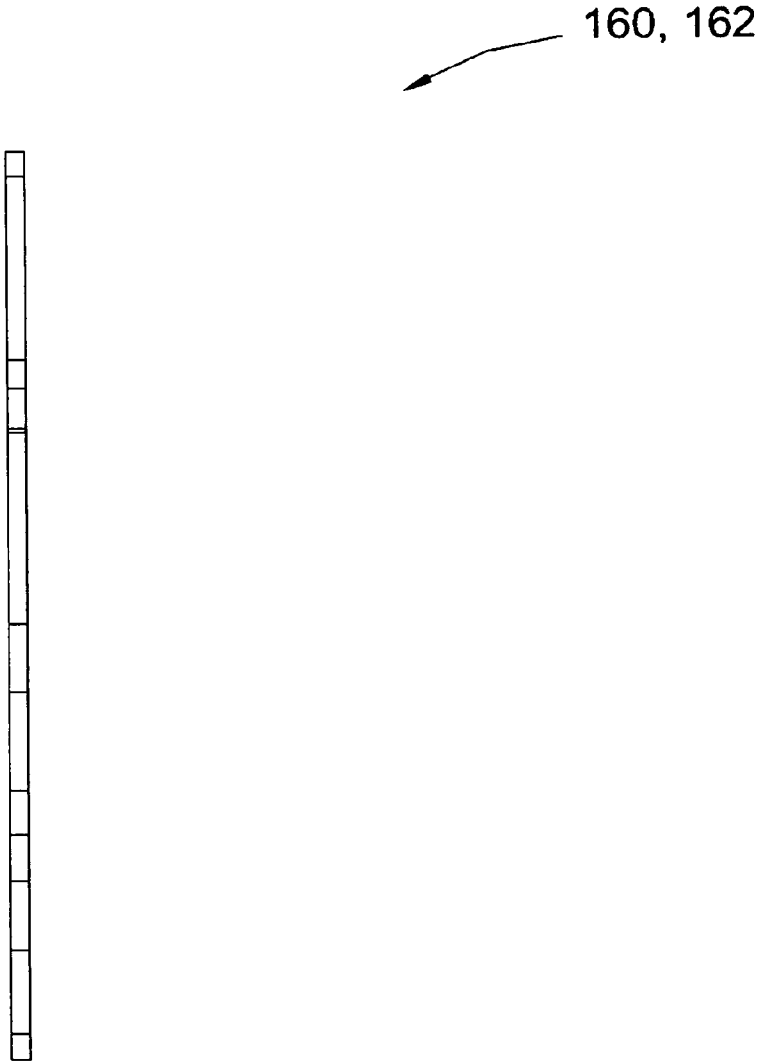
FIG. 29 is a side elevation view of the outlet cover shown in FIG. 24.
Figure 30:
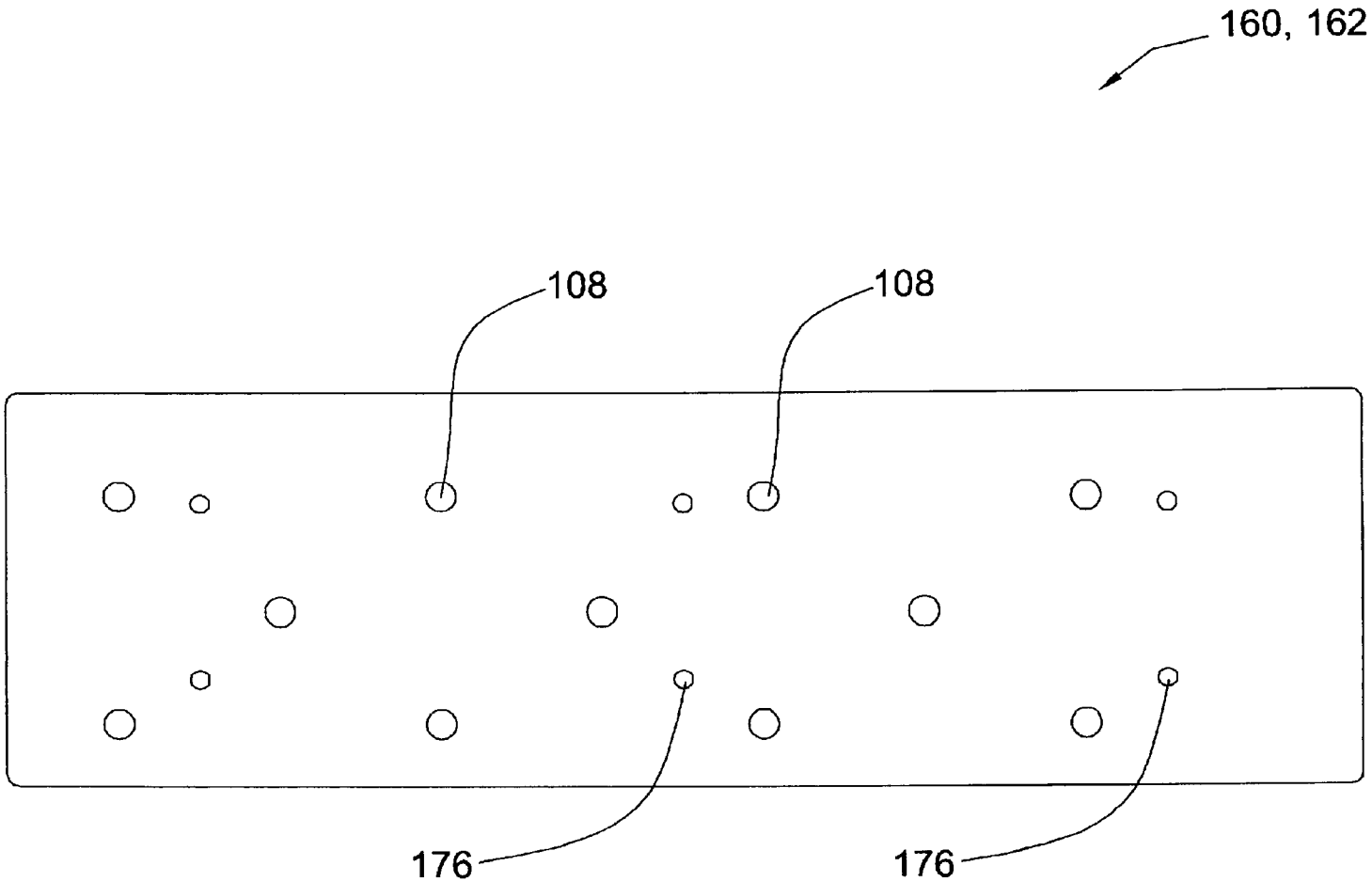
FIG. 30 is a rear elevation view of the outlet cover shown in FIG. 24.
Figure 31:
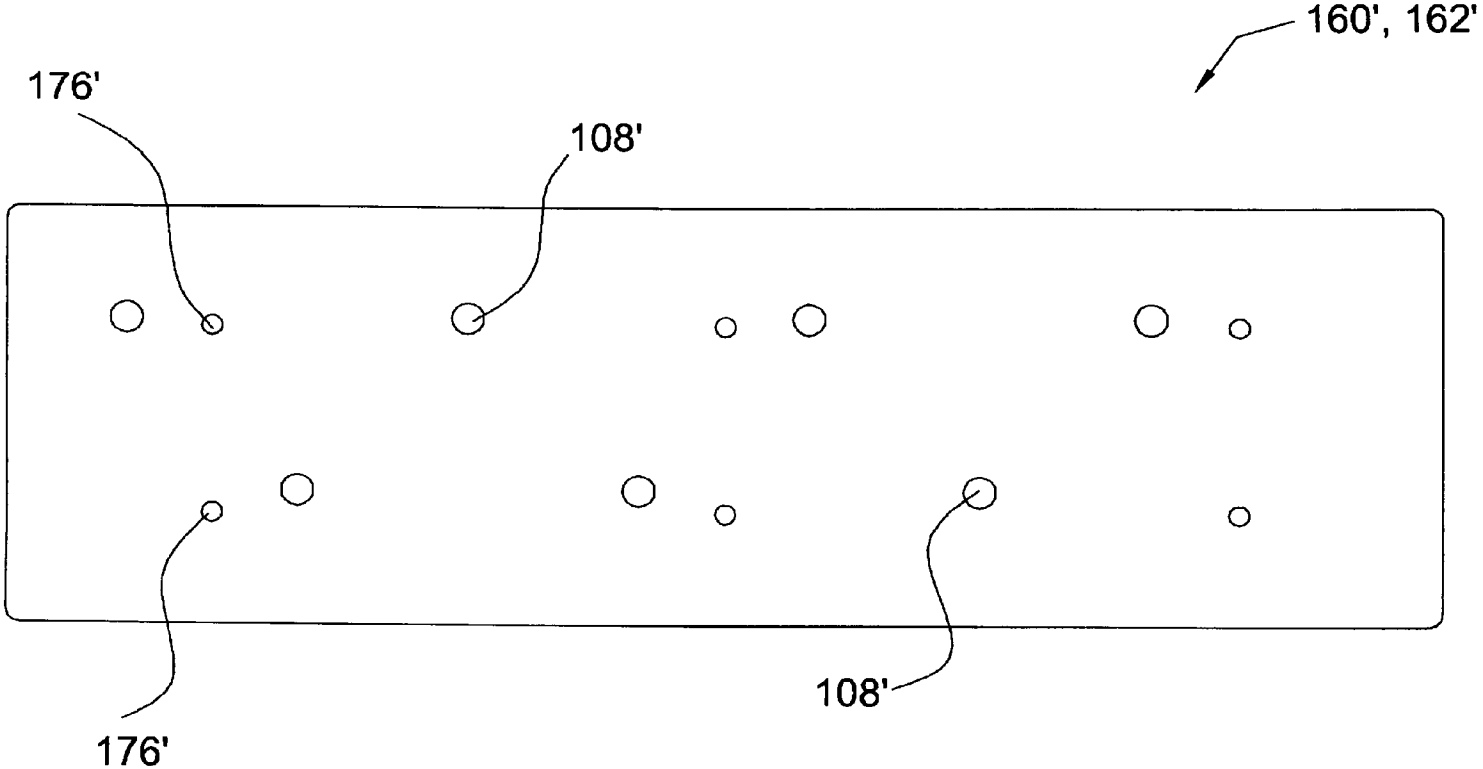
FIG. 31 is a front elevation view of another embodiment of an outlet cover with a different outlet pattern than the outlet cover shown in FIG. 24.
Figure 32:
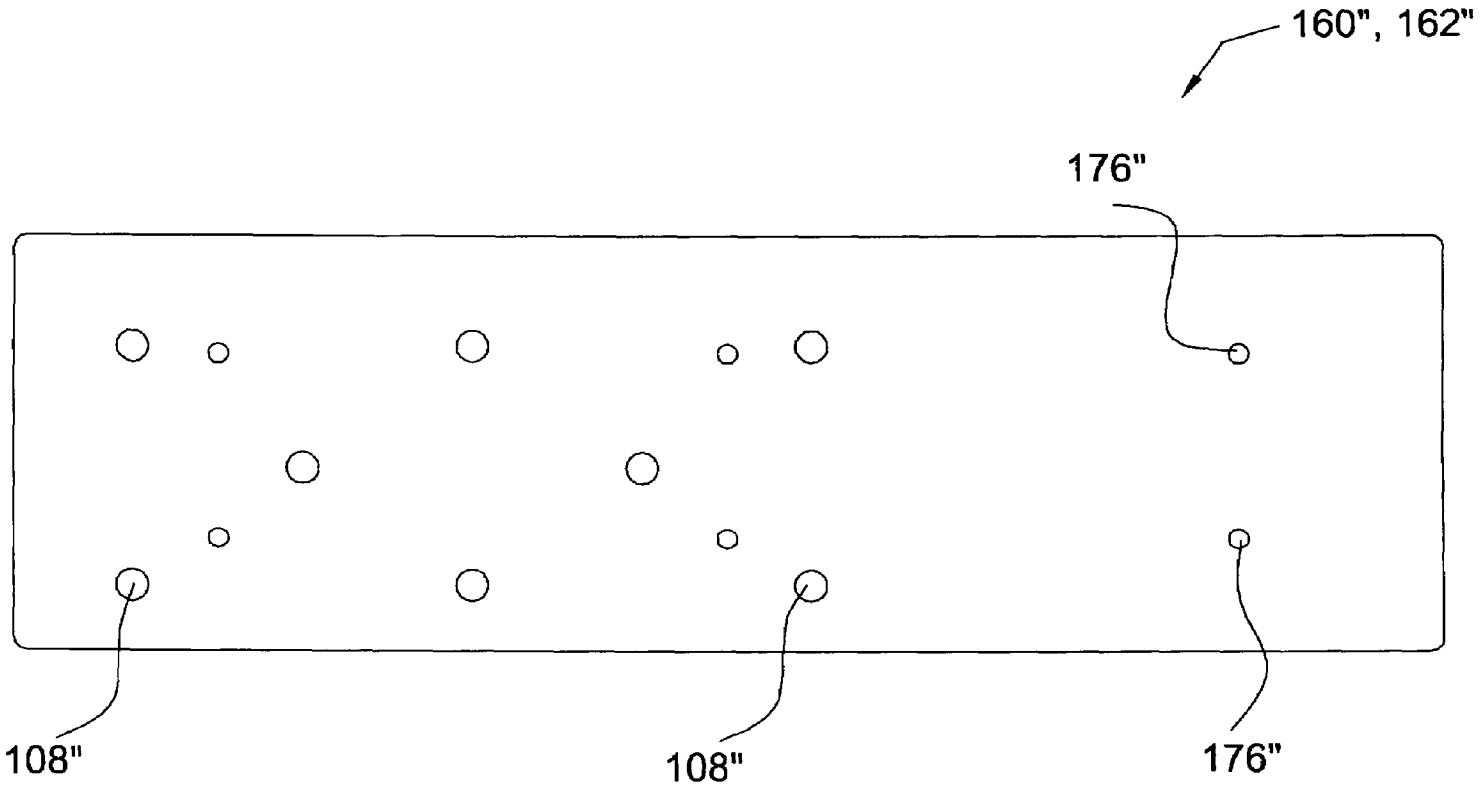
FIG. 32 is a front elevation view of another embodiment of an outlet cover with a different outlet pattern than the outlet covers shown in FIGS. 24 and 31.

In addition, the discharge openings 108 of each outlet cover 160 and 162 can be arranged in any number of rows and columns. FIG. 28 illustrates an exemplary arrangement in which the discharge openings 108 are arranged in three rows 164, 166, 168. In one embodiment, the distance between horizontal centers of the discharge openings 108 is preferably about 5.27 inches (as shown in FIG. 28 between points 168*a* and 168*b*). The vertical distance between centers of the openings 108 in each row is preferably about 1.94 inches (as shown in FIG. 28 between points 164*a* and 166*a*). The horizontal distance between hole centers for adjacent rows is preferably half the distance between horizontal centers in a given row and is about 2.635 inches (as shown in FIG. 28 between points 166*b* and 168*b*). The distances, number, and arrangement of discharge openings 108 shown and described are exemplary only, as the distances, number, and arrangement of such openings can be altered. For example, FIGS. 31 through 32 respectively illustrate outlet covers 160', 162' 160", 162', having outlets 108', 108" and fastener holes 176', 176". The outlets 108', 108" form a pattern that is different than the outlet pattern of the outlet covers 160, 162 shown in FIG. 28.

Figure 4:
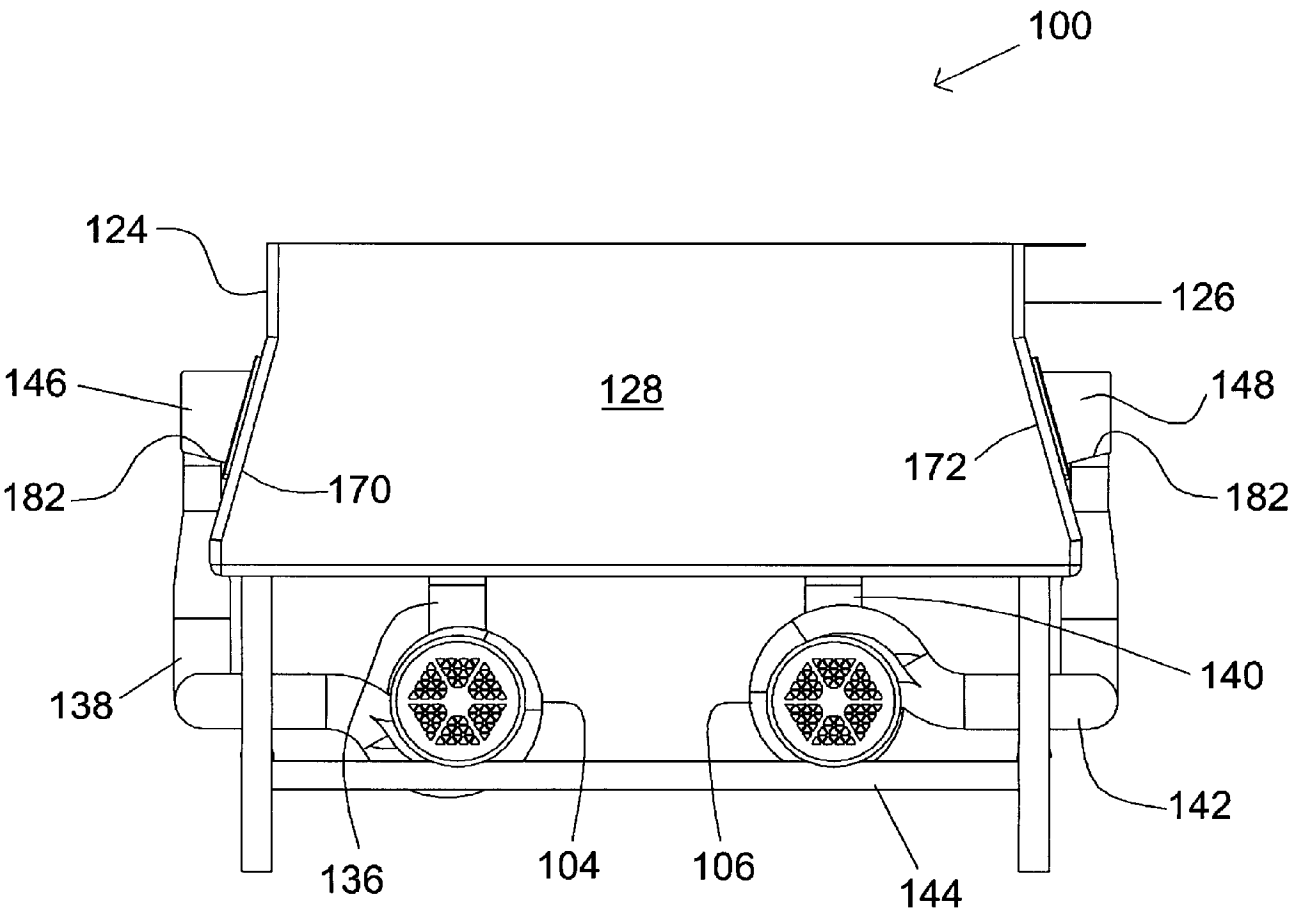
FIG. 4 is a front elevation view of the kitchenware washing assembly shown in FIG. 1.
Figure 5:
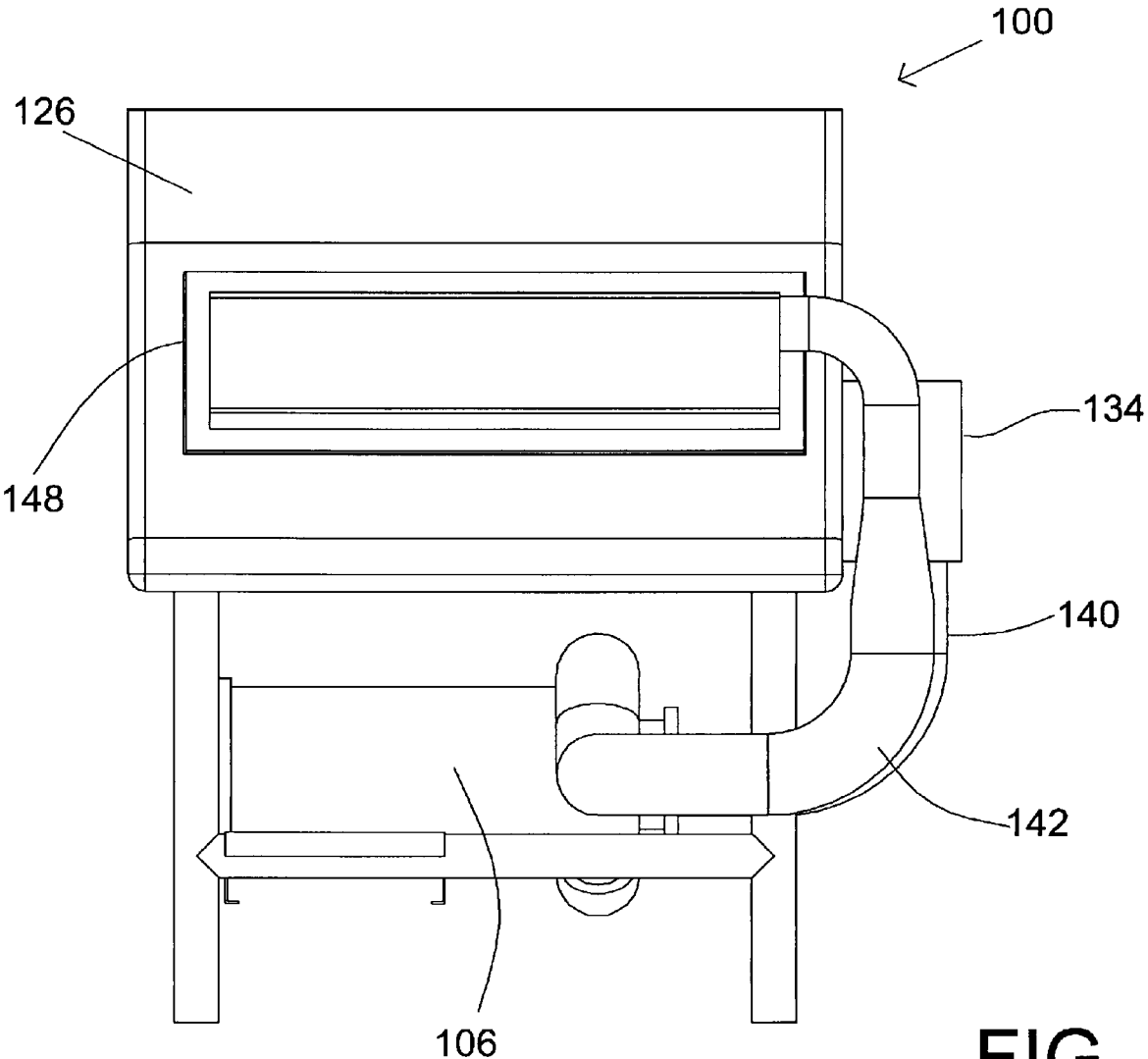
FIG. 5 is a right side elevation view of the kitchenware washing assembly shown in FIG. 1.
Figure 6:
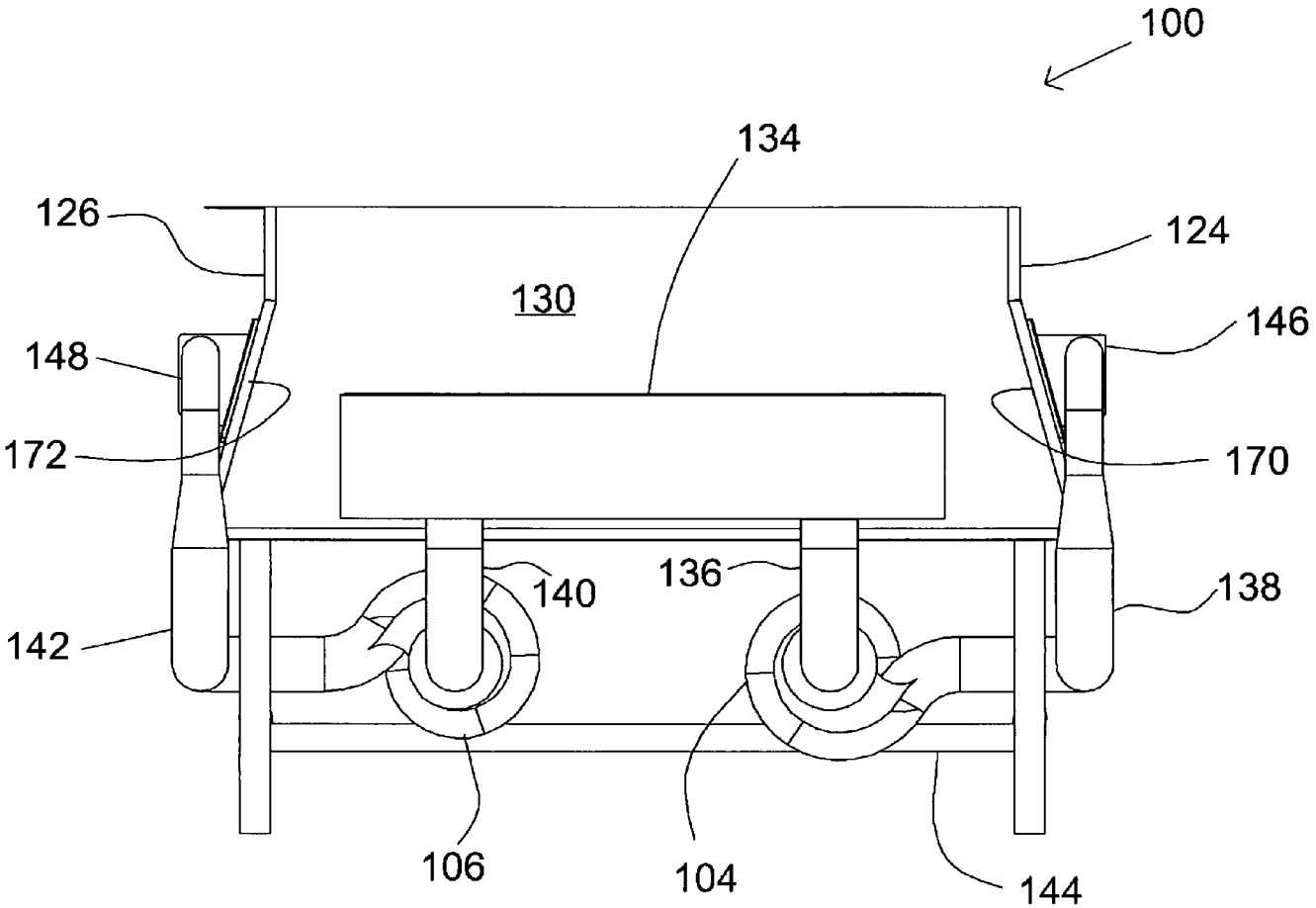
FIG. 6 is a rear elevation view of the kitchenware washing assembly shown in FIG. 1.
Figure 7:
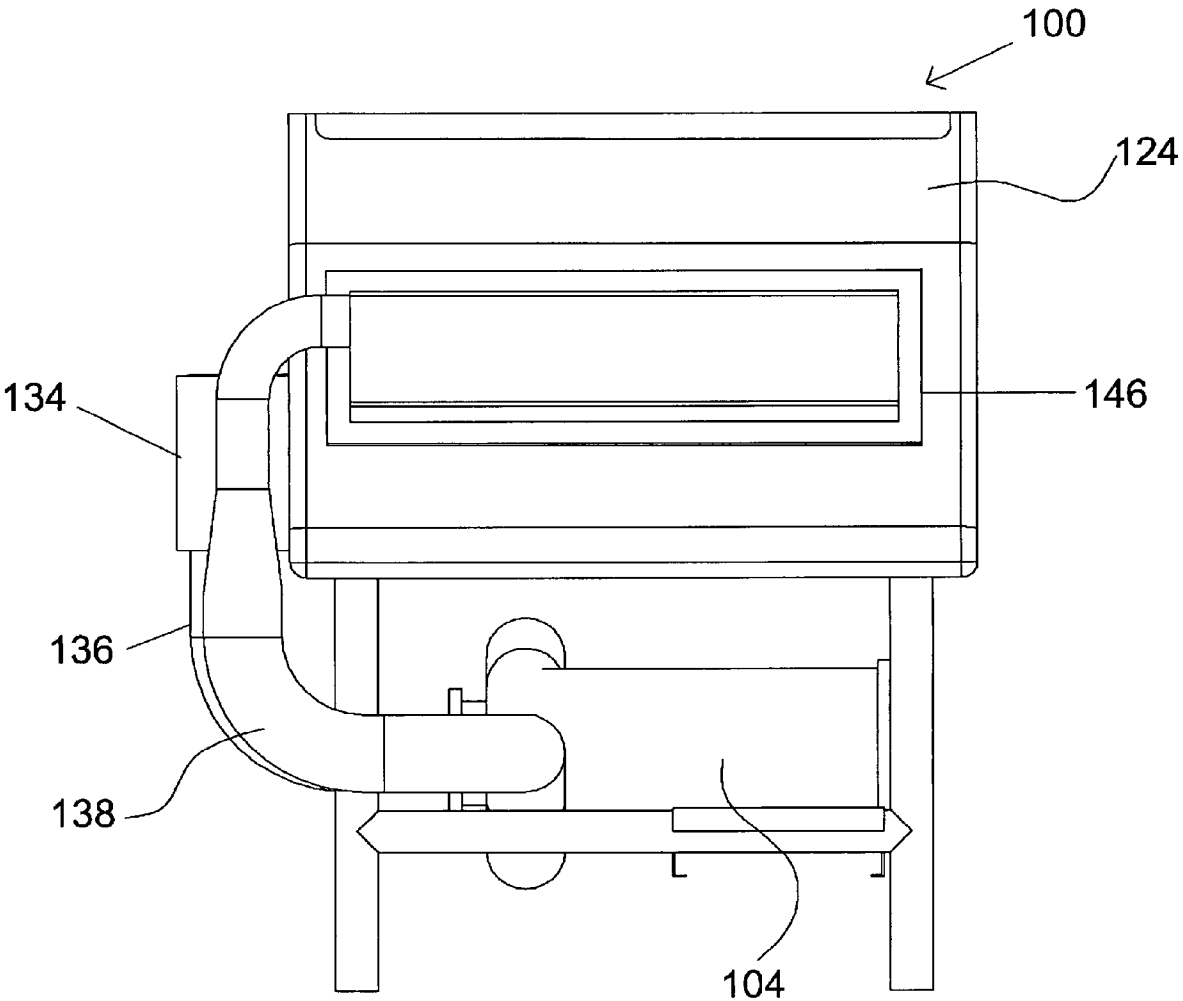
FIG. 7 is a left side elevation view of the kitchenware washing assembly shown in FIG. 1.
Figure 8:
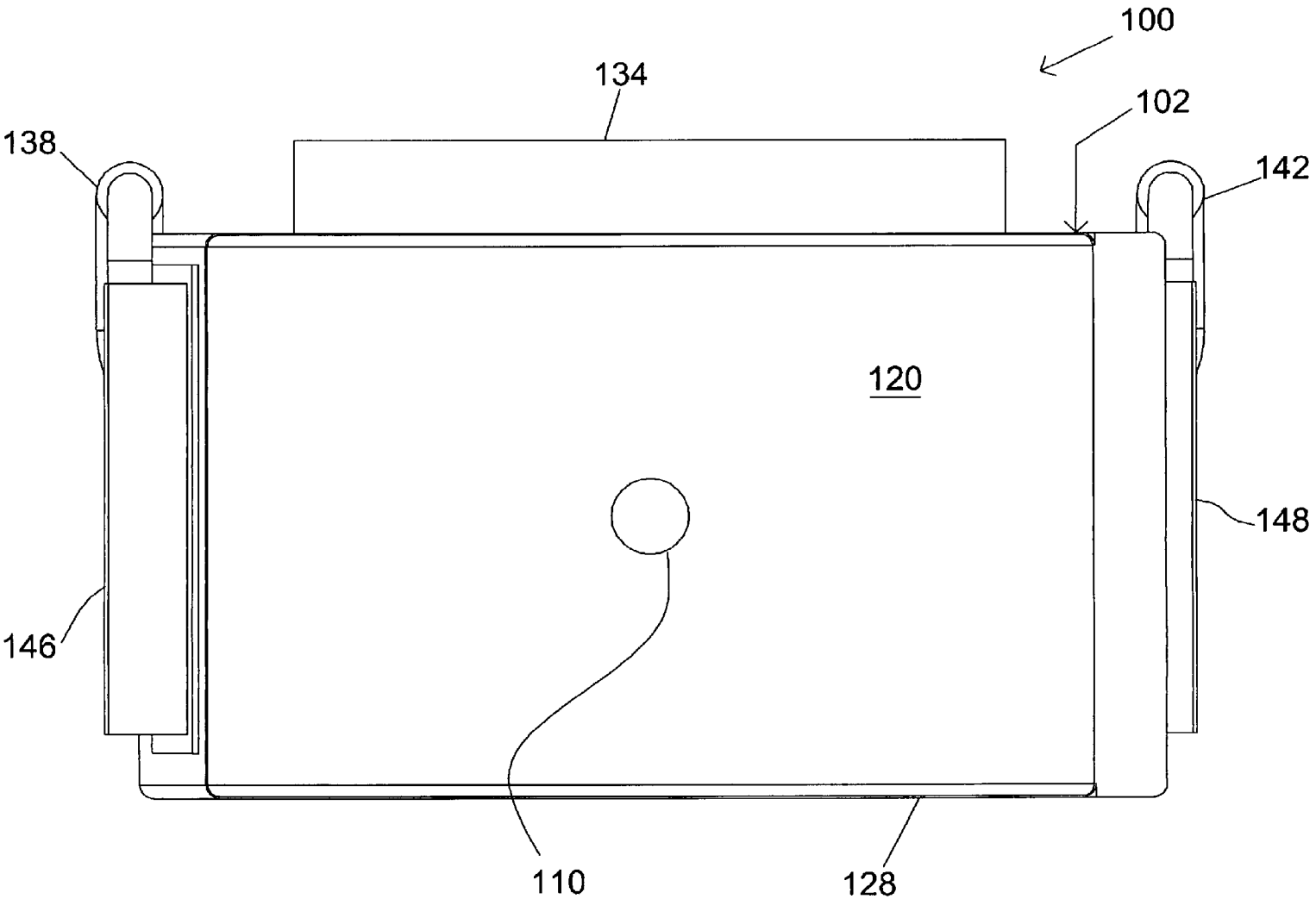
FIG. 8 is a top plan view of the kitchenware washing assembly shown in FIG. 1.

As shown in FIG. 4, sidewalls 124 and 126 include angled portions 170 and 172, respectively, upon which the outlets or discharge openings 108 (FIG. 25) are located. In one embodiment, the angled wall portions 170 and 172 are angled between about sixty degrees and eighty degrees from horizontal. In another embodiment, the angled portions 170 and 172 are angled about seventy-five degrees from the horizontal. In the illustrated embodiment, the outlet covers 160 and 162 include discharge openings 108 which are located on the angled portions 170 and 172 such that fluid directed through the discharge openings 108 forms a crossing pattern as shown in FIGS. 10 and 11. To enhance fluid rotation in the tank 102, various embodiments offset the opposing patterns on the opposed walls 124 and 126 so that the discharge openings 108 are not on directly opposed paths. In one particular embodiment, this is accomplished by shifting the discharge openings pattern on one of the outlet covers slightly to the left, and/or shifting the discharge openings pattern on the other outlet cover slightly to the right.

In one exemplary embodiment, the rearward-most discharge openings 108 of the outlet cover 160 are preferably about 7.3 inches from the back edge of wall 124, and the forward-most discharge openings 108 of outlet cover 160 are about 4.6 inches from the front edge of wall 124. This adjustment is reversed for the outlet cover 162 in order to create an forward/rearward offset between opposed discharge openings. The rearward-most discharge openings 108 of the outlet cover 162 are preferably about 4.6 inches from the back edge of wall 126, and the forward-most discharge openings 108 of outlet cover 162 are about 7.3 inches from the front edge of wall 126. The arrangement shown creates desirable fluid rotation within the tank 102. Aspects of this invention will, however, work well if the discharge openings on opposed walls are in direct opposed relationship. Turbulence in the tanks is still significant, even though fluid rotation is less.

Figure 24:
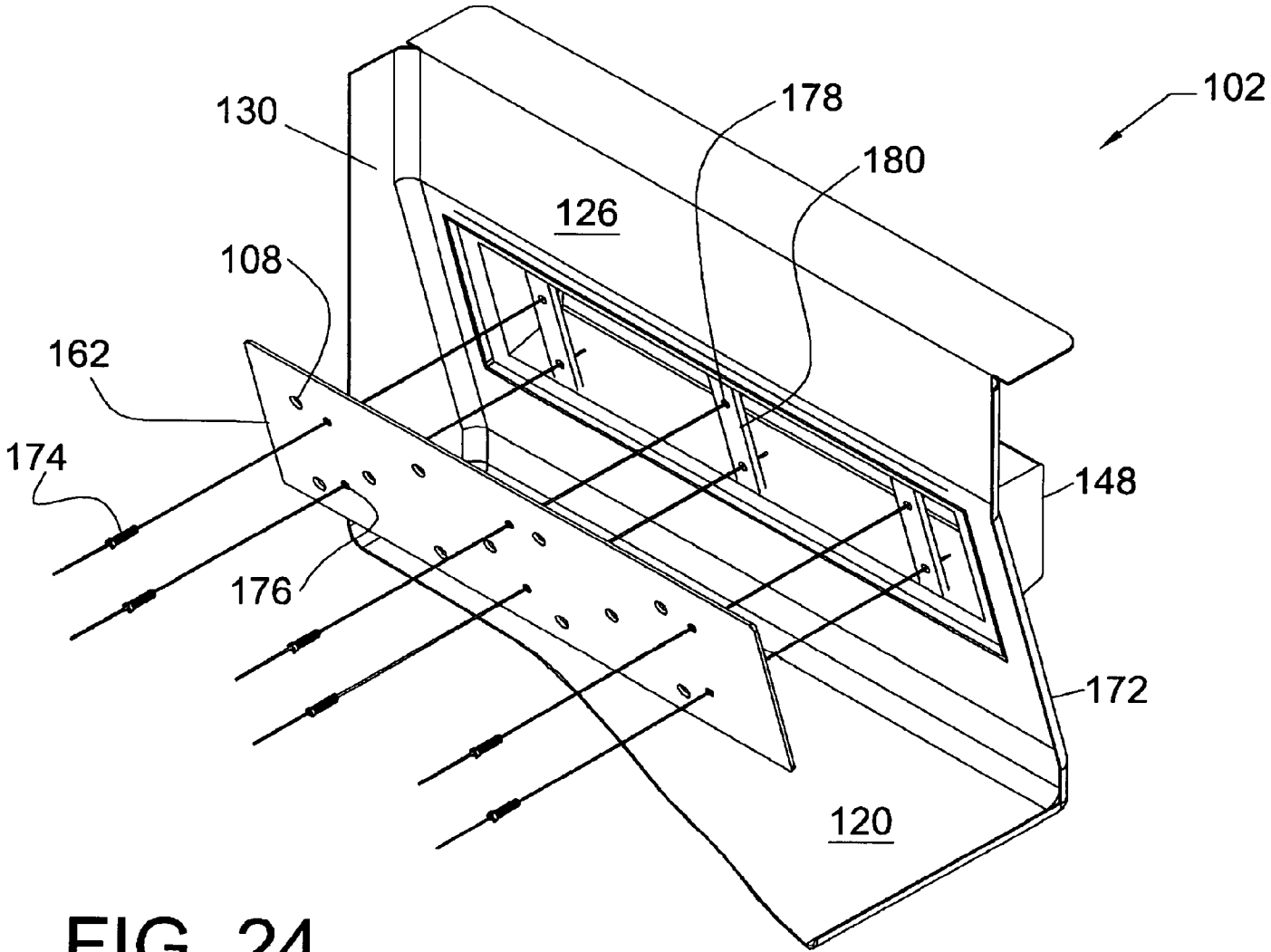
FIG. 24 is a partial exploded perspective view of a kitchenware washing assembly with a portion of the tank broken away and illustrating an outlet cover that can be removably attached to the tank to cover an outlet chamber according to one embodiment of the invention.

As shown in FIG. 24, the outlet covers 160 and 162 can be detached from the tank 102. Advantageously, this feature allows the interior of the outlet chambers 146 and 148 to be readily accessed, for example, for cleaning. Having detachable outlet covers also allows the outlet covers themselves to be more easily serviced, for example, to replace the outlet covers, clean out the outlets or discharge openings, and/or clean the outlet covers.

A wide range of systems and methods can be used to detachably connect the outlet covers 160 and 162 to the tank 102. In the illustrated embodiment, screws 174 are inserted through fastener holes 176 defined by the covers 160 and 162, and through fastener holes 178 defined by vertically extending supports members 180. The support members 180 are coupled to the tank 102, for example, by welding or other suitable attachment means. The particular type of fastening method, number of fasteners, and arrangement of the fastener holes can vary depending, for example, on the pressure at which the fluid will be discharged from the discharge openings 108 into the tank 102.

In various embodiments, each outlet cover 160 and 162 can have its perimeter sealed in a substantially fluid-tight manner. In addition, the fastener holes 178 can also be sealed in a substantially fluid-tight member. This sealing can help ensure that fluid is discharged into the tank 102 through the discharge openings 108 and that the fluid doesn't circumvent the discharge openings 108 by escaping through the fastener holes 178 and/or the interface between the outlet covers 160, 162 and the tank walls 124 and 126. By way of example, the interfaces between the tank walls 124, 126 and the respective outlet covers 160, 162 can be sealed by positioning a resilient sealing member generally around each outlet cover's perimeter between the outlet cover and the tank wall. And by way of further example, resilient O-rings can be used to seal the fastener holes 178. Alternatively, a wide range of other sealing members can be employed for sealing the outlet covers 160 and 162 and/or fastener holes 178.

In various embodiments, a plurality of detachable interchangeable outlet covers is provided. Each outlet cover (or each respective pair) can have outlets or discharge openings forming a different pattern (e.g., arranged differently, differently sized openings, differently shaped openings, etc.) from the other detachable covers. By selecting from amongst the interchangeable outlet covers, the operator can customize the kitchenware washing assembly with a particular pattern of outlets or discharge openings. For example, the operator may want to use a particular outlet pattern for heavy pots and pans, but use a different pattern for more delicate and fragile dishware. Or, for example, the operator may want to use a particular outlet pattern for one tank wall, but use a different pattern for another tank wall. Accordingly, the interchangeable outlet covers can even further increase the utility and efficiency of a kitchenware washing assembly.

In the illustrated embodiment, the outlet chambers 146, 148 and the intake chamber 134 are configured to provide drainage into the tank. With this positive drainage, fluid will drain out of the outlet chambers 146, 148 and intake chamber 134 such that little to no fluid will remain within these chambers 134, 146, 148. By eliminating (or at least reducing) the amount of standing fluid within the intake chamber 134 and outlet chambers 146, 148, the kitchenware washing assembly will be more sanitary.

Figure 33:
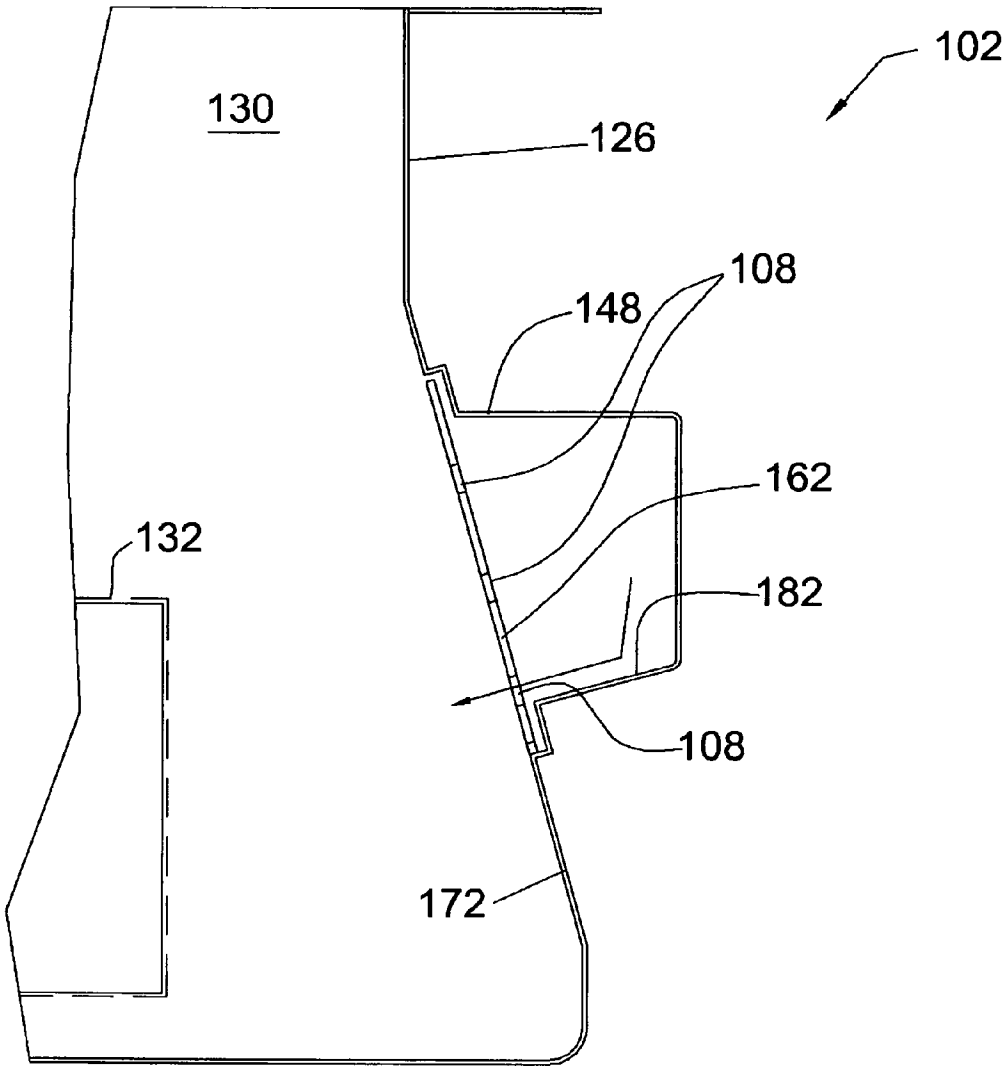
FIG. 33 is a partial cross-sectional side view of an outlet chamber of a kitchenware washing assembly having positive drainage according to one embodiment of the invention.

As shown in FIGS. 4 and 33, the outlet chambers 146 and 148 include a bottom 182 that generally slopes downwardly towards the tank 102, thereby providing positive drainage into the tank 102. Positive draining into the tank 102 is further facilitated by the positioning of the outlet chambers 146 and 148 on the respective angled wall portions 170 and 172.

Figure 25:
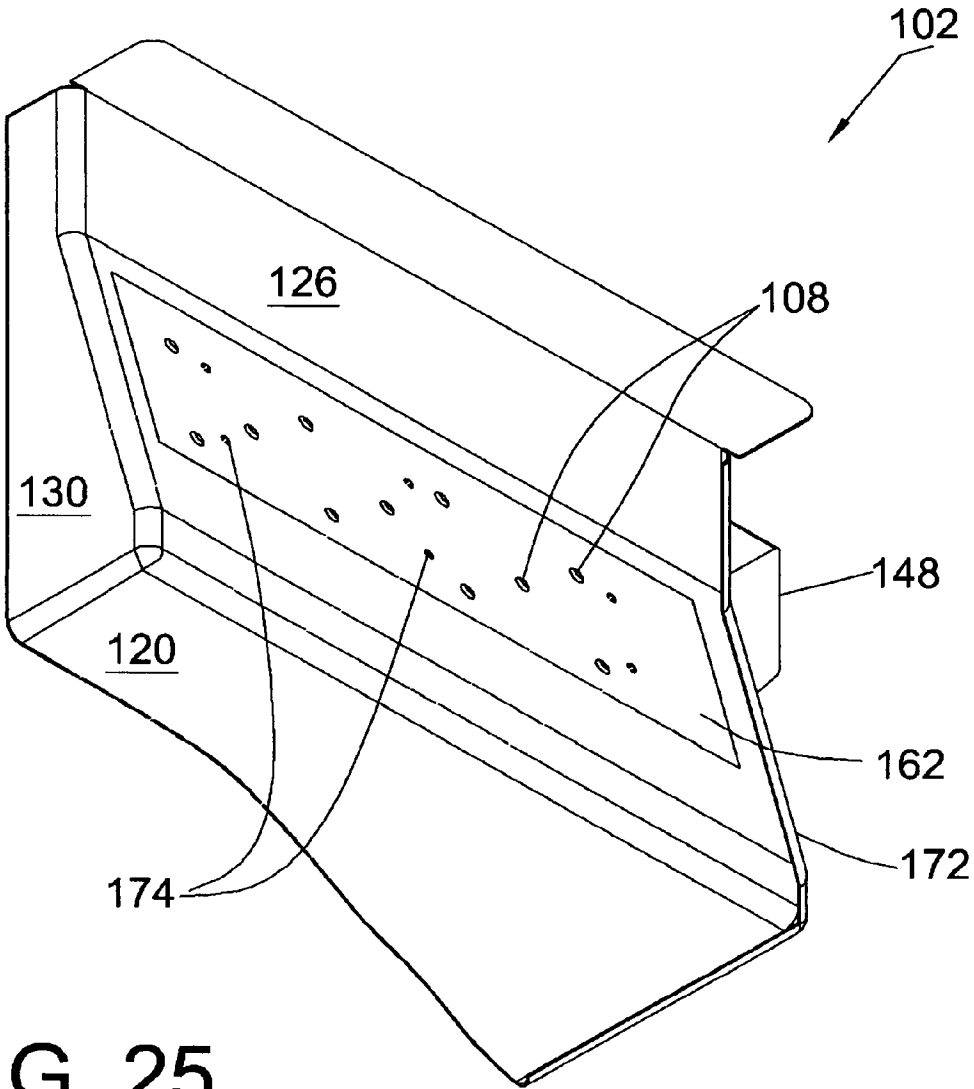
FIG. 25 is a partial perspective view of the tank and outlet cover shown in FIG. 24 after the outlet cover has been removably attached to the tank.
Figure 26:
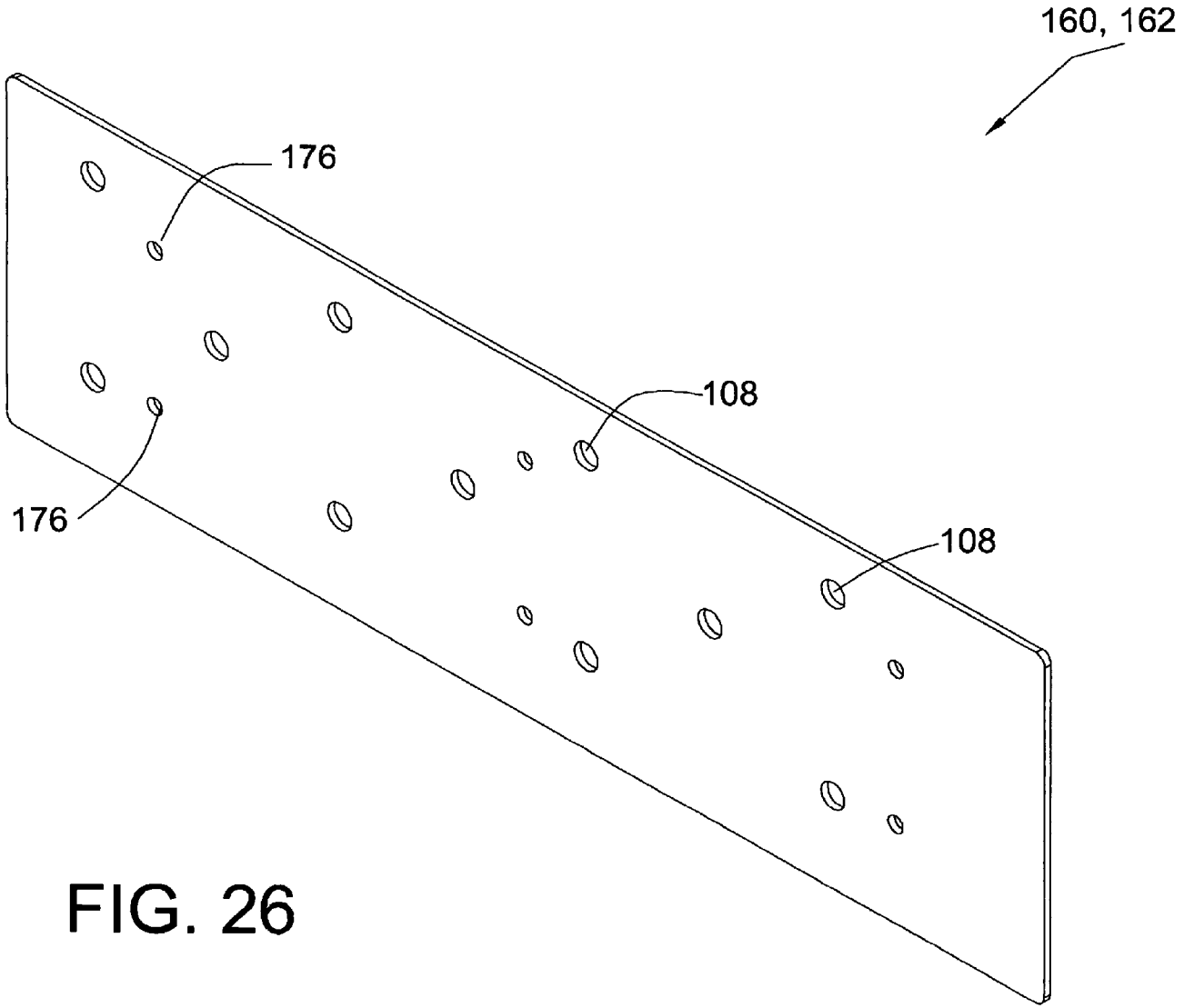
FIG. 26 is an outer perspective view of the outlet cover shown in FIG. 24.
Figure 27:
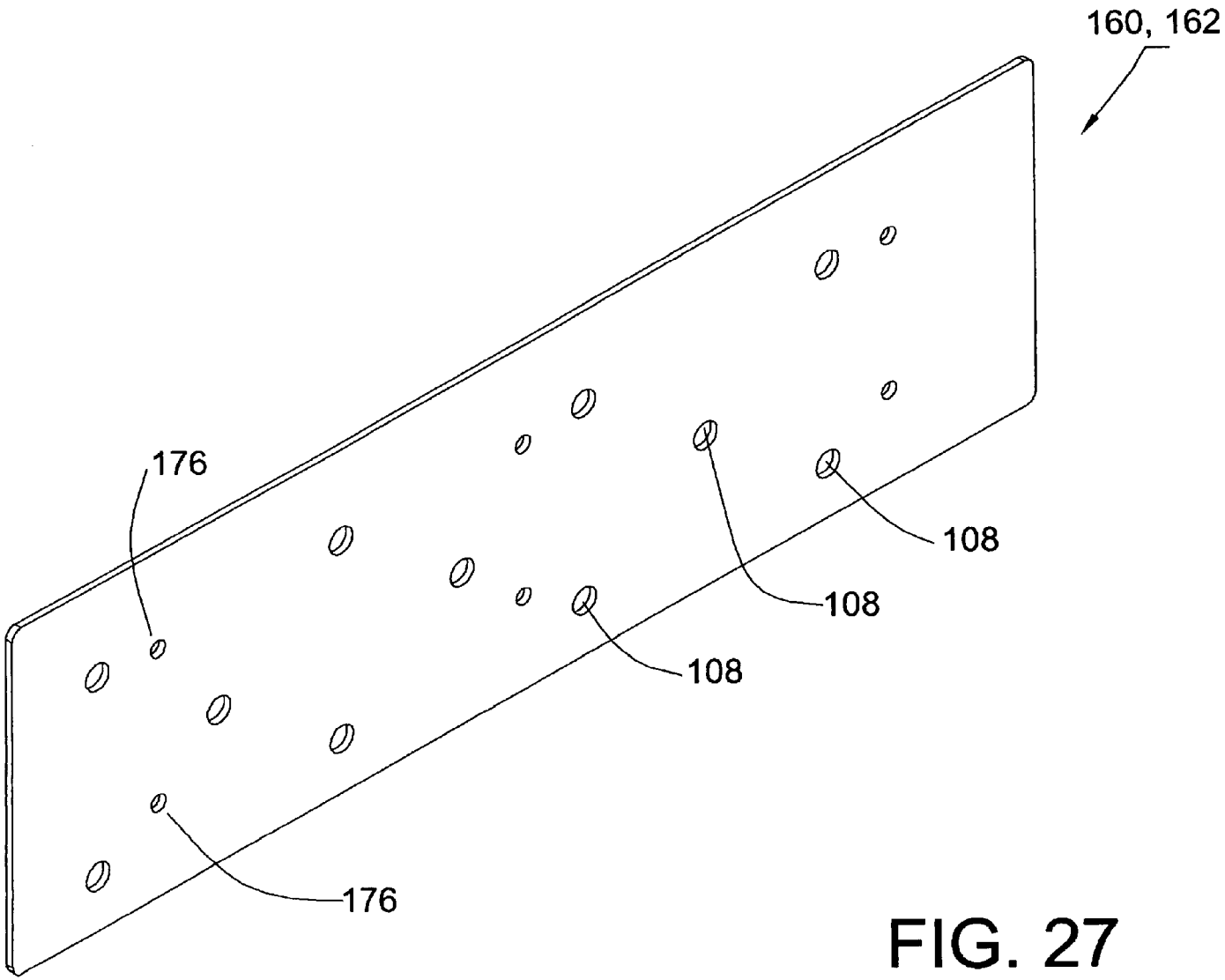
FIG. 27 is an inner perspective view of the outlet cover shown in FIG. 24.

The outlet covers 160 and 162 also include at least some discharge openings 108 adjacent the bottom 182 of the respective outlet chambers 146 and 148 when the outlet covers 160 and 162 are positioned to cover the outlet chambers 146 and 148, as shown in FIGS. 24 and 25. This also facilitates drainage from the outlet chambers 146 and 148 through those discharge openings 108 into the tank 102.

Figure 42:
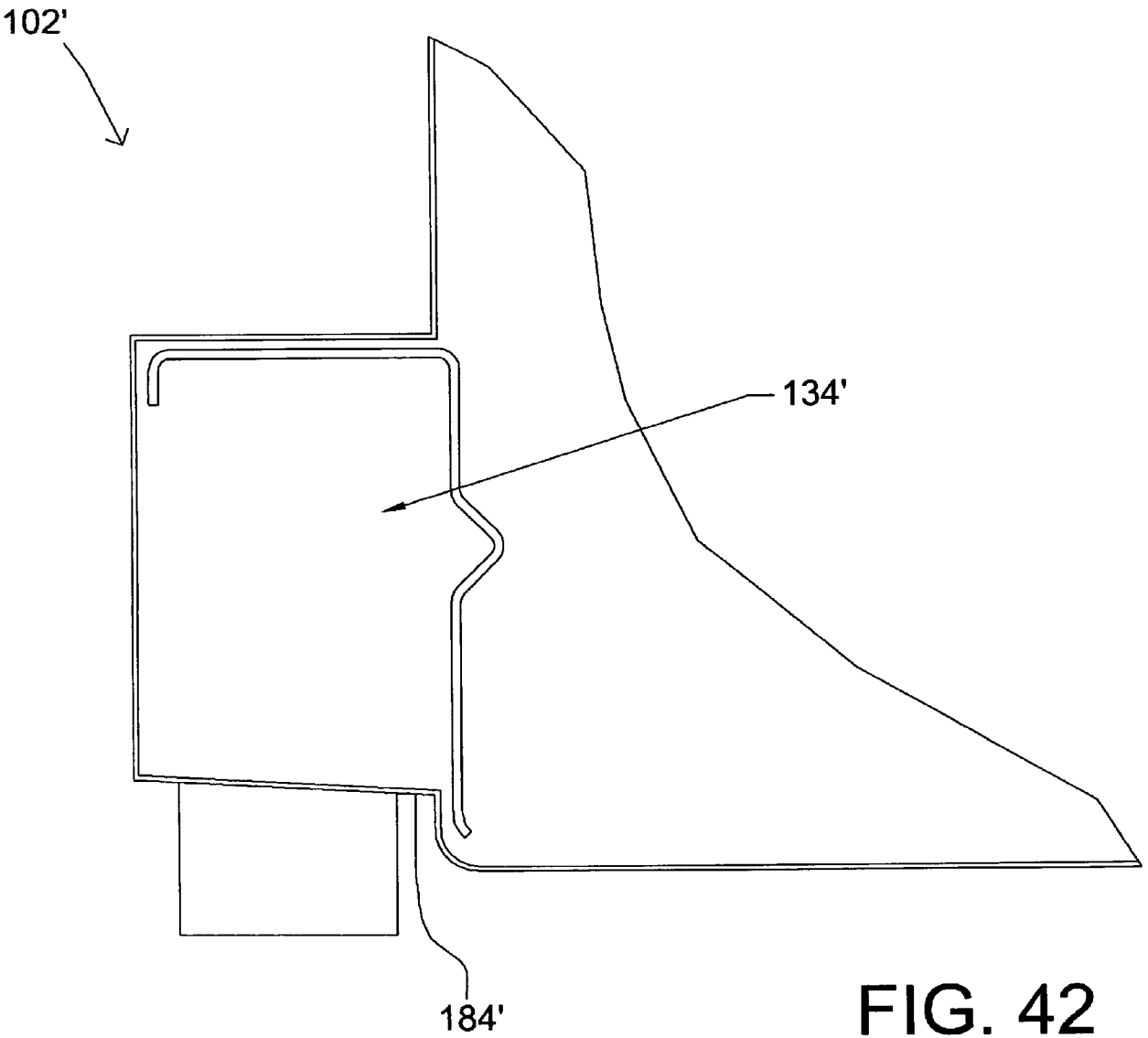
FIG. 42 is a partial side cross-sectional view of a kitchenware washing assembly with a portion of the tank broken away and illustrating an intake chamber having a downwardly sloping bottom portion according to one embodiment of the invention.

The intake chamber 134 can also have positive draining into the tank 102. For example, at least some of the inlet holes 152 in the intake cover 150 can be positioned adjacent the bottom 184 of the intake chamber 134 in order to facilitate drainage from the intake chamber 134 through those inlet holes 152 into the tank 102. See FIG. 18. Additionally, or alternatively, the intake chamber 134' can also include a bottom 184' that generally slopes downwardly toward the tank 102' to provide positive drainage from the intake chamber 134' into the tank 102', as shown in FIG. 42. As yet another alternative, the intake chamber 134 can be positioned on a wall portion that is angled downwardly.

Figure 14B:
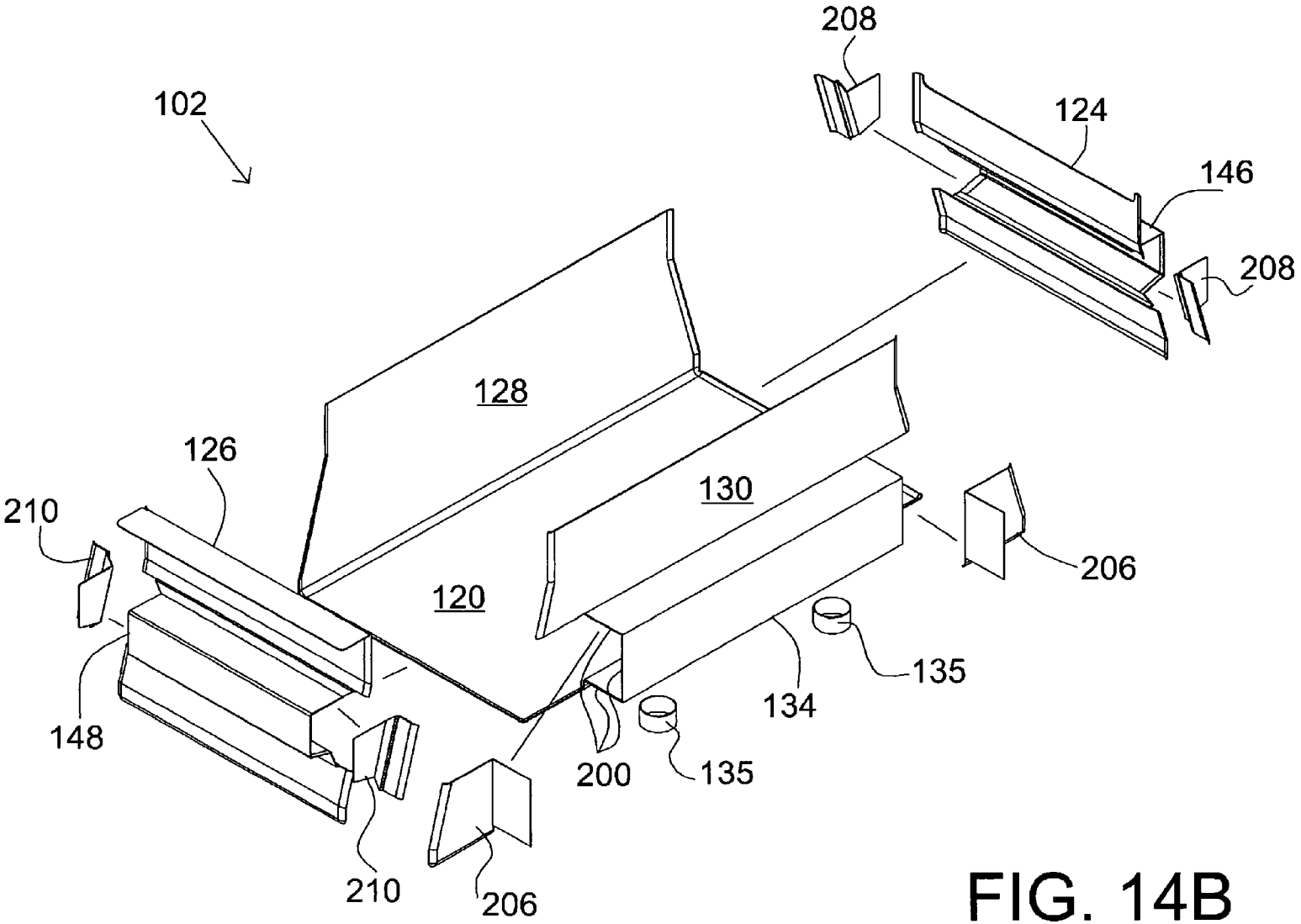
Figure 14C:
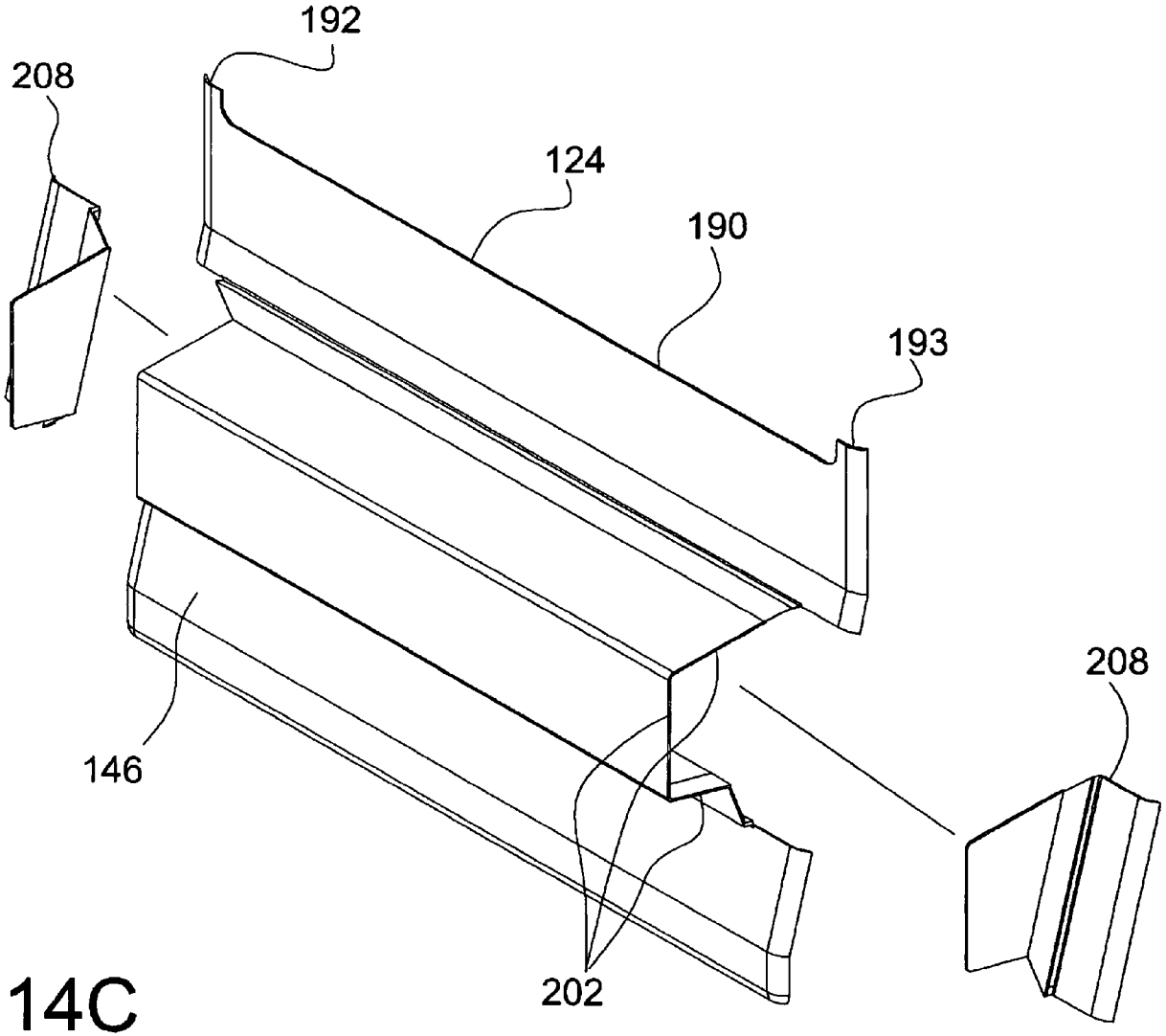

As shown in FIGS. 14C, 15A and 15B, the washer assembly 100 includes an overflow 190 formed as an elongated cutaway portion between edges 192 and 193 in sidewall 124 adjacent its top edge. When fluid in the tank 102 reaches the overflow 190, fluid spills over into the scraping station 114 (FIGS. 15A and 15B) and down the scraping station's drain. Further, grease and floating debris also spill over the overflow 190 and are disposed of in the scraping station 114. The scraping station 114 is equipped to dispose of grease and debris. Thus, the overflow 190 can serve two purposes: ensuring that the tank 102 does not overfill and spill onto the surrounding floor, and allowing grease or floating debris to be removed from the tank 102. The overflow 190 could also be formed by cutting a narrow, elongated opening in sidewall 124.

The tank 102 can be formed using a wide range of manufacturing processes. In various embodiments, the tank 102 includes an at least partially unitary construction. This can provide considerable reduction in manufacturing costs as compared to existing tank designs in which the tank walls are all formed from pieces that are welded together to form the tank. Forming two or more of the tank components unitary or monolithically with one another can reduce the overall amount of welding labor, and costs associated with manufacturing a tank.

The manufacturing process according to one particular embodiment will now be described in detail. As shown in the figures, the intake chamber 134 is on the back wall 130, and outlet chambers 146 and 148 are on the respective sidewalls 124 and 126. A substantial portion of each chamber 134, 146, and 148 is formed unitary or monolithically with the corresponding wall 130, 124, and 126 on which it is disposed.

As shown in FIGS. 14A and 14B, the tank's front and back walls 128 and 130 and bottom 120 are unitarily formed with one another. The tank's sidewalls 124 and 126, however, are separate components that are attached (e.g., welded, etc.) to the front and back walls 128 and 130 and bottom 120.

Figure 14D:
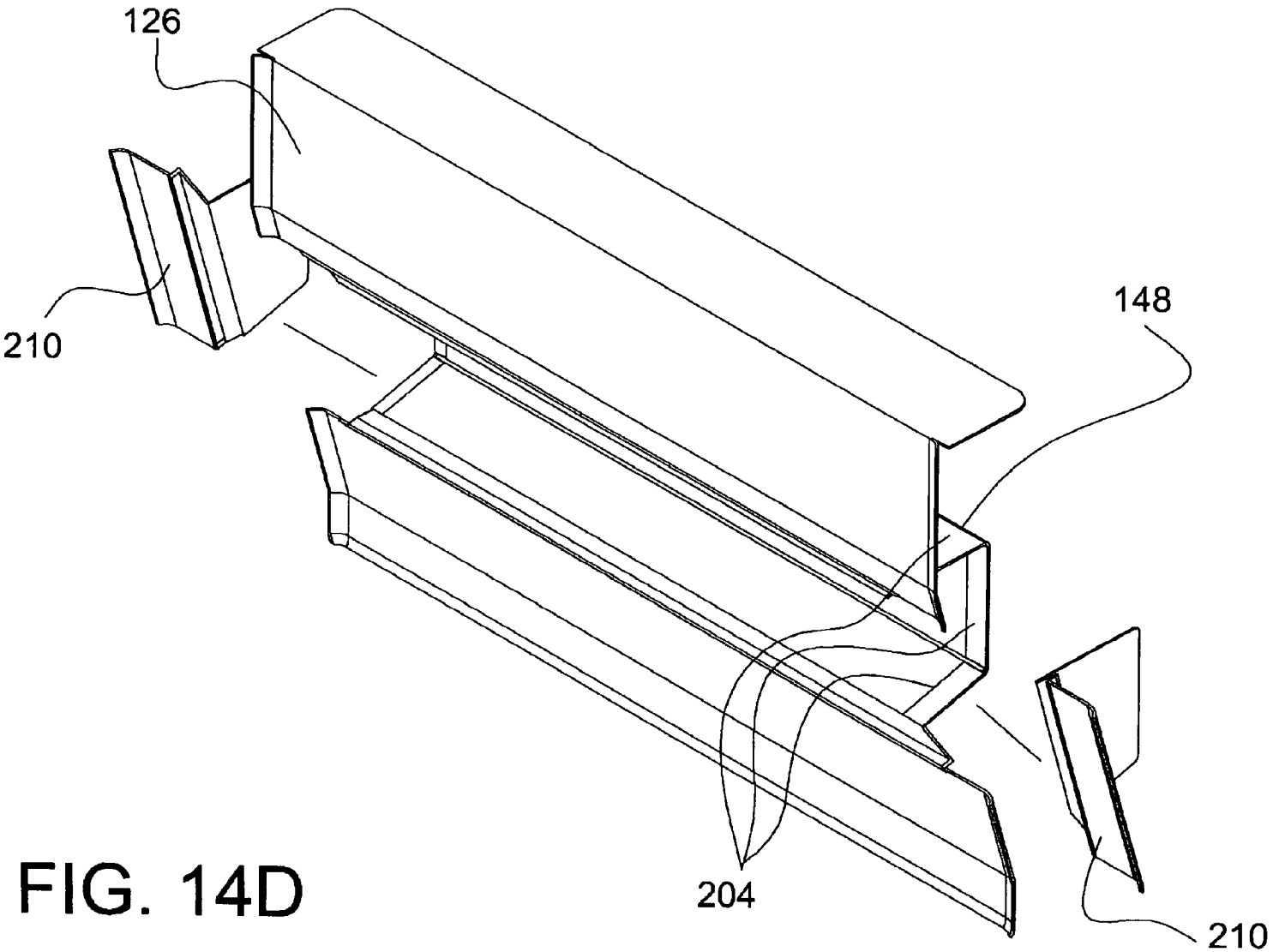
Figure 14E:
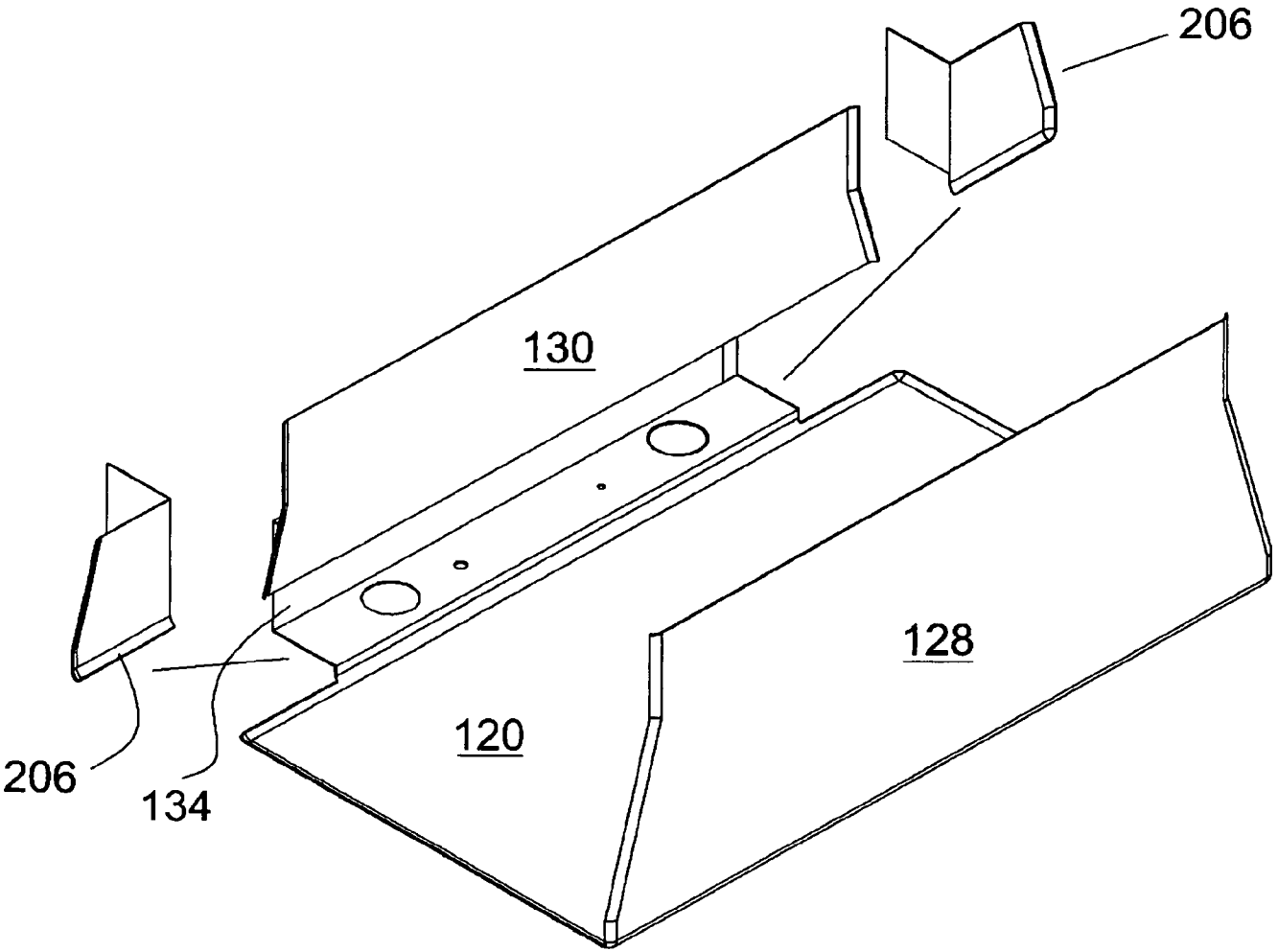

In addition, the intake chamber 134 includes a longitudinal wall 200 (FIG. 14B) that is formed unitary with the back wall 130. The outlet chamber 146 includes a longitudinal wall 202 (FIG. 14C) that is formed unitary with the sidewall 124. The other outlet chamber 148 includes a longitudinal wall 204 (FIG. 14D) that is formed unitary with the sidewall 126. Each longitudinal wall 200, 202, 204 forms at least portions of a top, back and bottom of the corresponding chamber 134, 146, 148 such that each chamber is generally box-shaped with an open side into the tank 102. Alternatively, other chamber walls besides longitudinally extending chamber walls and/or chamber walls having other geometries besides box-shaped (e.g., rounded, triangular, etc.) can also or instead be unitarily formed with a tank wall or bottom.

Each chamber 134, 146, 148 includes end walls 206, 208, 210, respectively, that are separately attached to the tank 102 and the longitudinal chamber walls 200, 202, 204. In one particular embodiment, the chamber end walls 206, 208, 210 are welded to the tank 102 and to the longitudinal chamber walls 200, 202, 204. Alternatively, other suitable methods can be used for attaching the chamber end walls.

In one particular manufacturing process, the tank 102 is formed as follows. A first sheet of stainless steel is cut and bent to form the front wall 128, bottom 120, back wall 130, and longitudinal chamber wall 200. A second sheet of stainless steel is cut and bent to form the sidewall 124 and longitudinal chamber wall 202. A third sheet of stainless steel is cut and bent to form the sidewall 126 and longitudinal chamber wall 204. The edges of the sidewalls 124 and 126 are welded to the edges of the front wall 128, back wall 130 and bottom 120. Rather than using three separate sheets of stainless steel material to form the tank 102, alternative embodiments can include using a single sheet of stainless steel material which is cut to form the three sheets of stainless steel.

The chamber end walls 206, 208, 210 are welded to the tank 102 and the corresponding chamber wall 200, 202, 204. As shown in FIG. 14A through 14E, the stainless steel portions that ultimately form the chamber end walls 206, 208, 210 also form a portion of the corresponding tank wall 130, 124 and 126. The chamber end walls 206, 208, 210 can be formed (e.g., laser cut, etc.) from the same sheet of stainless steel that is used to form the respective longitudinal chamber wall 200, 202, 206. Alternatively, the chamber end walls can each be formed from one or more separate sheets of stainless steel.

In alternative embodiments, the tank's sidewalls, front wall, and back wall are all formed unitary with one another and with the tank's bottom. These alternative embodiments can also include an intake chamber and/or an outlet chamber formed unitary with one or more of the tank walls, e.g., front, back, or sidewalls. A particular one of these alternative embodiments includes an intake having at least one wall formed unitary with the back wall, and two outlet chambers each having at least one wall formed unitary with one of the sidewalls. In this alternative embodiment, each chamber includes end walls that are separately attached (e.g., welded, etc.) to the tank and to the unitarily formed chamber walls. This tank can thus be formed as follows according to this alternative embodiment. A sheet of stainless steel is cut and bent to form the front wall, back wall, two sidewalls, bottom, and longitudinal chamber walls. The junctions between adjoining tank walls are welded to form the enclosure wall. The chamber end walls are welded to the tank and the corresponding unitarily formed chamber wall. The portions forming the chamber end walls can also form a portion of the corresponding tank wall to which it is attached. The chamber end walls can be formed (e.g., laser cut, etc.) from the same sheet of stainless steel that is used to monolithically form the tank bottom and tank walls. Alternatively, the chamber end walls can be formed from one or more separate sheets of stainless steel.

In yet another embodiment, the tank sidewalls can be unitarily formed with one another and with the tank bottom. The tank's front and back walls can be separate components that are attached (e.g., welded, etc.) to the sidewalls and the bottom. In this alternative embodiment, an intake chamber and/or an outlet chamber can be formed unitary with one of the tank walls, e.g., front, back, or sidewalls.

In each of the embodiments mentioned above, any of the chamber end walls could be formed unitary with their respective tank wall. Additionally, or alternatively, any of the chamber end walls can be formed unitary with their respective longitudinal chamber wall.

A further aspect of the invention includes a control system having a consolidated removable control module. The consolidated removable control module includes a plurality of electronic components (e.g., a circuit breaker or fuse, a motor starter, a relay, a printed circuit board electronic circuitry, etc.) for substantially controlling one or more operations of a kitchenware washing assembly. In various embodiments, the removable control module is a pluggable module that can be removed as a unit such that, in the event of a failure of one or more of the electronic components, the removable control module can simply be removed and replaced in its entirety by a layperson. Advantageously, this can allow for the elimination of costly service calls by a technician, for example, to perform diagnostics in the field to determine which individual component failed, and downtime of the machine while waiting for that service to be performed.

The control system includes electronics or similar control components for controlling one or more operations of the washing assembly. The control system can include a controller having a microprocessor, a real-time clock, a memory or other form of computer readable medium, and computer executable instructions including one or more wash cycle schemes. The computer executable instructions can be predefined or programmable by an operator. For example, the control system can include a programmable EPROM chip that provides for custom computer executable instructions to be applied to control the various components of the washing assembly, including a pump, and/or heater. Such a control system can provide for controlling a washing assembly operation such as providing power to one or more fluid pumps for extracting and injecting washing fluid from the tank. This can include controlling a variable speed motor associated with a pump for providing various cleaning fluid flow rates into and out of the tank.

The control system can also include a user interface device such as a keypad, buttons, or dial. A display can also be included for displaying programmed cycle information and other information pertinent to the use and operation of the control system and/or the washing assembly. Additionally, a data communication interface can provide for data connectivity to other systems, a remote control, and/or administration system. The user interface device or data communication interface can be utilized to provide or change a computer executable instruction of the control system.

The control system can also provide power and/or control to one or more heaters, an automatic cleaner dispenser system, and/or a water supply or drain solenoid, by way of additional examples. The control system can also receive one or more signals from sensors or other components located about the kitchenware washing assembly or from an external source. For example, a temperature signal that is indicative of a temperature of the washing fluid can be provided from a temperature sensor (e.g., thermocouple). Additionally, a fluid level sensor can provide a signal to the control system that is indicative of a fluid level within the tank. The control system can control an operation of the washing assembly as a function of the temperature signal or other received signals, the computer executable instructions, user input, and/or data input. In addition, the control system can generate outputs including an alarm output associated with the operation of the washing assembly and/or the status of a component thereof. The above control system components are set forth by way of example and are not intended to be limiting.

In operation, the control system can control the dispensing of washing fluid into the tank and the heater to heat the washing fluid in the tank to a specified temperature. The microprocessor can be programmed to provide a wash cycle program that provides cycles for predetermined time periods and the pump speed (e.g., washing fluid flow rate and/or resulting tank turbulence) and/or heat can be varied to provide predetermined cleaning cycles. The control system can provide for the removal of the washing fluid at the end of a cycle and for generating an alarm, an indicator, and/or an operational report.

The control system can be enclosed within a housing and have one or more control modules that are removable from the housing for replacement and maintenance. The housing and each control component can be configured to enable the control component to be plugged into and unplugged from the housing without requiring wiring or other similar technical and/or skilled operations on the part of the user or operator. For example, the housing can be configured to have one or more slots configured to receive one or more control components (e.g., plugs and receptacles, etc.). Each slot can include a connector for electrically coupling the control component to other components of the washing assembly such as a pump, heater, sensor, solenoid, user interface, or data communication port or interface. By being pluggable, the individual control component can be removed from the housing slot for maintenance or replacement by an operator without requiring wire management or other technical skills.

In various embodiments, the control system can be consolidated with each control module having two or more electronic components configured to substantially control one or more washing assembly operations. For example, each control module can include, but is not limited to, electronic components such as a circuit breaker or fuse, a motor starter, a relay, a transformer, a printed circuit board electronic circuitry, a processor, or a memory. In addition, the consolidated control system can be a pluggable module that can be removed as a unit. In such embodiments, if a component of the control system fails, the entire control module can be readily and quickly removed from the housing and replaced with another complete control module. This eliminates costly downtime and the need for diagnosis in the field to determine which individual component failed. The original control module can be diagnosed and repaired when convenient and returned to service when needed. In addition, this control module replacement can be performed by an unskilled operator without requiring the assistance of a skilled or semi-skilled service or repair technician.

A housing can be provided for containing the consolidated and removable control module. The housing can be located above a back portion of the tank. But the housing can be located in any position about the kitchenware washing assembly. In this manner, an operator can have easy access to the control system for operation and maintenance. Also, the control system can be positioned such that it is less susceptible to washing fluid spills. In some embodiments, the housing is positioned to be at a level between the operator's waist and eye to provide convenient operator access. In one embodiment, the lower portion or bottom of the housing can be positioned greater than about forty inches above the floor on which the washing assembly and/or the operator is standing.

The housing can include a cover for enclosing and protecting the electronic components. In some embodiments, the cover can be attached to the housing by one or more fasteners, such as a screw, and/or the cover can be attached with one or more hinges or hinge-type devices. Additionally, in some embodiments, a seal can be placed between the cover and the housing to provide a substantially water tight seal and access for the enclosed electronic components. The cover and/or the seal can be of any design, type, arrangement, or combination for enclosing and protecting the control system electronic components.

Figure 34:
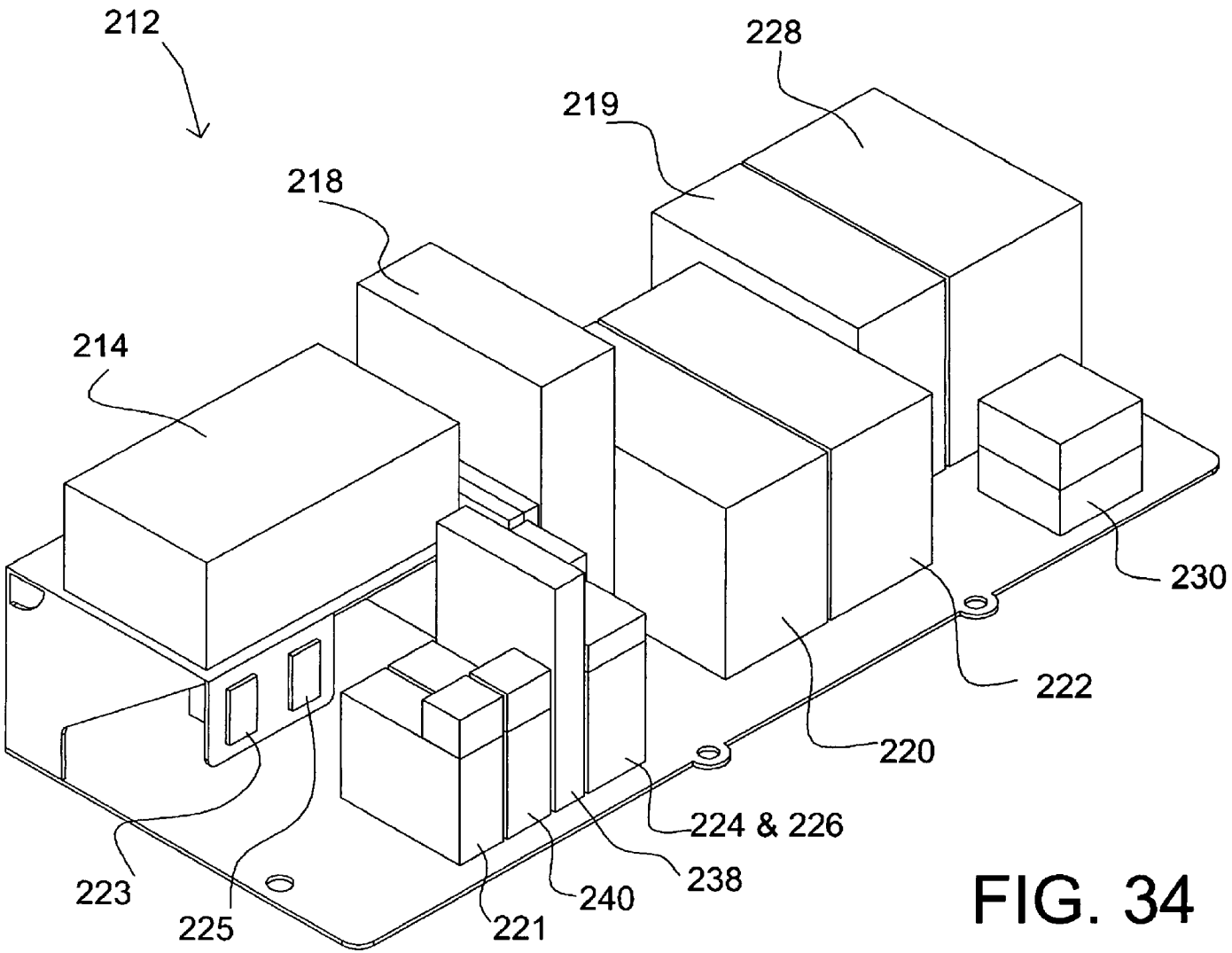
FIG. 34 is a perspective schematic view of a control system that can be used for controlling one or more operations of a kitchenware washing assembly according to one embodiment of the invention.
Figure 35:
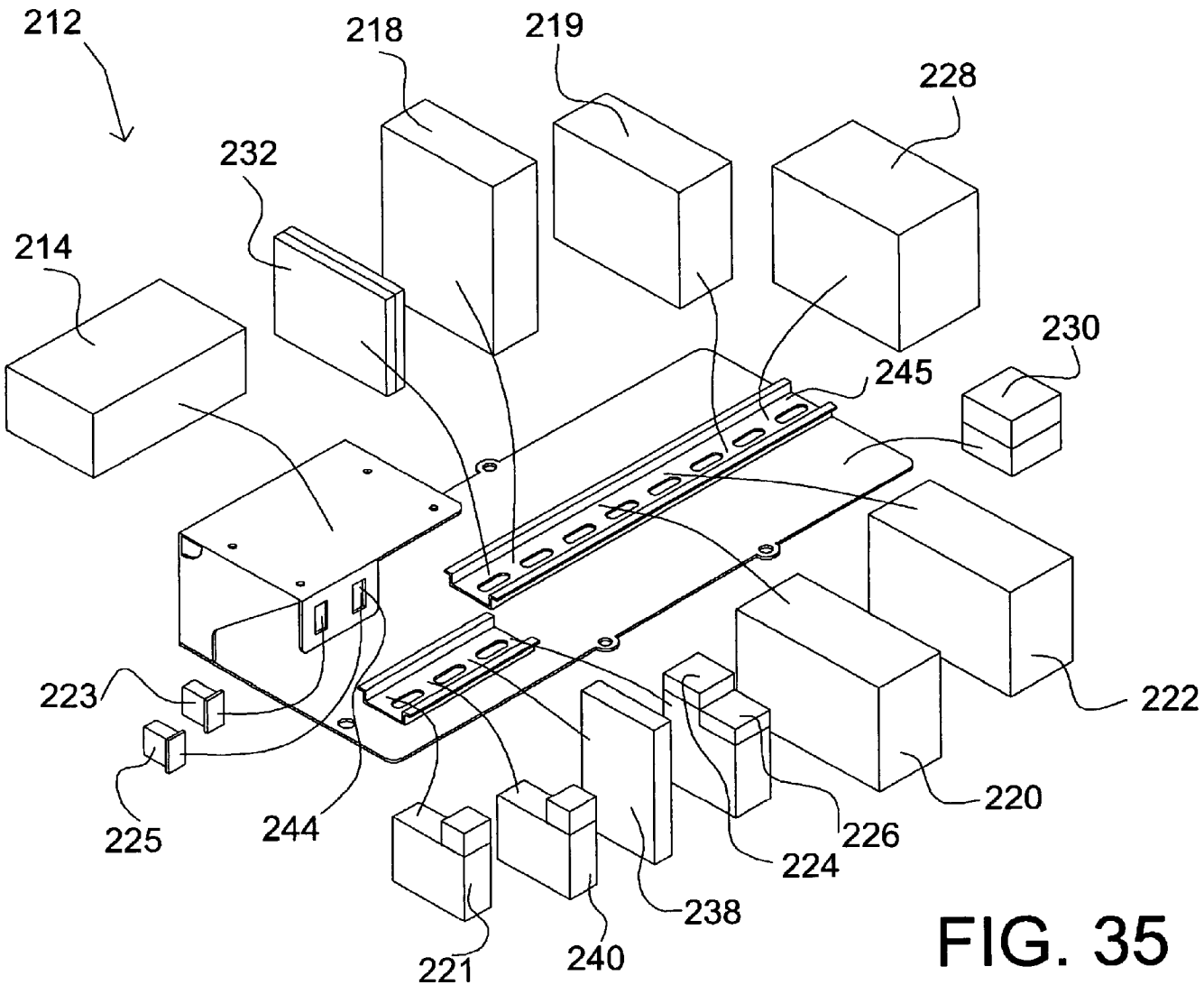
FIG. 35 is an exploded perspective schematic view of the control system in FIG. 34.
Figure 36:
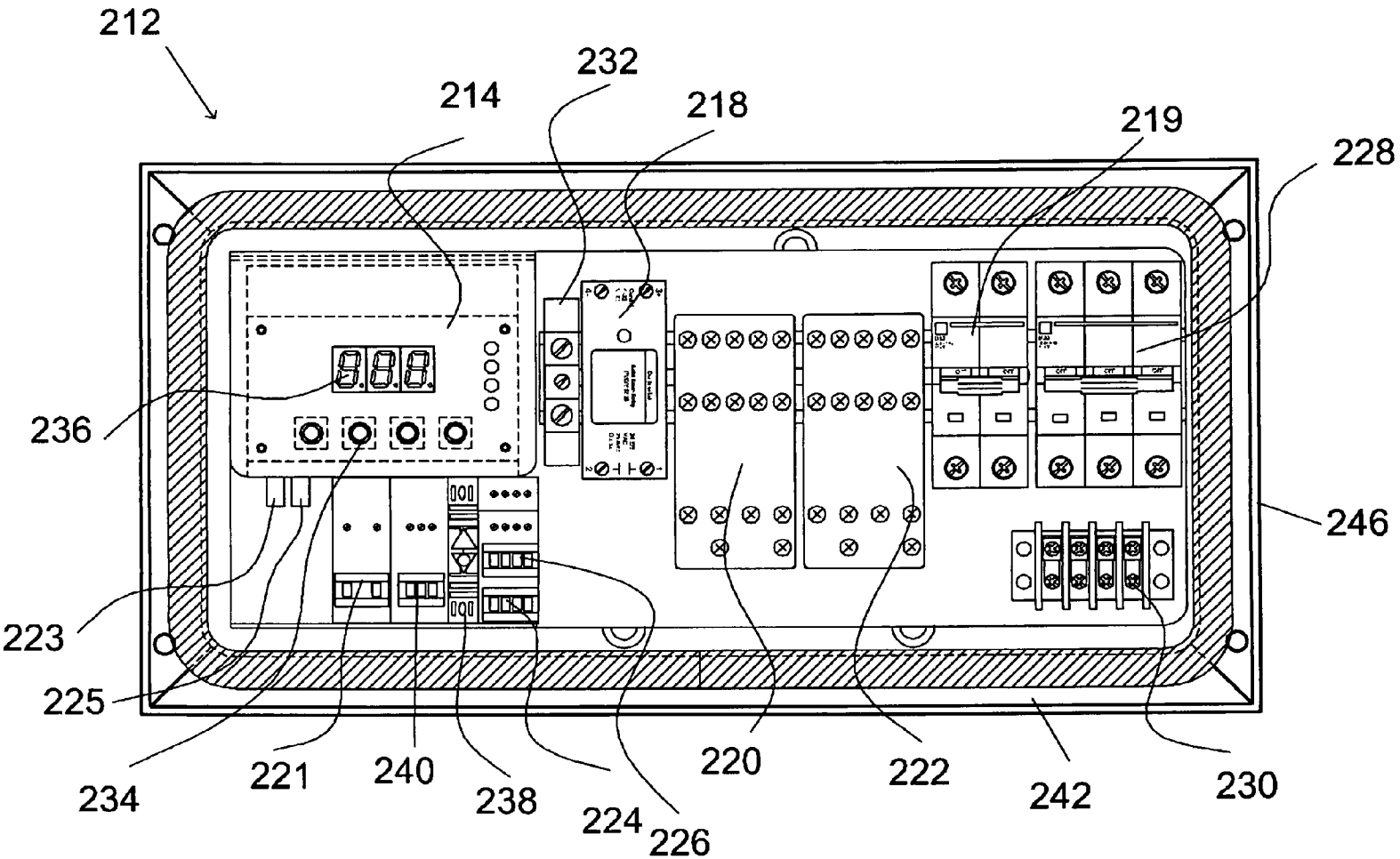
FIG. 36 is a front elevation view of the control system shown in FIG. 34.
Figure 37:
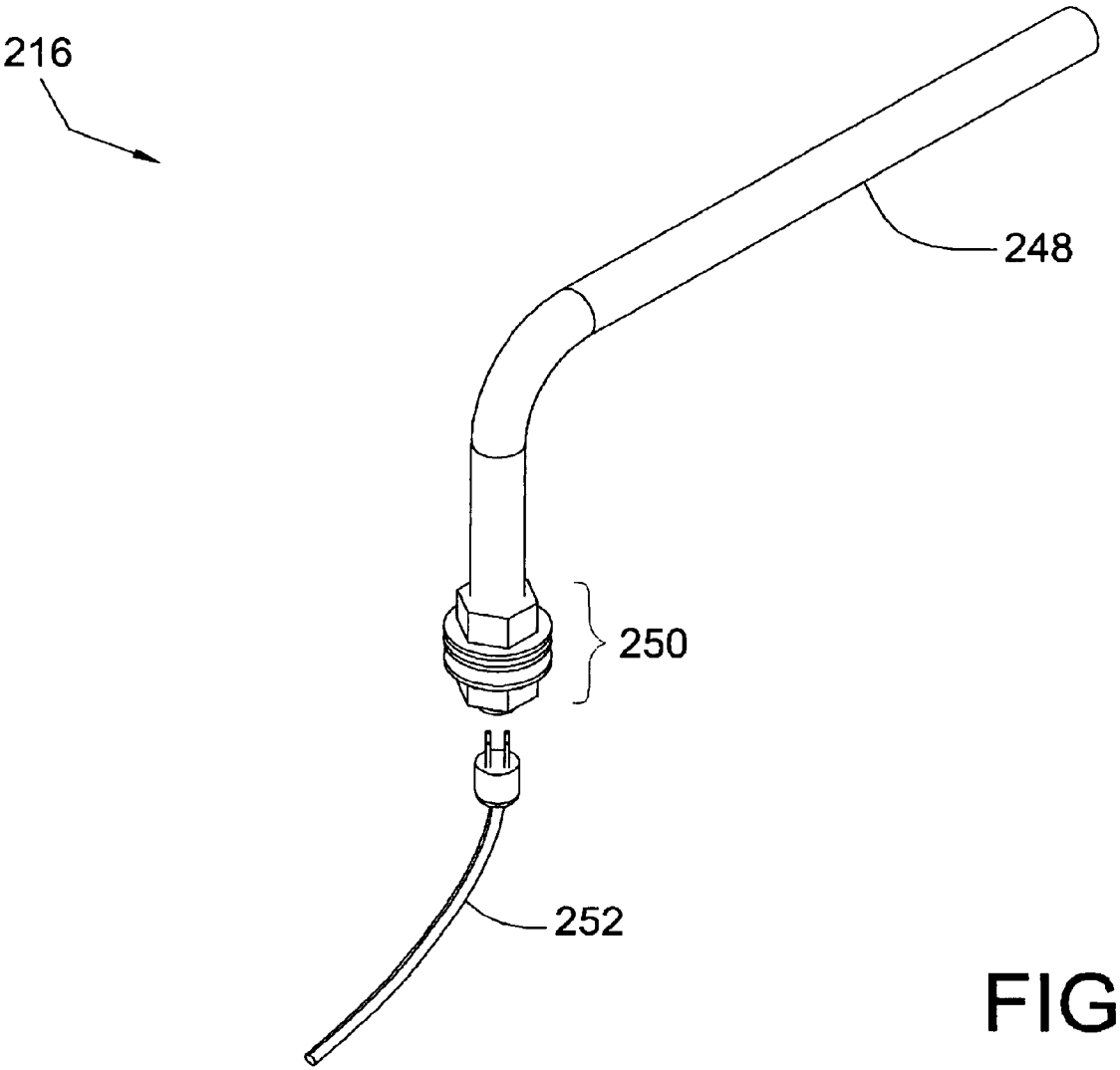
FIG. 37 is a perspective view of a heater that can be used with a kitchenware washing assembly according to one embodiment of the invention.
Figure 38:
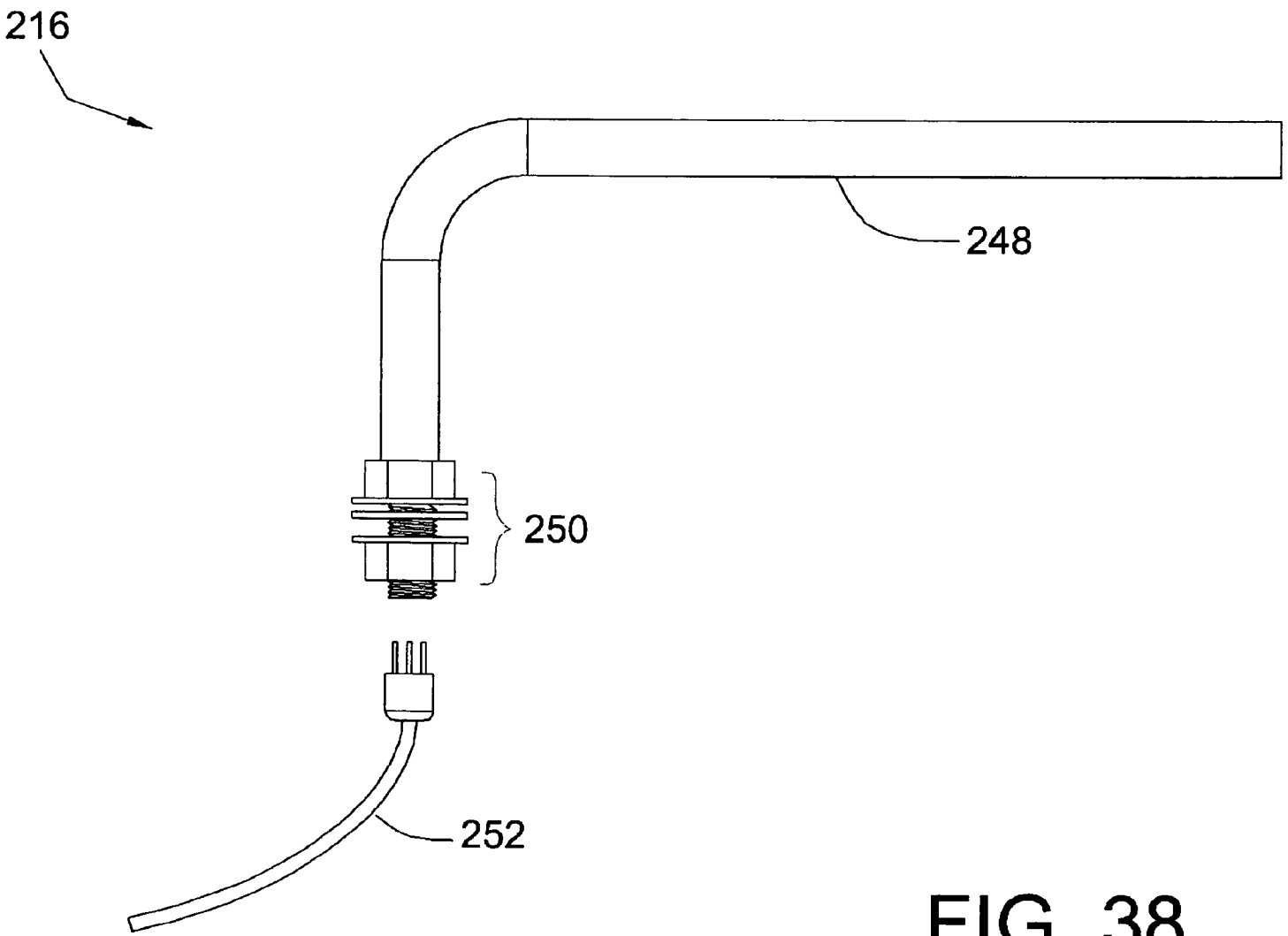
FIG. 38 is a side elevation view of the heater shown in FIG. 37.
Figure 39:
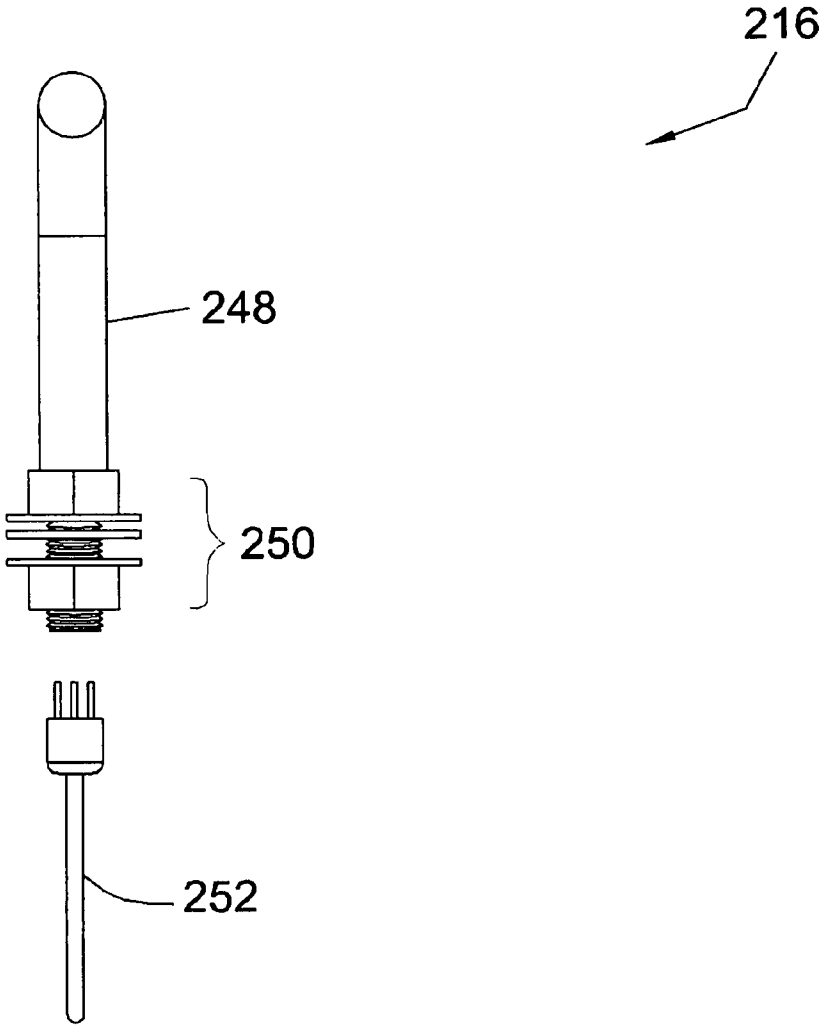
FIG. 39 is a front elevation view of the heater shown in FIG. 37.

Referring now to FIGS. 34 through 36, there is shown an exemplary implementation of a control system 212 that can be used for controlling one or more operations of the kitchenware washing assembly 100. As shown, the control system 212 includes a solid state controller 214 (e.g., microprocessor). The controller 214 is coupled to a heater 216 (FIGS. 37 through 40) through a solid-state relay 218. In addition to the heater solid-state relay 218, the control system 212 also includes a breaker 219 and a receptacle and plug 221 for the heater 216.

The control system 212 also includes one or more receptacles and plugs for one or more thermocouples. As shown, the control system 212 includes a receptacle and plug 223 for a thermocouple (or other suitable sensor) in the tank for determining the temperature of the water. The control system 212 also includes a receptacle and plug 225 for a heater thermocouple (e.g., thermocouple within the heater 216 for determining the temperature of the heater).

The controller 214 is coupled to the pumps 104 and 106, for example, for providing power to the pumps 104 and 106 and/or controlling variable speed motors associated with the pumps 104 and 106 for providing various cleaning fluid flow rates into and out of the tank 102. Regarding the motors, the control system 212 includes motor contractor and overloads 220 and 222, and motor receptacles and plugs 224 and 226.

The control system 212 also includes a main breaker 228 and a plug and receptacle 230 for the main power. The control system 212 further includes a ground block 232.

The control system 212, or more specifically, the controller 214 in the illustrated embodiment includes a control panel 234 (FIG. 36) that includes controls, such as a keypad, buttons, and/or dials, for activating the pump speeds, wash cycles, heater, and cleaner dispenser. The controller 214 also includes a display 236 (e.g., digital readout screen) for displaying programmed information and other information pertinent to the use and operation of the control system 212 and controller 214.

The control system 212 can also provide power and/or control to an automatic cleaner dispenser system. In this regard, the illustrated control system 212 includes a fuse block 238 and receptacle and plug 240 for a soap pump.

In the illustrated embodiment, the control system 212 is enclosed within a housing 242. In various embodiments, the entire control system 212 is a pluggable module that can be removed as a unit. In such embodiments, if a component of the control system fails, the entire control module can be readily and quickly removed from the housing 242 and replaced with another complete control module. This eliminates costly downtime and the need for diagnosis in the field to determine which individual component failed. The original control module can be diagnosed and repaired when convenient and returned to service when needed. In addition, the control module replacement can be performed by an unskilled operator without requiring the assistance of a skilled or semi-skilled service or repair technician. Additionally, or alternatively, each control appendage (e.g. pump motors, soap pump, thermocouples, heater, etc.) can be readily and quickly unplugged from the control system for individual replacement when required.

In various embodiments, the individual electronic components of the control system 212 can also be individually removed from the housing 242, thus also allowing for relatively easy replacement and maintenance. For example, the housing 242, microprocessor 214, solid-state heater relay 218, heater breaker 219, heater receptacle and plug 221, thermocouple receptacles and plugs 223 and 225, motor contractor and overloads 220 and 222, motor receptacles and plugs 224 and 226, main breaker 228, main power plug and receptacle 230, ground block 232, soap pump fuse block 238, and soap pump receptacle and plug 240 can be configured such that each of these various components can be individually plugged into and unplugged from the control module without requiring wiring or other similar technical and/or skilled operations on the part of the user or operator.

As shown in FIG. 35, the housing 242 includes slots 244 configured to receive components, such as the receptacles and plugs 223 and 225. Each slot 244 can include a connector for electrically coupling the component to other components of the washing assembly 100 such as thermocouples, pumps 104 and 106, heater 216, soap pump, sensor, solenoid, user interface, data communication port or interface, etc. The housing 242 also includes DIN rails 245 formed on or mounted to the housing 242 using screws, other suitable mechanical fasteners, among other methods. The solid-state heater relay 218, heater breaker 219, heater receptacle and plug 221, motor contractor and overloads 220 and 222, motor receptacles and plugs 224 and 226, main breaker 228, main power plug and receptacle 230, ground block 232, soap pump fuse block 238, and soap pump receptacle and plug 240 are configured to be detachably mounted to the DIN rails 245. Accordingly, each individual component can be relatively easily removed from its corresponding slot 244 or from the corresponding DIN rail 245 for maintenance or replacement by an operator without requiring wire management or other technical skills.

In the exemplary embodiment shown in FIG. 36, the housing 242 includes a removable cover 246 for enclosing and protecting the components within the housing 242. In some embodiments, the removable cover 246 is a laminated covered or transparent membrane that help protects the control system 212 from fluid spills from the tank 102.

Various embodiments include a heater (e.g., electric heater element, etc.) coupled to or at least partially housed within the intake chamber 134. For example, the heating element can be attached to the bottom 184 of the intake chamber 134, or may be mounted in any other suitable location. A thermocouple (or other suitable sensor) located a suitable distance away from the heater can be used for determining the temperature of the water. This thermocouple can be interfaced to a microprocessor that controls operation of the heater such that the heater maintains a specified fluid temperature in the tank. For example, in one particular embodiment, Proportional—Integral—Derivative (PID) control methodology is used during normal operation to control the temperature of the fluid in the tank. With this exemplary PID control, fluid temperature is monitored as the process variable for deviation from a desired value or set point in a continuous feedback loop. Corrective action (e.g., shutting down the heater, increasing the amount of heat produced by the heater, etc.) is taken whenever the monitored temperature sufficiently deviates from the set point. In this exemplary manner, PID control can be efficiently used to monitor the fluid temperature in the tank based on the current values and rates of change of the monitored variables.

Another thermocouple (or other suitable sensor) can be associated with (e.g., embedded, located in, or otherwise coupled to) the heater element. This second thermocouple can be used for fluid low level detection, and thus help determine whether a desired fluid level is in the tank. If this second thermocouple senses that the heater has an abrupt temperature increase (e.g., more than a predetermined temperature increase over a predetermined time interval), that detected condition is indicative of a low fluid level in which the fluid level has dropped too low to cover the heater and absorb the heat produced thereby. To help prevent damage to the heater by operating during low fluid level conditions, the second thermocouple is interfaced to a microprocessor that deactivates the heater to ensure that the heating element and pumps do not overheat.

In the illustrated embodiment, the microprocessor 214 (FIGS. 34 through 36) is coupled to the heater 216 (FIGS. 37 through 40). The control system 212 includes controls that control the microprocessor 214 to cause the heater 216 to heat the fluid in the tank 102 to a specified temperature. The microprocessor 214 is coupled to the heater through the solid-state relay 218. The microprocessor 214 can be programmed to provide a wash cycle program that provides wash cycles for predetermined time periods and the pump speed (e.g., tank turbulence) and/or heat can be varied to provide predetermined cleaning cycles. Thus, the tank 102 may operate at a mild presoak turbulence level at a higher (uncomfortable to the touch) heat to loosen caked-on food from the dishware, followed by a more turbulent flow in the tank to break away loosened food debris, followed by a final cycle at reduced temperature during which employees can finish the cleaning process.

As one example program, the following operations can be performed by the controller 214 and sensors (e.g., thermocouples) upon activation of the program: determine whether the fluid temperature is at one hundred ten degrees Fahrenheit; if it is not, cause the heater to heat the fluid to one hundred ten degrees Fahrenheit; when the fluid temperature is at one hundred ten degrees, initiate a three minute presoak cycle during which time the pumps operate at between about thirty to thirty-five hertz; proceed to a three minute intermediate cycle during which time cycle the pumps are increased to forty to forty-five hertz, thus increasing tank turbulence and cleaner agitation; proceed to a heavy duty clean cycle during which time cycle the pumps are increased to fifty to sixty hertz for eight minutes; proceed to an idle mode at about thirty hertz which prevents grease suspended in the cleaning fluid from settling back onto the kitchenware and allows removal of the kitchenware from the tank 102. It is also contemplated that overnight cycles can also be provided that allow the tank temperature to be increased to much higher temperatures of around one hundred fifty degrees Fahrenheit or higher to further facilitate cleaning. Because such temperatures are too hot for the human touch, the most difficult-to-clean kitchenware could be cleaned overnight for extended periods of time while personnel are not around and thus are not exposed to the tank of hot water. It is also contemplated that a cover could be provided to prevent personnel from putting their hands in the water and/or alarms can be activated to warn of the hot water temperature. In various embodiments, the microprocessor 214 provides preprogrammed wash cycle programs, but is also adapted to allow the user to create programs to cater to specific cleaning needs.

FIGS. 37 through 40 illustrate an exemplary heater 216 according to one exemplary embodiment of the invention. As shown, the heater 216 includes a housing 248 and a threaded coupling 250. The housing 248 is shown in a generally L-shaped configuration and is formed from stainless steel. Alternatively, other shapes and materials can be used for the housing 248.

Figure 40:
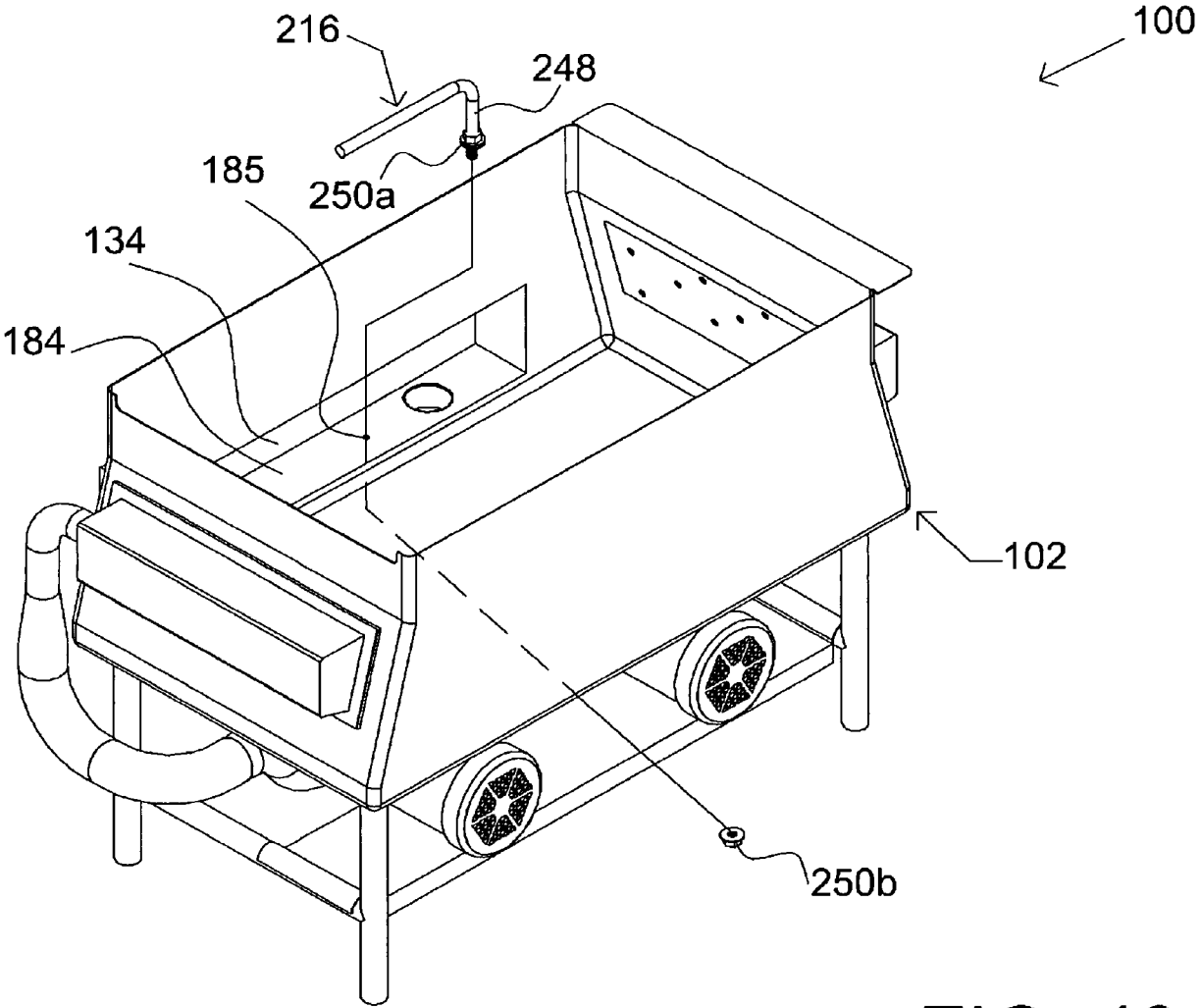
FIG. 40 is an exploded perspective view showing the heater of FIG. 37 being positioned within an intake chamber of a kitchenware washing assembly according to one embodiment of the invention.

As shown in FIG. 40, the threaded coupling 250 can be used to couple the heater 216 to the bottom 184 of the intake chamber 134, with the housing 248 positioned within the intake chamber 134. In this particular illustrated embodiment, a threaded portion 250*a* of the coupling 250 is inserted at least partially through a hole 185 in the bottom 184 of the intake chamber 134. A nut 250*b* is then threaded onto the threaded portion 250*a* to thereby attach the heater 216 to the tank 102. Alternatively, the heater 216 can be coupled to the tank 102 using other suitable means and/or positioned at other suitable tank locations, such as through a wall of the tank 102 and/or through the top of the tank. In addition, the electrical power for the heater 216 is provided by way of an electrical cord 252. Accordingly, the heater 216 can be relatively easily removed from the tank 102 by unplugging the electrical cord 252, removing the intake cover 150, and unscrewing the nut 250B. Therefore, the heater 216 in this particular embodiment can be relatively easily removed and replaced by another heater 216, thereby eliminating the need to wait and pay for a costly service call by a technician.

In one particular embodiment, the heater 216 includes a cartridge heater having a heating element within the housing 248. A thermocouple is also within the housing 248. The thermocouple can be built into or embedded within the heater 216.

When there is no water in the tank or insufficient water within the tank to cover the heater 216, the heater 216 can damage itself by overheating if it remains in operation. In various embodiments of the present invention, control logic has been provided that enables tank fluid low level detection and heater temperature high limit protection using the thermocouple integrated with the heater 216. For example, in one embodiment, the controller 214 automatically cuts power to the heater 216 if the heater temperature (as determined by the thermocouple within the heater 216) reaches a predetermined high limit set point.

As an additional or alternative way of protecting the heater 216 from overheating, the controller 214 can deactivate the heater 216 when an abrupt temperature rise of the heater 216 is detected by the thermocouple within the heater 216. An abrupt temperature rise can occur when there is insufficient water around that heater 216 to absorb the heat produced by the heater 216. When the thermocouple detects that the heater's temperature has risen by a predetermined amount over a predetermined amount of time (e.g., over the last few time slices or seconds), that detected condition is indicative that there is insufficient water in the tank to cover the heater 216. Because continued operation of the heater 216 could damage the heater 216 by overheating, the controller 214 automatically shuts down the heater 216. Additionally, or alternatively, the control system 212 could also emit a warning (e.g., visual display, emit sounds, etc.) to the operator to shut down the heater 216.

Over time and repeated wash cycles, the water within the tank can get stagnate and dirty such that the tank water needs replaced. It can be very difficult, however, to determine when to change the tank water. Plus, changing the tank water too frequently can be costly. Conversely, waiting too long to change the tank water can lead to insufficient cleaning of the kitchenware such that kitchenware will need to be rewashed. Accordingly, it is desirable to automate the decision as to when the tank water should be changed. It is also desirable to provide some means for ensuring that the tank water is in fact changed when it should be. In various embodiments, control logic has been provided for accomplishing these tasks.

Figure 44:
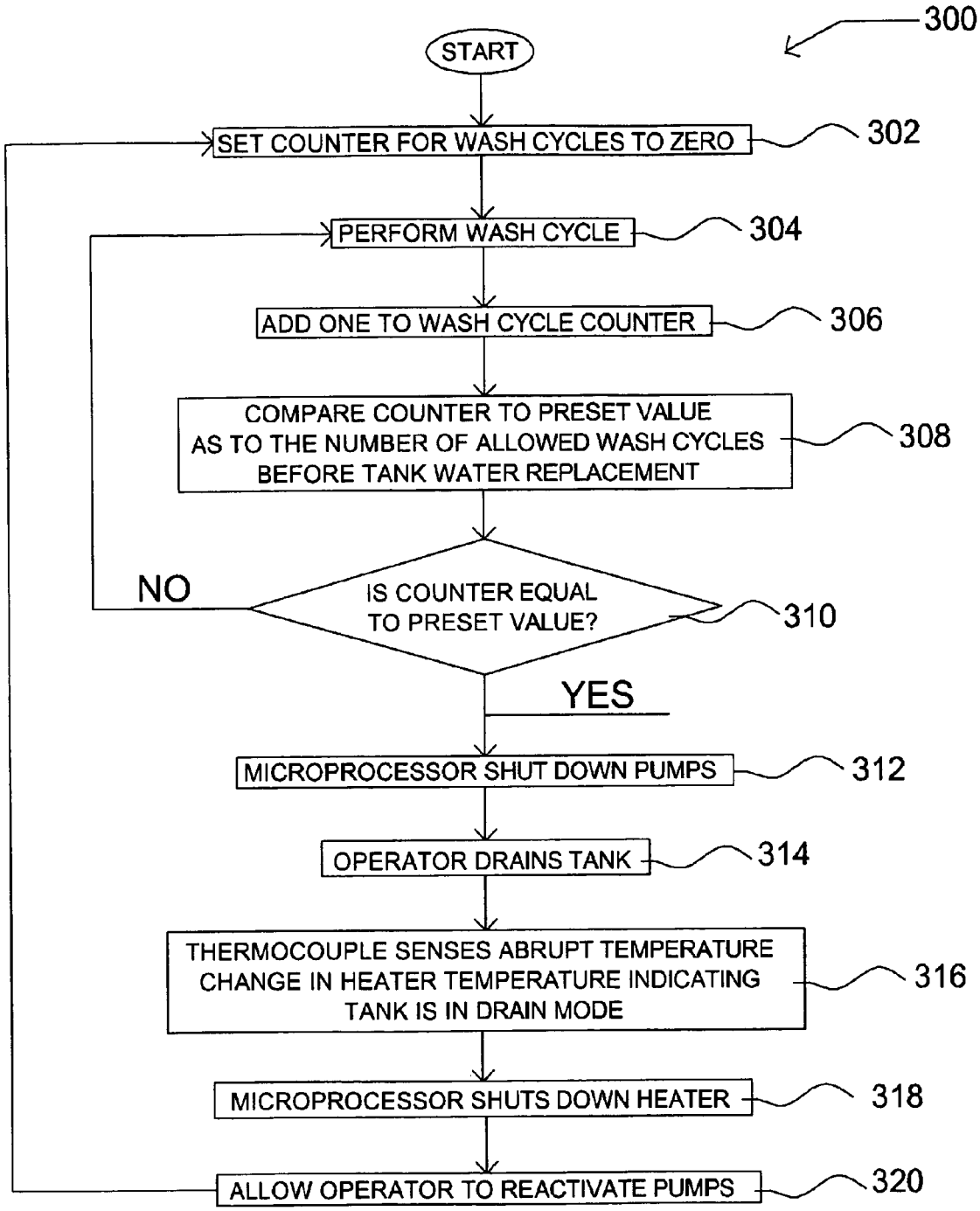
FIG. 44 is a flow diagram showing various operations of a method for monitoring tank water replacement according to one embodiment of the invention.

FIG. 44 illustrates various operations of an exemplary process 300 for monitoring tank water replacement according to one particular embodiment. As shown, the controller 214 maintains a counter that tracks the number of wash cycles, amount of run time, and/or time that has elapsed since the water was last changed. At operation 302, the counter is set to zero. For each washing cycle 304, the counter is increased by one (operation 306) and then the counter is compared (operation 308) to determine whether the counter is equal to a preset value. The preset value can be a value entered by the operator, and/or preprogrammed into the control system 212. The preset value is the allowable or acceptable number of wash cycles that can be performed before the tank water is replaced. The number of acceptable or allowable wash cycles may vary, however, depending, for example, on the particular type of items being washed and the size of the tank, among other factors.

The operator can continue performing wash cycles if the counter does not equal the preset value (operation 310). But when the counter equals the preset value, that is an indicator that the tank water should be replaced.

To help ensure that the tank water is replaced once the number of wash cycles equals the preset value, the controller 214 shuts down the pumps (operation 312) and will not allow the pumps to be reactivated until the water is drained from the tank. Accordingly, the operator should then drain the tank (operation 314).

To automatically determine whether the water is being drained or has been drained from the tank, the tank fluid low level detection described above can be employed. That is, the thermocouple within the heater 216 will detect (operation 316) a relatively abrupt temperature rise in the heating element when the water breaches or drains below the heater 216. This temperature rise indicates to the controller 214 that the tank water is being or has been drained. The controller 214 shuts down the heater 216 at operation 318. Now that the controller 214 knows that the tank water should be replaced (via operations 308 and 310) and that the tank water is being or has been drained (via operation 316), the controller 214 allows the operator to reactivate (or the controller may automatically activate) the pumps 104 and 106 (operation 320). The controller 214 also resets the counter back to zero (operation 302). Additionally, or alternatively, the control system 212 could also notify the operator (e.g., by a visual display, emitting sounds, etc.) to manually reset the counter.

Accordingly, aspects of the invention include using the heater and thermocouples for tank fluid low level detection, for heater temperature high limit protection, and for monitoring tank water replacement. These particular aspects of the invention (as can all other aspects of the invention) can be used individually or in combination with any one or more of the other aspects of the present invention.

The teachings of the present invention can be applied to a wide range of washing systems including existing washer systems for commercial or large-scale kitchens. Accordingly, aspects of the present invention should not be limited to implementation into any specific form/type of washing system.

In addition, aspects of the present invention should also not be limited to washing any particular type of items as various embodiments of the present invention provide washers that are capable of washing a variety of kitchenware, dishware, food service ware and equipment, pots, pans, food trays, grease filters, gratings, tableware, among other items. Indeed, embodiments of the present invention can also be used for meat thawing and for washing produce, fruits, vegetables, seafood, oysters, clamshells, crustaceans, non-kitchen items, non-food items, metal parts, plastic parts, etc. For example, a washing assembly of the present invention can be used for washing large quantities of potatoes that will be served at a restaurant. As another example, a washing assembly of the present invention can be used for washing plastic or metal parts in a manufacturing or industrial application.

Certain terminology is used herein for purposes of reference only, and thus is not intended to be limiting. For example, terms such as "upper", "lower", "above", and "below" refer to directions in the drawings to which reference is made. Terms such as "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present invention and the exemplary embodiments, the articles "a", "an", "the" and "said" are intended to mean that there are one or more of such elements or features. The terms "comprising", "including" and "having" are intended to be inclusive and mean that there may be additional elements or features other than those specifically noted.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A kitchenware washing assembly comprising a tank for holding fluid for washing kitchenware, at least one pump, at least one outlet for dispensing fluid into the tank, at least one intake chamber for receiving fluid from said tank, the intake chamber including at least a portion that is sloped to provide positive drainage along at least one inner surface within the intake chamber into the tank, and at least one intake cover for separating the intake chamber from the tank, said intake cover including a plurality of inlets and a projection extending into the tank, the projection configured to inhibit kitchenware from being drawn up flush against the inlets of the intake cover.

2. The assembly of claim 1, wherein said projection extends across a substantial portion of the intake cover.

3. The assembly of claim 1, wherein the intake cover includes a plurality of projections extending into the tank.

4. The assembly of claim 1, wherein the projection is a rib that generally extends from a first side of the intake cover to a second side of the intake cover.

5. The assembly of claim 4, wherein the rib includes at least a portion of the inlets.

6. The assembly of claim 1, wherein the projection has a generally V-shaped longitudinal cross-section.

7. The assembly of claim 1, wherein the intake cover is detachable from said tank and said intake chamber.

8. The assembly of claim 1, wherein the inlets are patterned to substantially distribute the flow of intake fluid across the intake cover.

9. The assembly of claim 1, wherein the inlets are patterned to substantially evenly distribute the intake fluid pressure across a length of the intake cover.

10. The assembly of claim 9, wherein the inlets are patterned such that more material mass of the intake cover is distributed in front of a fluid conduit connecting the pump to the intake chamber.

11. The assembly of claim 1, wherein at least a portion of the inlets are adjacent the bottom of the intake chamber thereby allowing fluid flowing along the at least one inner surface to drain from the intake chamber into the tank.

12. The assembly of claim 1, wherein the intake cover is oriented at an angle above horizontal.

13. The assembly of claim 1, wherein the intake cover is oriented at an angle of about forty-five degrees or more above horizontal.

14. The assembly of claim 1, wherein the intake cover is oriented substantially vertically.

15. The assembly of claim 1, wherein the intake cover is positioned to be substantially submerged by fluid in the tank during operation of the assembly.

16. The assembly of claim 1, comprising at least one side wall defining at least a portion of the tank, the intake cover being attached to the tank in a substantially parallel configuration with the at least one side wall.

17. A kitchenware washing assembly comprising a tank for holding fluid for washing kitchenware, at least one pump, at least one inlet for receiving fluid from said tank, at least one outlet chamber on at least one wall of the tank for dispensing fluid into the tank, a resilient sealing member, and a plurality of detachable outlet covers each configured to cover the outlet chamber and each having a plurality of outlets forming a different pattern from the other detachable covers, and after being detached, each of the detachable outlet covers being readily reattachable by mechanical fasteners for covering the outlet chamber, wherein the resilient sealing member is positioned to provide a fluid tight seal between the outlet cover and at least one of the tank and the outlet chamber, whereby flow patterns of fluid into the tank may be selectively changed for different washing operations by selecting which of the interchangeable outlet covers is used for covering the outlet chamber.

* * * * *